United States Patent [19]

Malott et al.

[11] 4,050,277

[45] Sept. 27, 1977

[54] METHOD AND EQUIPMENT FOR ROLL FORMING PRODUCTS OF COMPLEX SHAPE

[75] Inventors: Richard C. Malott, Spring Lake; Donald J. Trainer, Ludington, both of Mich.

[73] Assignee: Leigh Products, Inc., Coopersville, Mich.

[21] Appl. No.: 687,511

[22] Filed: May 18, 1976

[51] Int. Cl.[2] ..... B21D 5/08

[52] U.S. Cl. ..... 72/129; 72/181; 72/186; 29/155 R

[58] Field of Search ..... 72/181, 178, 177, 130, 72/129, 204, 186; 29/155 R

[56] References Cited

U.S. PATENT DOCUMENTS

| | | | |
|---|---|---|---|
| 1,673,787 | 6/1928 | Frahm et al. | 72/181 X |
| 1,843,064 | 1/1932 | Chesney | 72/186 |
| 1,888,151 | 11/1932 | Walper | 72/186 |
| 2,083,370 | 6/1937 | Greulich | 72/186 |
| 2,181,228 | 11/1939 | Gersman | 72/186 X |
| 2,248,088 | 7/1941 | Kane | 72/181 |
| 2,251,967 | 8/1941 | Yoder | 72/181 X |
| 2,294,324 | 8/1942 | Wilkens et al. | 72/181 X |
| 3,367,161 | 2/1968 | Avakian | 72/186 |

*Primary Examiner*—Milton S. Mehr

*Attorney, Agent, or Firm*—Price, Heneveld, Huizenga & Cooper

[57] ABSTRACT

A multistation roll form machine for forming an article of complex shape such as a roof ridge vent having integral dams along the inner lateral edges of the ventilation panels includes a longitudinally extending support frame, a first group of individual roll forming stations, a lancing subassembly and a second group of individual roll forming stations. Each of the individual stations includes upper and lower roller die sets for continuously and progressively bending the stock material as it is fed through the machine. The first group of roll forming stations progressively bends the stock on itself to form dam portions integral with the lateral edges of the ventilation panels. The lancing subassembly positioned immediately downstream of the first group of individual stations, includes two pairs of outer and inner lancing rolls having teeth formed around their circumferences which lance the stock to form the ventilation openings. The second group of forming stations in conjunction with a pair of progressively angled, longitudinally extending support bars, bend the stock to its final, predetermined cross-sectional shape. The method includes the steps of progressively bending the stock to form double bend portions of the stock lancing areas of the stock to form openings and then progressively bending the lanced stock into the final complex, cross-sectional shape.

58 Claims, 70 Drawing Figures

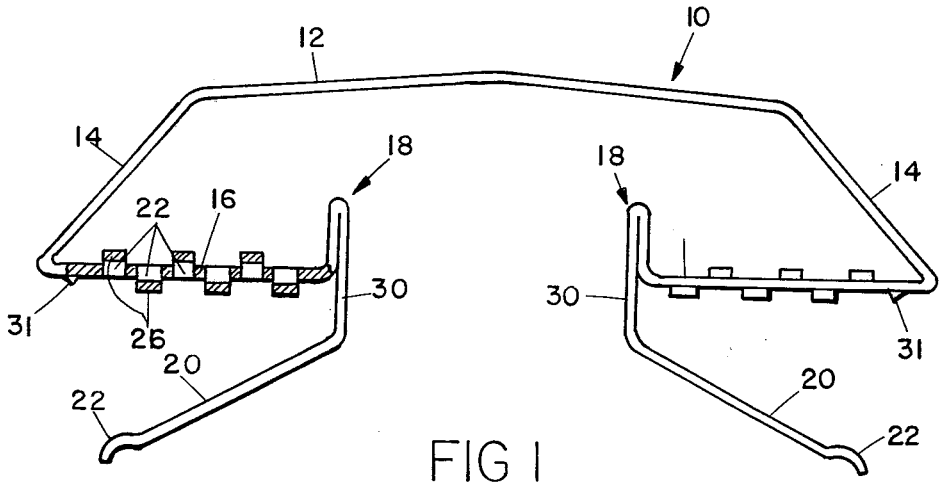
FIG 1
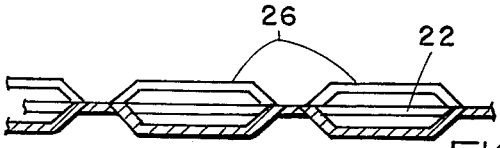
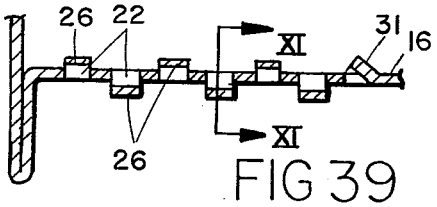
FIG 39
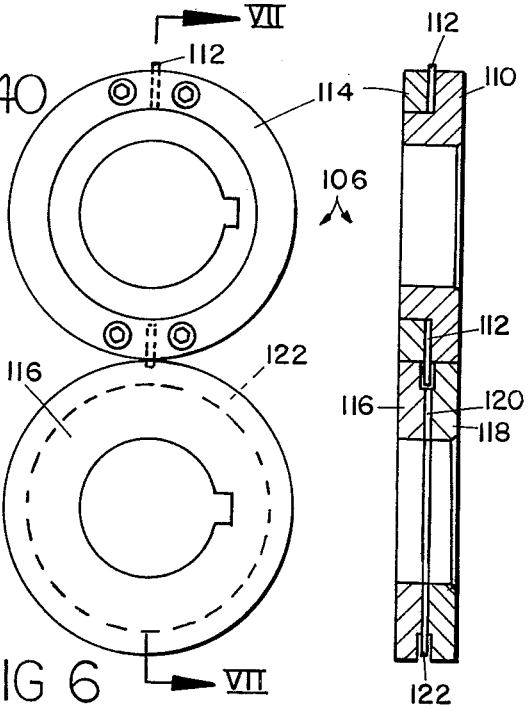
FIG 40
FIG 6
FIG 7
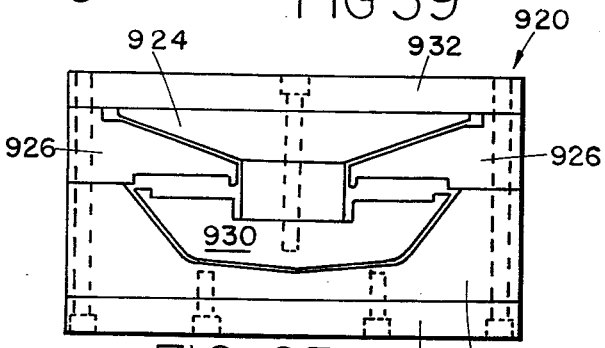
FIG 63
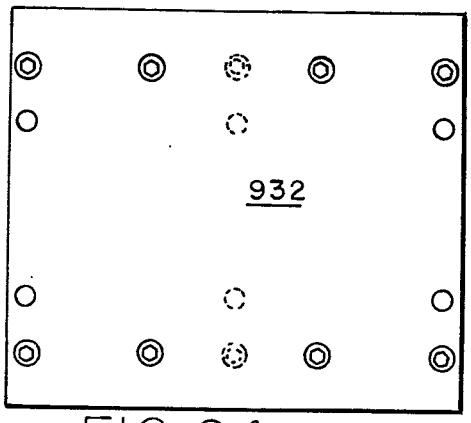
FIG 64
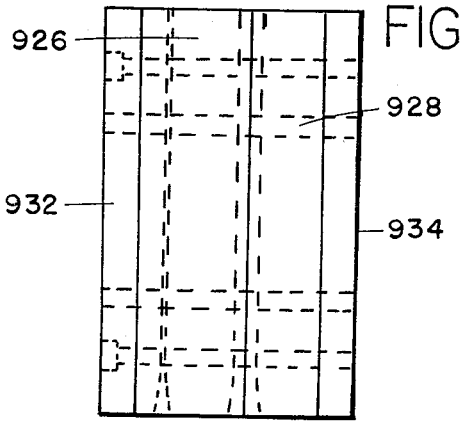
FIG 65

METHOD AND EQUIPMENT FOR ROLL FORMING PRODUCTS OF COMPLEX SHAPE

BACKGROUND OF THE INVENTION

This invention relates to a method and apparatus for roll forming products of complex shape and, more particularly, to a unique method and apparatus for fabricating on a continuous basis a roof ridge ventilator having an integral dam on a continuous basis.

Heretofore, various forms of roof ridge vents have been proposed. These roof ridge vents are mounted at the peak or ridge of a roof structure and are employed to provide natural attic ventilation in conjunction with soffit vents. Each ventilator section usually includes a hood portion or cover, generally horizontal, inwardly extending ventilation panels, downwardly extending inner side walls and flashing portions. An example of one such roof ridge ventilator may be found in commonly owned, copending U.S. application, Ser. No. 597,029, filed July 18, 1975 and entitled VENTILATOR FOR ROOF RIDGE, now U.S. Pat. No. 4,000,688, issued Jan. 4, 1977. As disclosed therein, the ventilator includes a hood portion, inwardly extending ventilation panels each having formed, integral with the inner lateral edge thereof and an upwardly extending dam. The dam is defined by a vertical lip and an inner vertical side wall, reverse reversedly bent and formed integral with the lip. The ventilation panel includes a plurality of longitudinally extending vent openings, transversely spaced across the panel. Each vent opening is hooded by an offset strap. The straps extend from the panel in alternate rows, offset oppositely from the panel. The central portion of each strap is generally parallel to the panel and must be formed by a double lancing process.

Roof ridge vents of the type illustrated in the aforementioned application have not been economically or commercially formable on a continuous basis from coiled aluminum stock by a rolling mill process. This has resulted primarily from problems encountered with forming the integral dam structure adjacent the ventilation panel. Once the ventilation panels have been lanced to form the vent openings, these panels cannot be touched by the forming apparatus. As a result, roof ridge vents including an integral dam structure have not been mass produced from aluminum stock due to the inherent fabrication problems. Although roll form apparatus such as that illustrated in U.S. Pat. No. 2,251,967 to Yoder entitled MACHINE FOR AND PROCESS OF FORMING STRUCTURAL MEMBERS and issued on Aug. 12, 1941, have been employed to fabricate a wide variety of products of complex shape, they have not been employed for the fabrication of roof ridge ventilators including integral dam structures.

A need therefore exists for a method and apparatus for fabricating roof ridge ventilators having integral dam structures on a continuous basis from coiled or sheet aluminum stock and which is economically and commercially practicable.

SUMMARY OF THE INVENTION

In accordance with the present invention, a unique method and apparatus is provided whereby the problems heretofore experienced in the fabrication of roof ridge vents on a continuous basis are substantially eliminated. Essentially, the unique apparatus includes a longitudinally extending frame structure for supporting a first group of individual rolling stations, a lancing subassembly, and a second group of individual rolling stations.

The first group of individual roll forming stations progressively bends the initially flat aluminum stock into a cross-sectional shape whereby the ventilation panels may be lanced after the integral dams are formed by reverse bending of the stock material. Each individual station includes upper and lower roll sets driven to pull the stock through the apparatus and progressively bend the stock.

The lancing subassembly includes two pairs of inner and outer lancing rolls. The pairs of lancing rolls are offset lengthwise of the apparatus. Each pair of lancing rolls is positioned to lance a ventilation panel portion of the stock. Provision is made for synchronizing the operation of the pairs of lancing rolls.

The second group of individual roll forming stations progressively bend the lanced stock into its final cross-sectional shape. A pair of transversely spaced, angled, longitudinally extending support or guide bars cooperate with some of the individual stations of the second group to progressively bend the stock into the final cross-sectional shape.

Provision is made for forming nail holes adjacent the lateral edges of the sheet stock as it initially enters into the roll forming apparatus. Further, provision is made for automatically cutting the continuously moving stock into sections of suitable length after passage through the final roll forming station.

In its broader aspects, the method in accordance with the present invention contemplates progressive deformation of flat or coiled aluminum stock whereby the hood portions of a roof ridge vent are partially formed and the reversed bend, integral dam portion is formed. Next, the ventilation panels are lanced so that the panels define vent apertures and finally, the stock is progressively bent into the final cross-sectional shape.

BRIEF DESCRIPTION OF THE DRAWINGS

FIGS. 1 is a front, elevational view in partial section of a roof ridge vent which may be fabricated on a continuous basis by the apparatus in accordance with the present invention;

FIG. 6 is an enlarged, elevational view illustrating the upper and lower rolls of the rotary nail punch subassembly;

FIG. 7 is a cross-sectional view taken along line VII—VII of FIG. 6;

FIG. 39 is a fragmentary, elevational view showing the stock material after it passes through the lancing subassembly;

FIG. 40 is a cross-sectional view taken generally along line XL—XL of FIG. 39;

FIG. 63 is a front, elevational view of a straightener subassembly positioned immediately downstream of station No. XX;

FIG. 64 is a top, plan view of the straightener subassembly;

FIG. 65 is a side, elevational view of the straightener subassembly;

DETAILED DESCRIPTION OF THE PREFERRED EMBODIMENT

Figure 2:
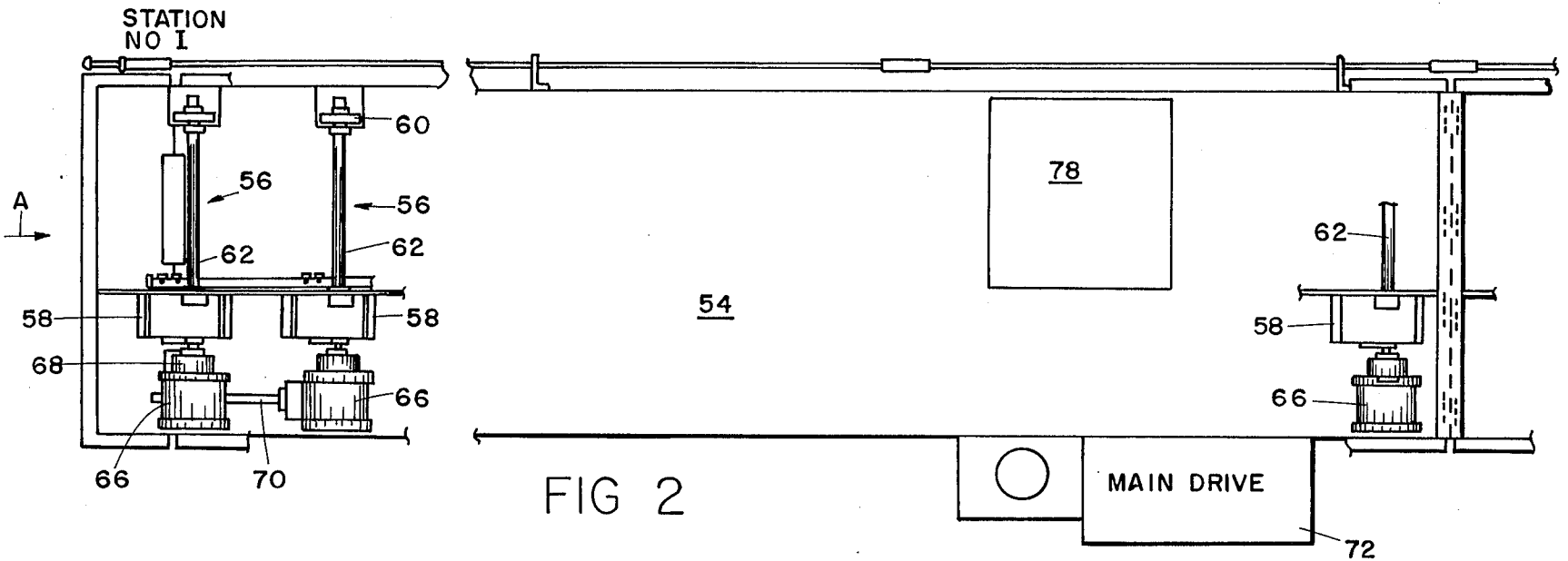
FIG. 2 is a fragmentary, plan view schematically illustrating the general layout of the roll forming apparatus in accordance with the present invention.

The unique roll forming apparatus in accordance with the present invention is primarily adapted to produce a roof ridge ventilator of the type illustrated in FIG. 1 and generally designated 10. As shown, the ventilator is of a complex cross-sectional shape and includes a peaked hood 12, depending outwardly extending outer side walls 14, inwardly extending, generally horizontal ventilation panels 16, an integral dam 18 and depending, downwardly extending inner side walls 30 and outwardly extending flashing portions 20. A stiffening lip 22 extends longitudinally adjacent the lateral edges of the flashing portions 20. Each ventilator panel 16 includes a plurality of longitudinally extending rows of ventilation slots 22. The ventilation slots are formed in rows and further positioned transversely across the ventilation panel. Each ventilation slot 24 is hooded by an offset strap 26. The straps 26 in alternating rows are offset oppositely from the panel and the central portion of each strap is positioned generally parallel to the plane of the panel. Each integral dam 18 is defined by an upwardly extending lip 28 and a portion of the downwardly extending inner side wall 30 formed by reverse bending of flat stock material. The stock material is typically coiled aluminum. In a preferred embodiment of the ventilator of the vent openings are shielded by a downwardly and inwardly inclined lips 31. A more detailed description of the integral one-piece roof ridge ventilator may be found in commonly owned, copending U.S. application, Ser. No. 597,029, filed July 18, 1975, in the name of Richard C. Malott and entitled VENTILATOR FOR ROOF RIDGE, now U.S. Pat. No. 4,000,688, issued Jan. 4, 1977. The disclosure of this copending application is herein incorporated by reference.

As previously mentioned, roof ridge ventilators of the type illustrated in FIG. 1 having an integral dam structure formed by reverse bending of the stock material, have heretofore not been commercially producable on a continuous basis from sheet or coiled aluminum stock by a rolling mill process. The complex cross-sectional configuration has not been formable in an economical and commercially acceptable manner by presently available equipment or presently known continuous methods since the ventilation panels may not be touched after the vent openings have been formed therein.

GENERAL LAYOUT OF THE APPARATUS

Figure 3:
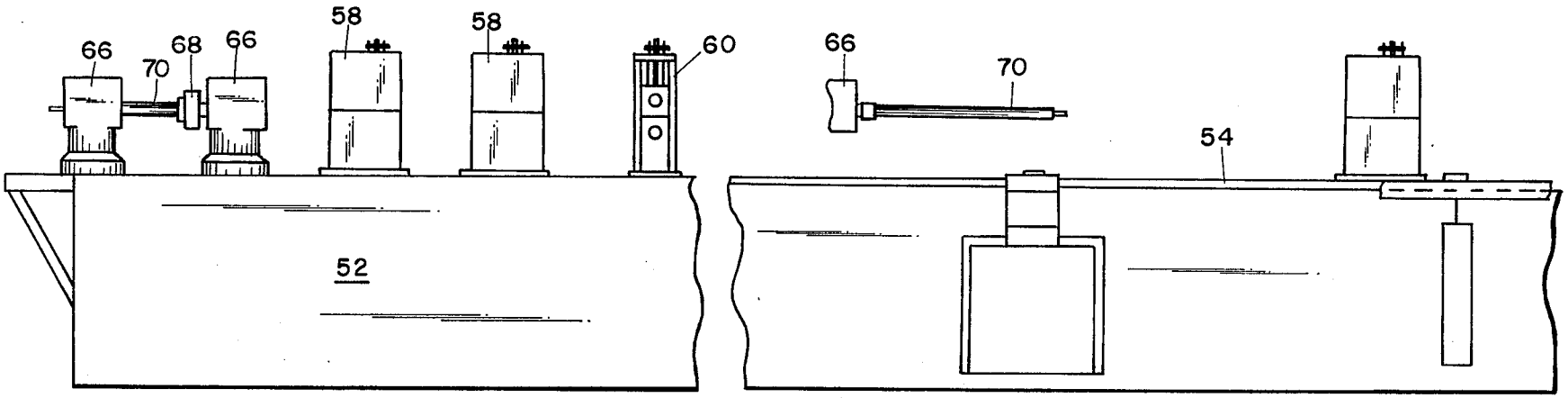
FIG. 3 is a front, elevational view schematically illustrating the general layout of the roll forming apparatus.
Figure 4:
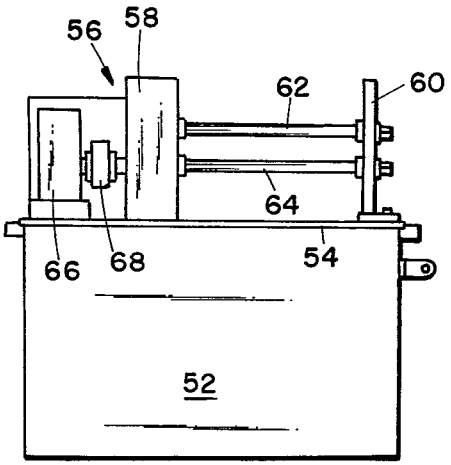
FIGS. 4 is an end, elevational view of the roll forming apparatus.
Figure 38:
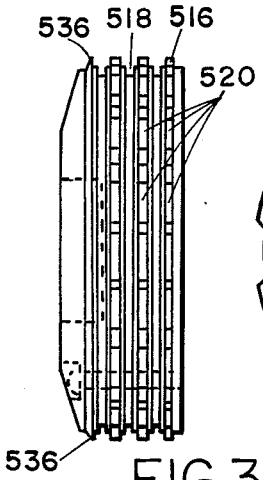
FIG. 38 is an elevational view of the inner lancing roll.

The general layout of the unique roll forming apparatus in accordance with the present invention which solves the problems heretofore experienced in the manufacture of the aforementioned type of roof ridge ventilator or any type of product having a complex shape which requires reverse bending of the material and punching or lancing of apertures in the stock during the forming process, is illustrated in FIGS. 2, 3 and 4. The rolling mill apparatus 50 includes a bed or frame structure 52. The bed 52 includes a horizontally positioned, longitudinally extending support surface 54 upon which the various roll forming stations are securely mounted. The bed 52 supports a plurality of stations each generally designated 56. In the preferred embodiment such stations are employed in conjunction with a lancing subassembly, generally designated 78.

Each of the stations includes a support head drive assembly 58 and a spaced, opposed, adjustable shaft support stand 60. Supported between the head 58 and stand 60 are upper and lower shafts 62, 64, respectively. As will be more fully explained below, the shafts 62, 64, are adapted to receive and nonrotatably support the variously configured rolls or rolling dies employed to progressively bend the stock material on a continuous basis as it passes through the apparatus. Each of the lower shafts 64 are directly driven by constant input, variable output drives 66. Each of the drives 66 is coupled to the lower shaft through a coupling 68. The input to each drive unit 66 is provided by a plurality of connecting shafts 70. The drive units 66 are preferably of a conventional cone drive type. These drives may be adjusted so that the peripheral speed or angular speed of the rollers at each station is constant and equal. As a result, the linear velocity of the stock will be constant throughout the apparatus. The main drive 72 shown schematically in FIG. 2 and more fully described below is coupled to one of the shafts 70 and provides the input to each of the cone drives 66.

ROTARY NAIL PUNCH SUBASSEMBLY

Figure 5:
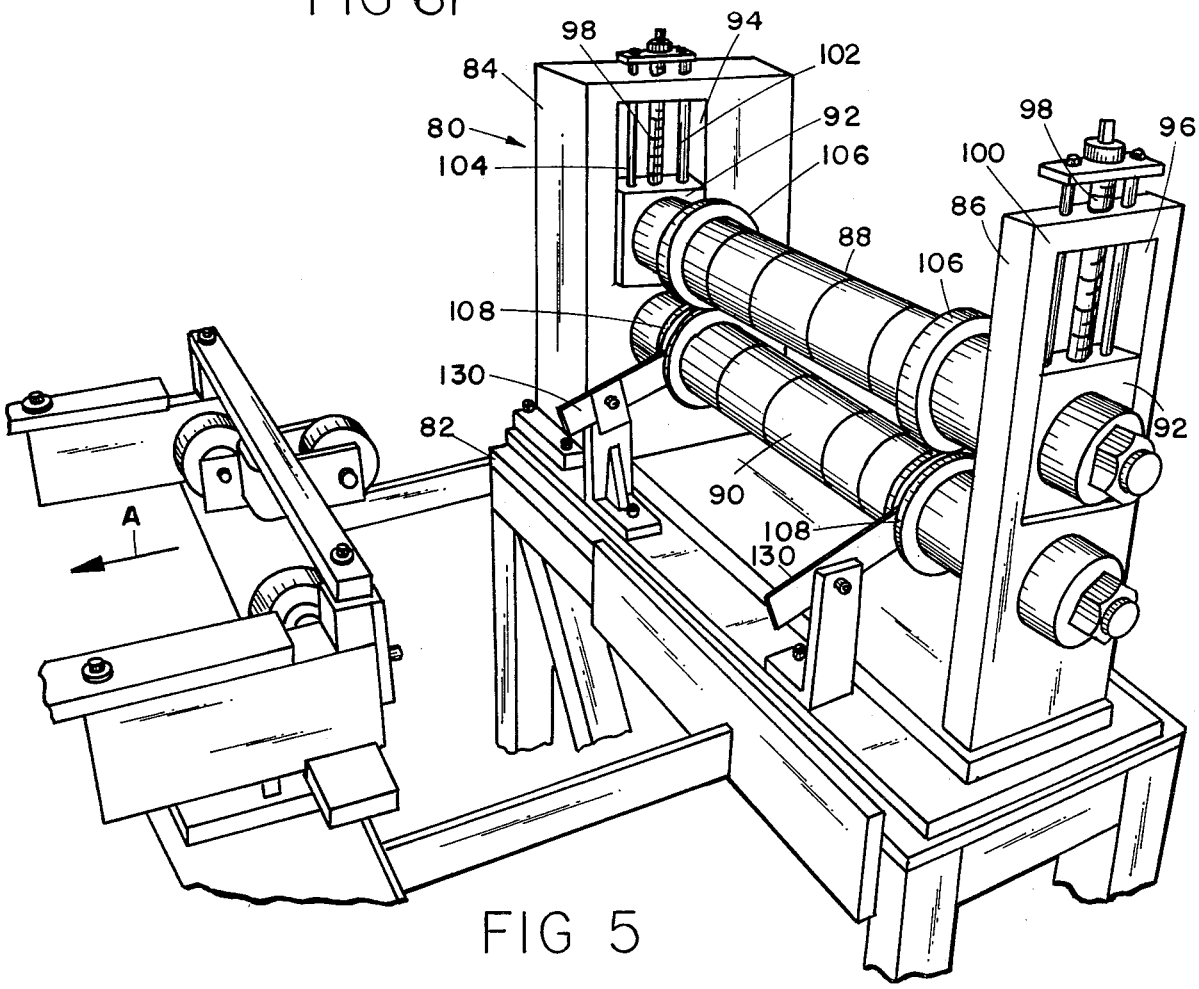
FIG. 5 is a perspective view of the rotary nail punch subassembly positioned at the inlet to the roll forming apparatus.

As best seen in FIGS. 2 and 5, the stock material which is preferably provided in a coiled form enters the roll forming apparatus in the direction of arrow A just upstream of station I. Positioned adjacent the inlet of the apparatus is a rotary nail punch subassembly generally designated 80. The rotary nail punch subassembly includes a support stand 82, a pair of opposed, spaced standards 84, 86, which support opposite ends of an upper shaft 88 and a lower shaft 90. The ends of upper shaft 88 are rotatably received in journal blocks 92 which are positioned for vertical movement within slots 94, 96, formed in standards 84, 86, respectively. A screw 98 is threaded through the bridge portions 100 of each of the standards. The screw 98 in conjunction with rods 102, 104, permits vertical adjustment of the upper shaft 88 relative to the lower shaft 90. The upper shaft 88 supports a pair of spaced, upper nail punch rolls 106. The lower shaft 90 similarly supports a pair of spaced, lower rolls 108. Rolls 108 and rolls 106 are positioned in a superimposed relationship relative to each other and are adapted to punch longitudinally spaced nail holes in the stock material as it is pulled through the rotary nail punch.

As best seen in FIGS. 6 and 7, the upper roll 106 includes a flanged hub 110. A pair of diametrically positioned studs 112 are clamped to the flanged hub 110 by a ring clamp 114. The lower or bottom roll 108 includes a pair of concentric, superimposed rings 116, 118. Sandwiched between the rings 116, 118 is a shim 120. The shim 120 has a thickness approximately equal to the diameter of the studs 112. Therefore, the lower roll includes a peripheral groove 122 positioned in the same plane as the studs 112.

In operation, as the sheet stock or coiled stock is drawn through the nail punch, the upper and lower rolls will rotate and the studs or punches 112 will pierce the stock thereby forming longitudinally spaced nail holes in the stock material. These prepunched nail holes increase the ease by which the finished product in the case of a roof ridge vent may be installed by the ultimate user. The shaft 88 is vertically adjustable so that the nail punch may be adjusted to accommodate stock material of varying thickness. A pair of flat bar members 130 may be positioned downstream of the lower roll 90 with their ends extending into the annular grooves 122. These bar members assist in removal of the punched material from the annular groove. Further, variously dimensioned spacers 132 are mounted on the shafts so that the spacing between the rolls may be varied to accommodate different stock widths.

HEAD ASSEMBLY

Figure 8:
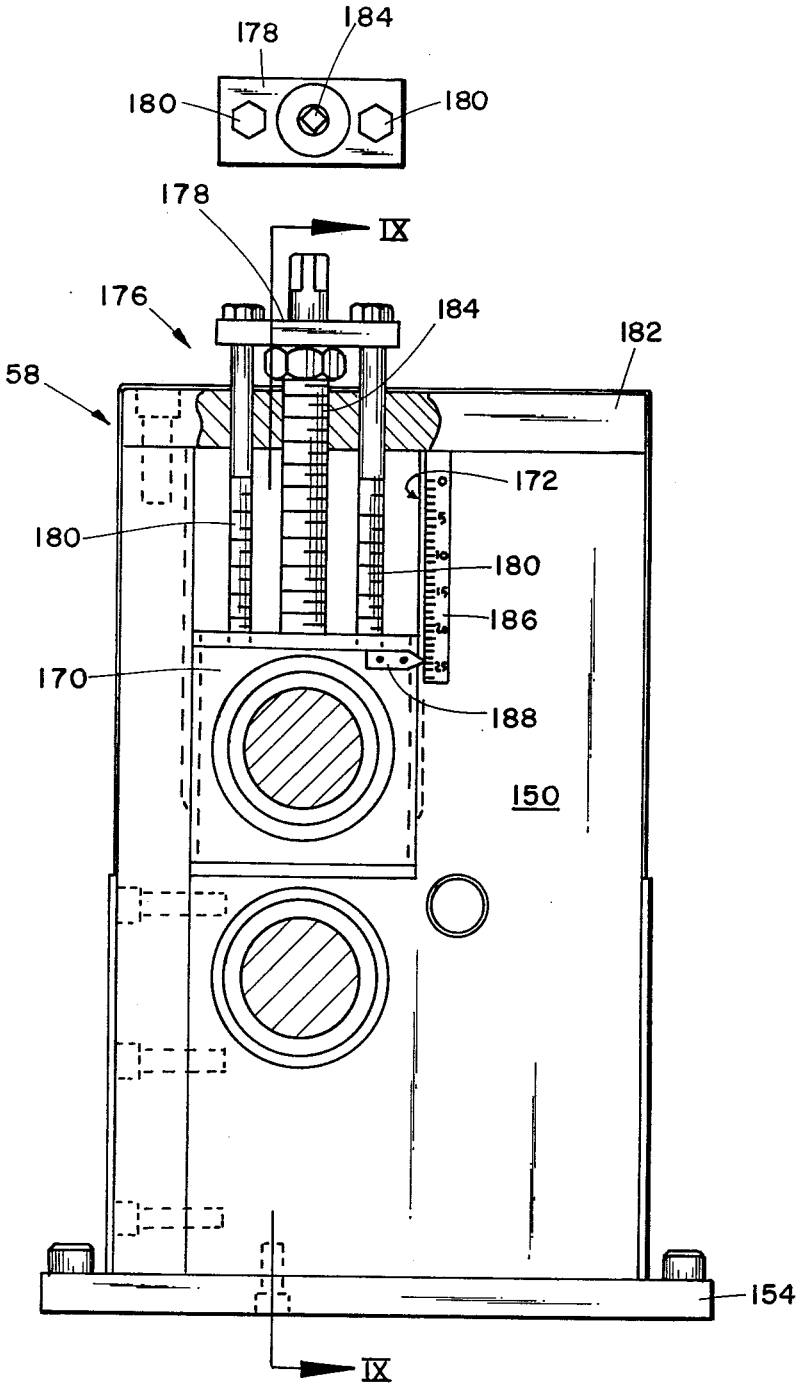
FIG. 8 is a front, elevational view of the adjustable shaft mount employed with each station of the roll forming apparatus.
Figure 10:
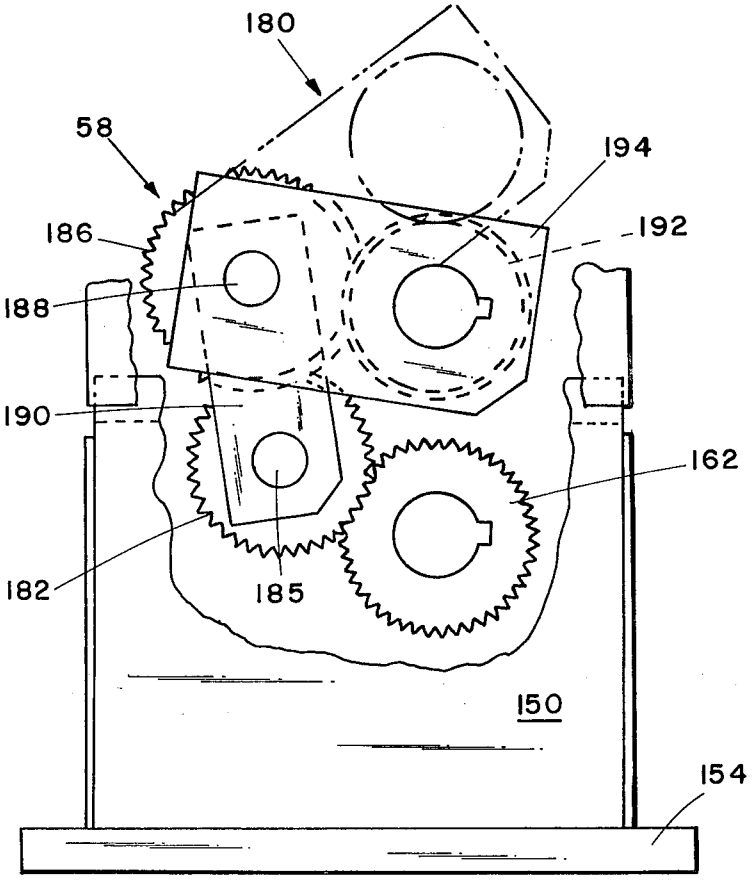
FIG. 10 is a fragmentary, front, elevational view of the shaft mount schematically illustrating a gear train by which rotary motion of the lower shaft is transmitted to the upper shaft.
Figure 9:
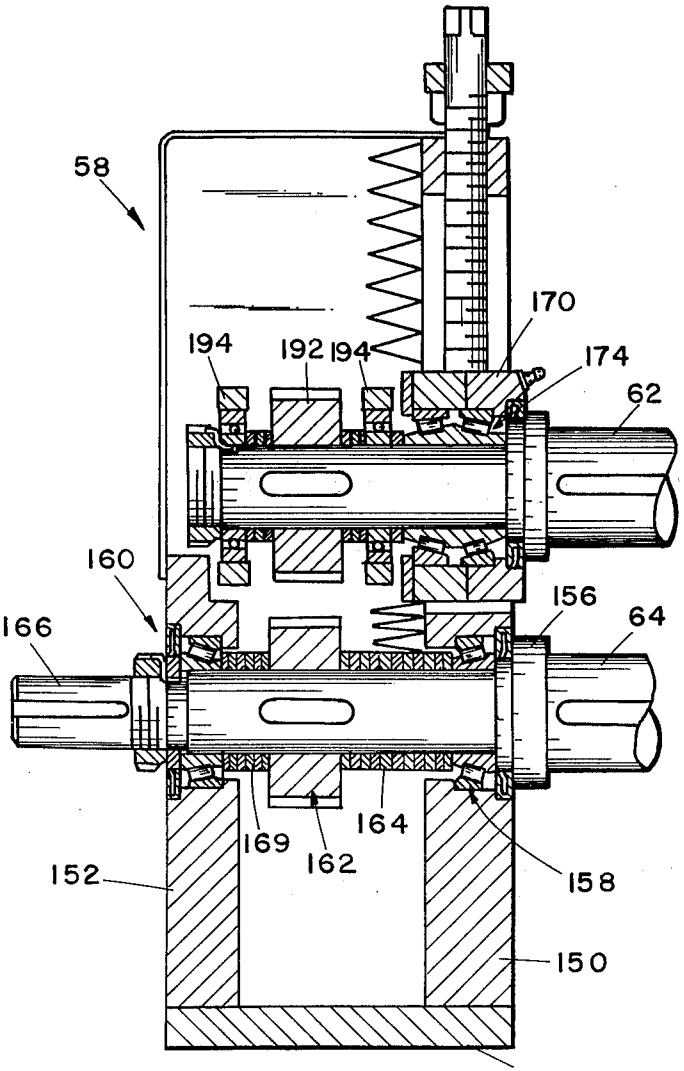
FIG. 9 is a cross-sectional view taken generally along line IX—IX of FIG. 8.

The adjustable, support head and drive assembly 58 is illustrated in detail in FIGS. 8, 9 and 10. As shown therein, the head assembly includes a housing defined by spaced, vertical plates 150, 152, secured to a base plate 154. The lower shaft 64 extends through apertures formed in the walls 150, 152. The shaft 64 which includes a collar 156 is supported in a wall 150 by a bearing assembly 158 and by a similar bearing assembly 160 in wall 152. A gear 162 is keyed to the shaft 64 and positioned within the head assembly by suitable spacers 164. The end of the shaft 166 is coupled to the cone drive assembly 66 and, therefore, indirectly driven by the main drive motor 72.

The end of the upper shaft 62 is rotatably received within a vertically adjustable, bearing block or journal 170. The block 170 is slidably received within a slot 172 formed in the wall 150. The block 170 defines a bearing housing within which is disposed a suitable roller bearing assembly 174 which rotatably supports the end of the shaft. The block 170 is vertically adjustable within guide slot 172 by means of a yolk and adjustment screw assembly 176. The yolk and adjustment stud assembly 176 includes a crossbar 178 and a pair of elongated bolts 180 which extend from the crossbar down through a bridge member 182 or top wall of the head assembly. The bolts 180 are secured to the top of the block 170. A threaded bolt 184 passes through the cross member 178 and is threaded within an aperture formed in the bridge member 182. As a result, rotation of stud 184 results in vertical movement of the block 170. A suitable scale indicator 186 positioned on the front wall 150 and a pointer 188 secured to the block 170 may be employed to insure accurate adjustment of the upper shaft relative to the lower shaft. This type of head assembly, therefore, permits ready adjustment of each roll station to accommodate stock material of varying thickness.

Rotary motion of the shaft 64 is transmitted to the shaft 62 through a gear train and a variable center link assembly 180. The gear 162 keyed to the lower shaft 64 meshes with a spur gear 182 rotatably mounted on a fixed shaft 184. Spur gear 182 in turn meshes with spur gear 186 rotatably mounted on a floating shaft 188. Shaft 188 is pivotally connected to the shaft 184 by an arm or link 190. Floating spur gear 186 meshes with a spur gear 192 which is keyed to the upper shaft 62. Shaft 188 is pivotally connected to the upper shaft 62 by a pair of floating links or arms 194. The gear train and variable center link insures that rotary motion is transmitted from gear 162 to gear 192 through intermediate spur gears 182, 186, within the vertical adjustment range provided by the head assembly.

MAIN DRIVE SUBASSEMBLY

Figure 11:
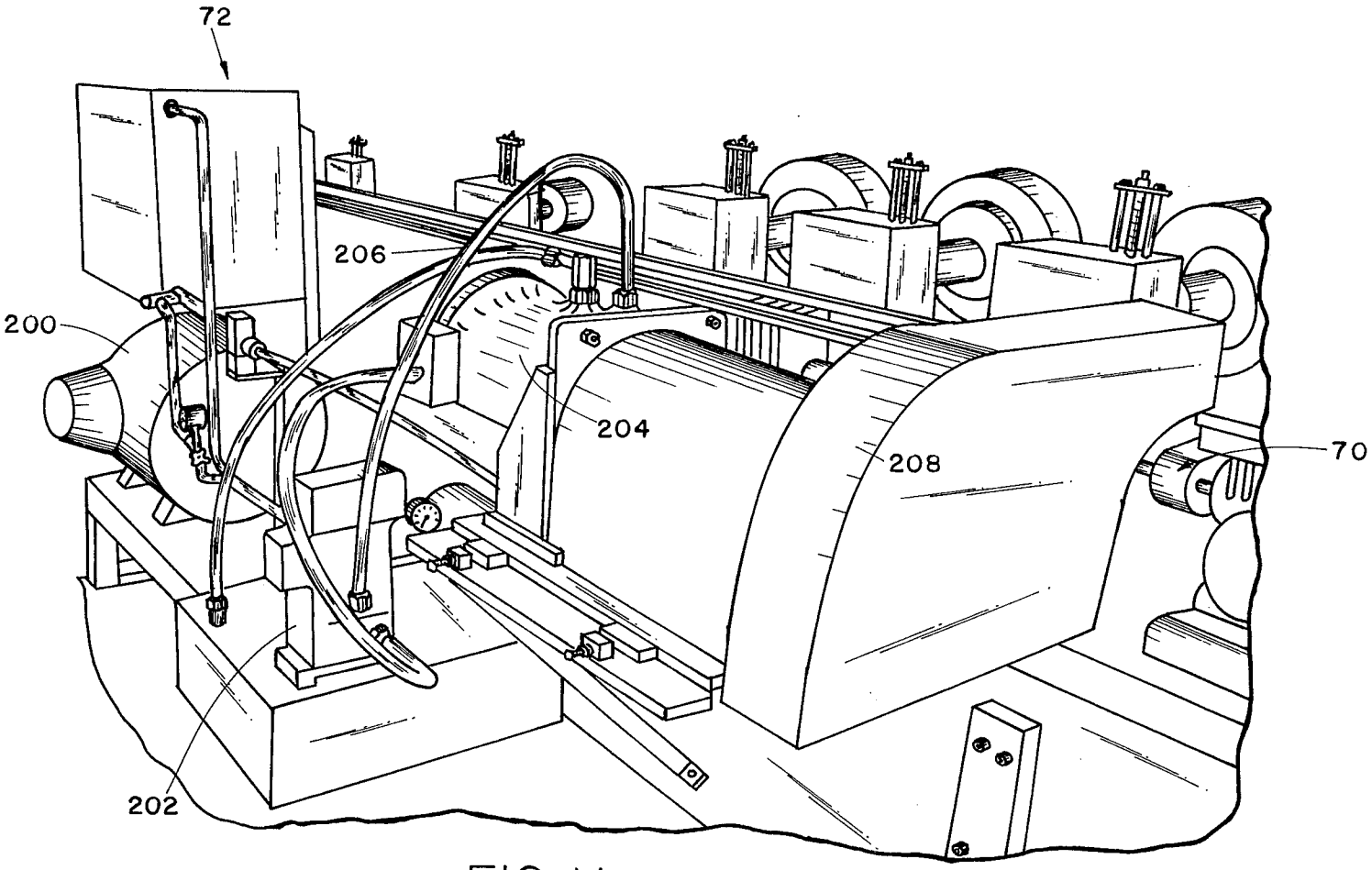
FIG. 11 is a fragmentary, perspective view of portions of the main drive of the roll forming apparatus.

As best seen in FIG. 11, the main drive subassembly 72 includes a constant speed electric motor 200 operatively coupled to a constant output pump 202. Hydraulic fluid is directed from the pump 202 to a hydraulic motor 204 via a line 206. The output of the hydraulic motor 204 may be varied by controlling the flow rate from the constant output 202. The output of the hydraulic motor 204 is coupled to one of the drive transmission shafts 70 through a suitable belt drive and pulley arrangement (not shown) covered by the housing 208. It should be understood that the specific form of main drive cam, of course, vary from that illustrated. Further, the main drive may be coupled to one of the transmission shafts 70 at any point along the apparatus. A suitable location has been found to be immediately downstream of the lancing subassembly 78.

STATIONS I–VIII

The overall apparatus in accordance with the present invention for purposes of this description has been divided into three portions. The first portion comprises a first group of individual roll forming stations numbered from I to VIII. The second major portion of the apparatus comprises the lancing subassembly which is positioned at station IX. The third major portion of the apparatus comprises stations numbered X–XX. As will be more fully set forth below, the coiled stock after passing through the rotary nail punch subassembly, enters the apparatus at station I and is progressively deformed in the first eight stations so that the general cross section of the hood portion of the roof ridge vent is shaped and the stock material is reversed bent upon itself to form the internal dam structure. The roll die sets sets at each individual station in the first group perform this progressive deformation.

STATION NO. I

Figure 12:
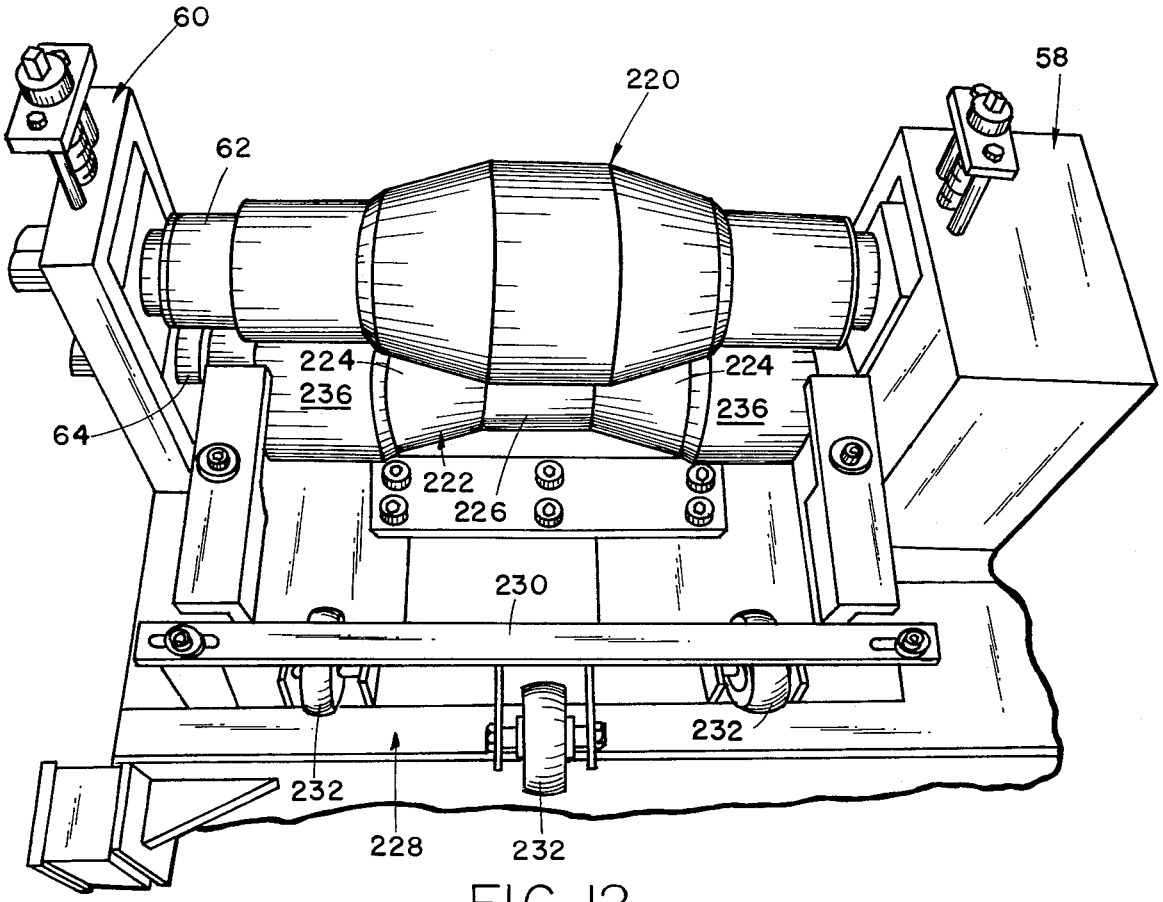
FIG. 12 is a fragmentary, perspective view of the station No. I.

As best seen in FIG. 12, the first roll forming station is positioned immediately adjacent the inlet end of the bed 52. The station includes an adjustable support head 58 and an adjustable support head 60. The upper shaft 62 supports a generally barrel-shaped roller 220. The lower shaft 64 supports a configured roller 222. The roller 222 includes three portions or areas. End portions 224 have a generally frusto-conical shape and center portion 226 has a generally cylindrical shape. A guide wheel support structure 228 including a crossbar 230 supporting guide wheels 232 is positioned immediately upstream of station I. This structure helps to guide and flatten the sheet stock as it enters the apparatus from a coil (not shown) after passing through the nail punch subassembly.

Figure 13:
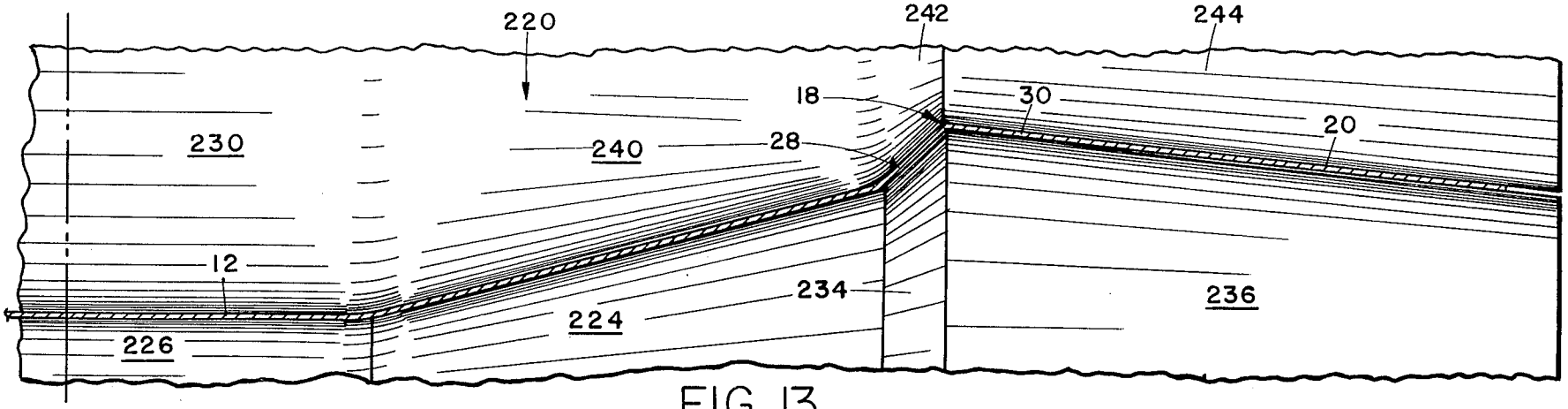
FIG. 13 is an enlarged, fragmentary, front, elevational view of station No. I.

As best seen in FIG. 13, the lower roll 222 includes adjacent the end of the conical portions 224 a generally beveled surface 234. The lower roll 222 terminates adjacent each end with downwardly angled conical portion 236.

The upper roll 220 includes the central barrel portion having an intermediate generally cylindrical portion 238, conical portions 240 shaped to conform to the peripheral surface of the conical portions 224 of the lower roll, beveled portions 242, similarly conforming to the beveled portions 234 of the lower roll, and further conical portions 244 which conform to the conical portions 236 of the lower roll. The aluminum stock material as shown in FIG. 13 is as it passes through the nip of the rolls deformed by the rolling dies. As shown, this station begins the initial shaping of the hood portion 12 of the roof ridge vent. Further, the beveled portions 234, 242, of the rollers coact to begin the initial shaping of the dam 18 by bending upwardly the inner lip portion 28 and bending downwardly the side wall portion 30 and flashing area 20.

STATION NO. II

Figure 14:
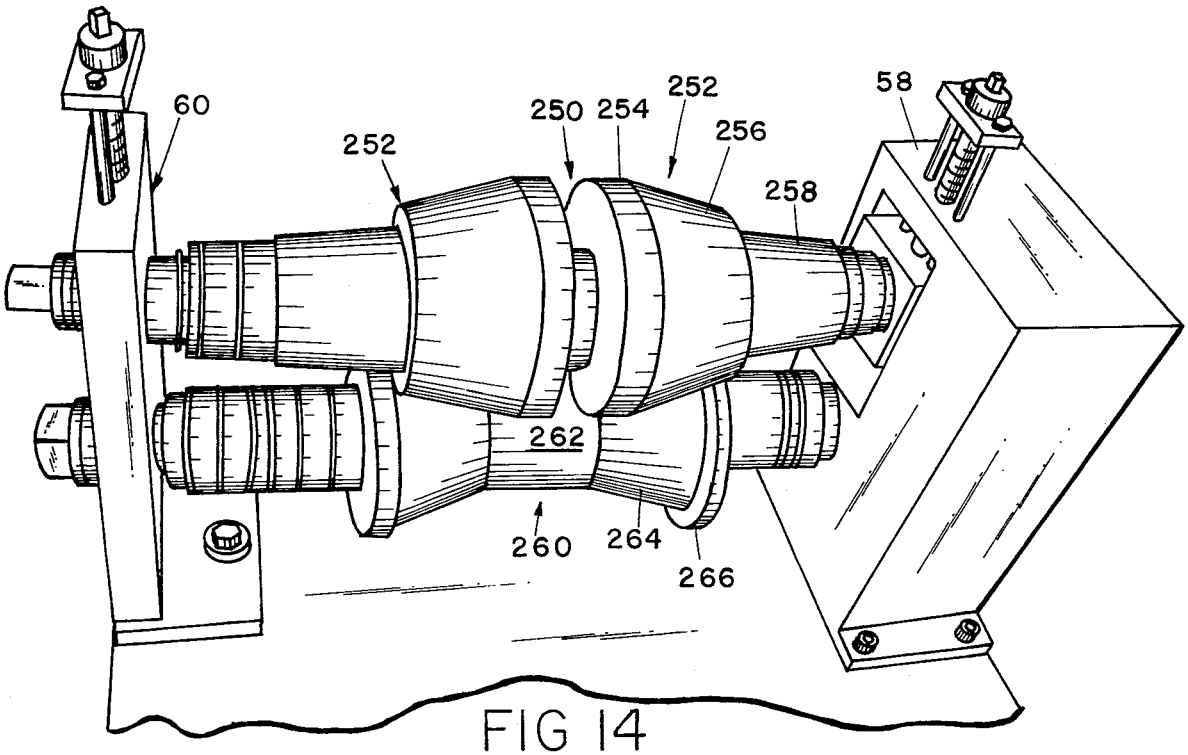
FIG. 14 is a perspective, fragmentary view of the station No. II.

As best seen in FIG. 14, station II includes an upper rolling die structure 250 having two spaced, mirror image portions 252. Each die rod 252 includes a generally cylindrical portion 254, a conical portion 256 and a conical portion 258. The lower roll 260 includes a central cylindrical portion 262, opposed, upwardly angled conical portions 264 and end rings 266.

Figure 15:
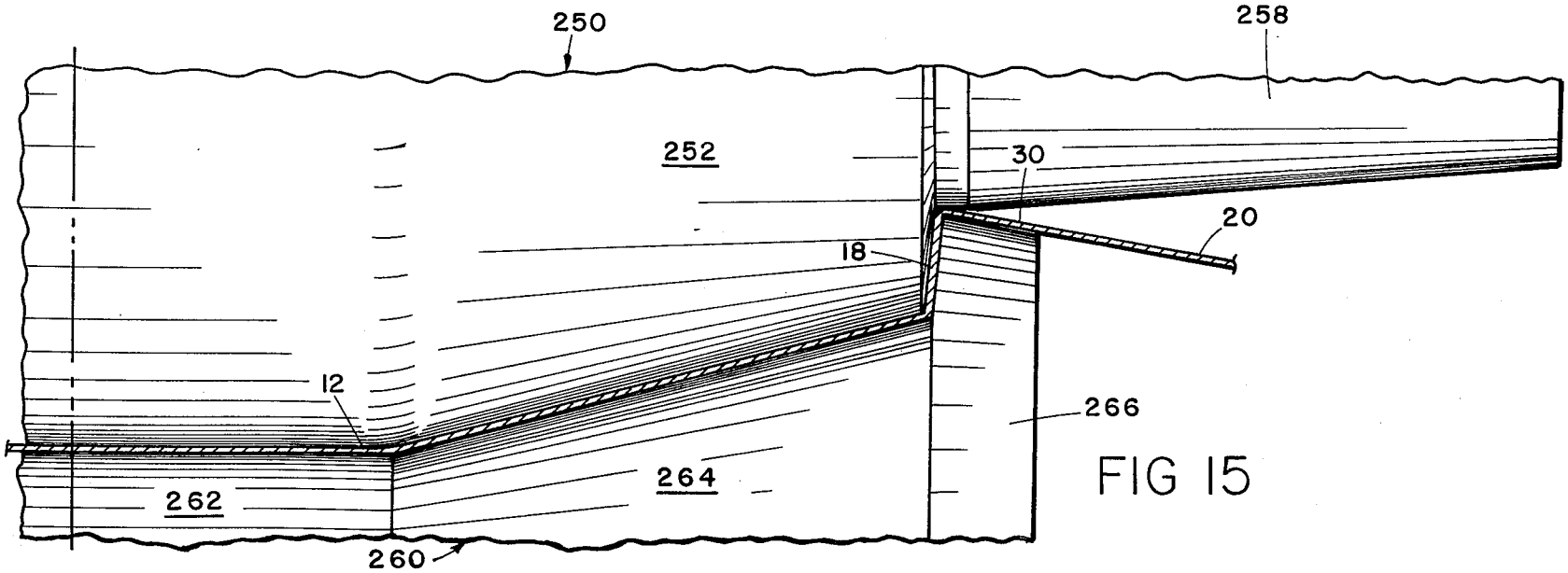
FIG. 15 is an enlarged, fragmentary, elevational view of station No. II.

As best seen in FIG. 15, the aluminum stock passing through the nip or bite of this roller die set is further deformed with the hood portion 12 bent further upwardly, the inner lip portion 18 being bent further towards vertical and the flashing or inner side wall portion 30 being angled downwardly by the action of upper roller portion 258 and beveled, lower roller portion 226.

STATION NO. III

Figure 16:
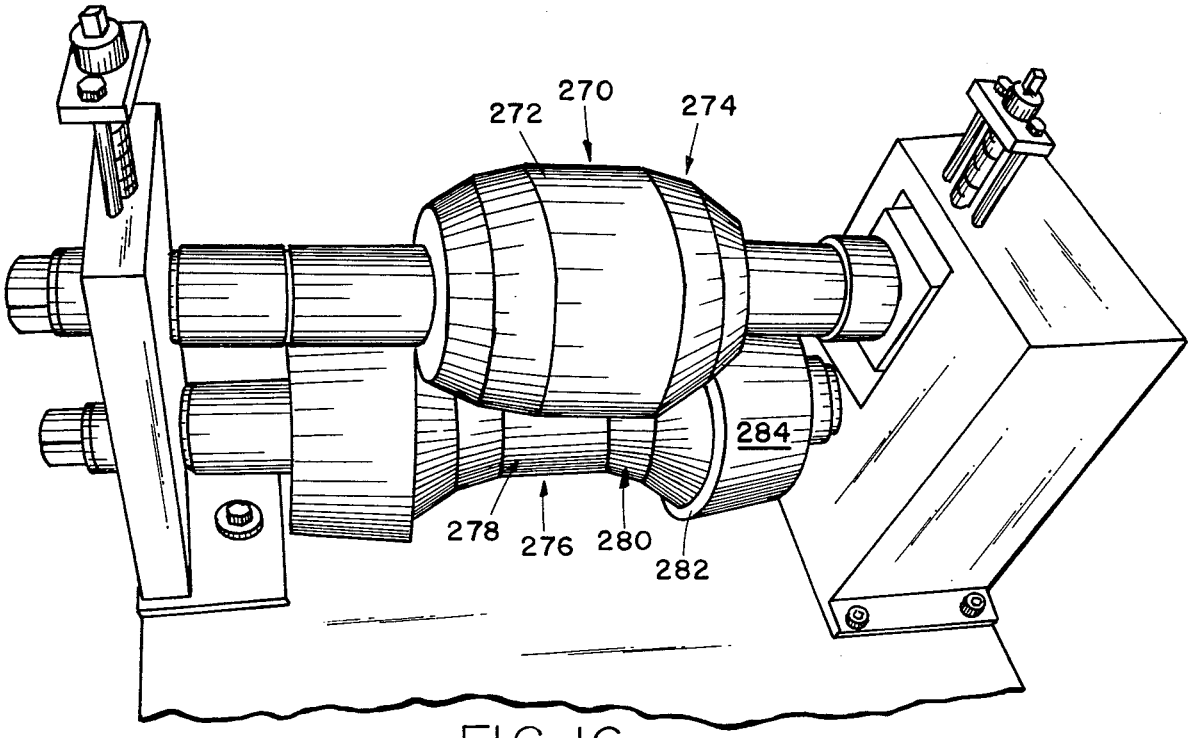
FIG. 16 is a fragmentary, perspective view of station No. III.
Figure 17:
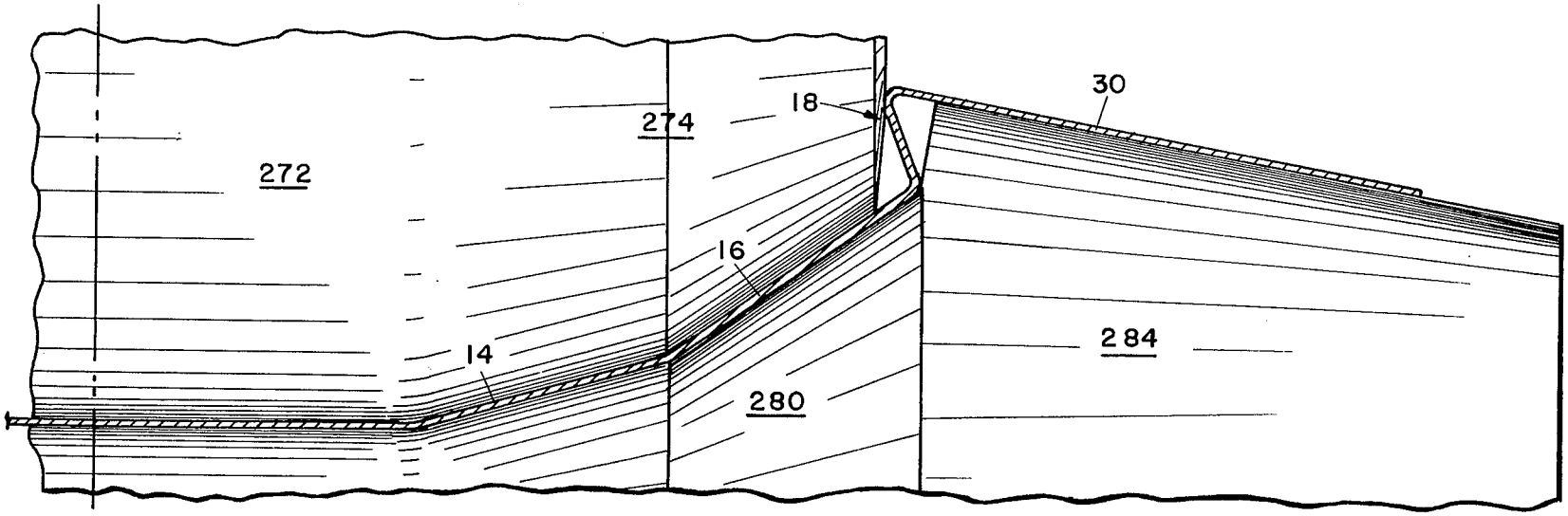
FIG. 17 is an enlarged, fragmentary, front, elevational view of station No. III.

As best seen in FIGS. 16 and 17, station III includes an upper generally barrel-shaped roll 270 having a central cylindrical portion 272 and double angled conical portion 274 at each end.

The lower roll 276 is concave in shape and includes a corresponding cylindrical portion 278 and stepped conical portions 280 superimposed with the upper roll 270. Further, the lower roll includes an outer beveled surface 282 and terminates at each end with a downwardly angled conical portion 284. A corresponding conical portion of the upper roller is not included. As best seen in FIG. 17, the double angled conical portions 280 and 274 further form the hood portion 12 of the product and begin formation of the outer side walls 14. The dividing line between the outer side walls 14 and the inner vent panel 16 is made and the dam portion 18 is angled upwardly. Therefore, it can be seen that by increasing the angle of convergence or divergence of the conical sections of the roller dies and by introducing double angled conical sections, the material is progressively bent into the desired cross-sectional shape and the cross section of the dam portion is further formed.

STATION NO. IV

Figure 18:
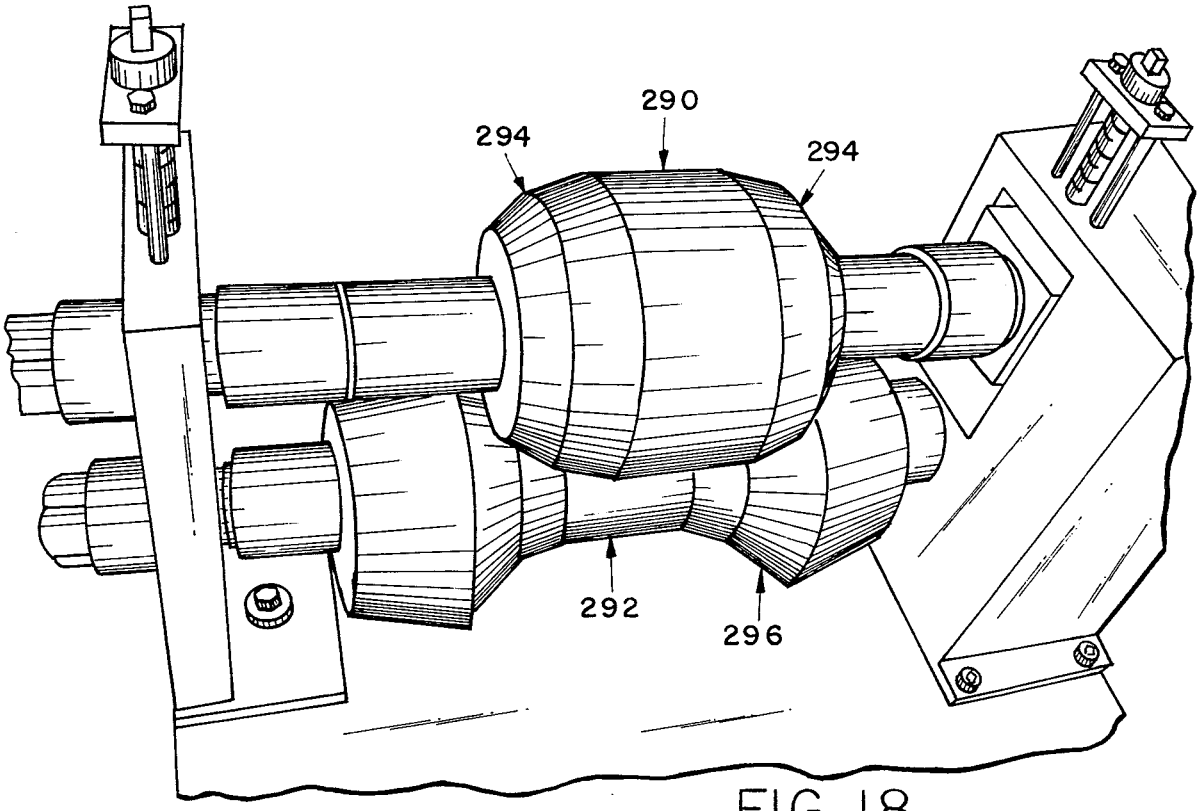
FIG. 18 is a fragmentary, perspective view of station No. IV.
Figure 19:
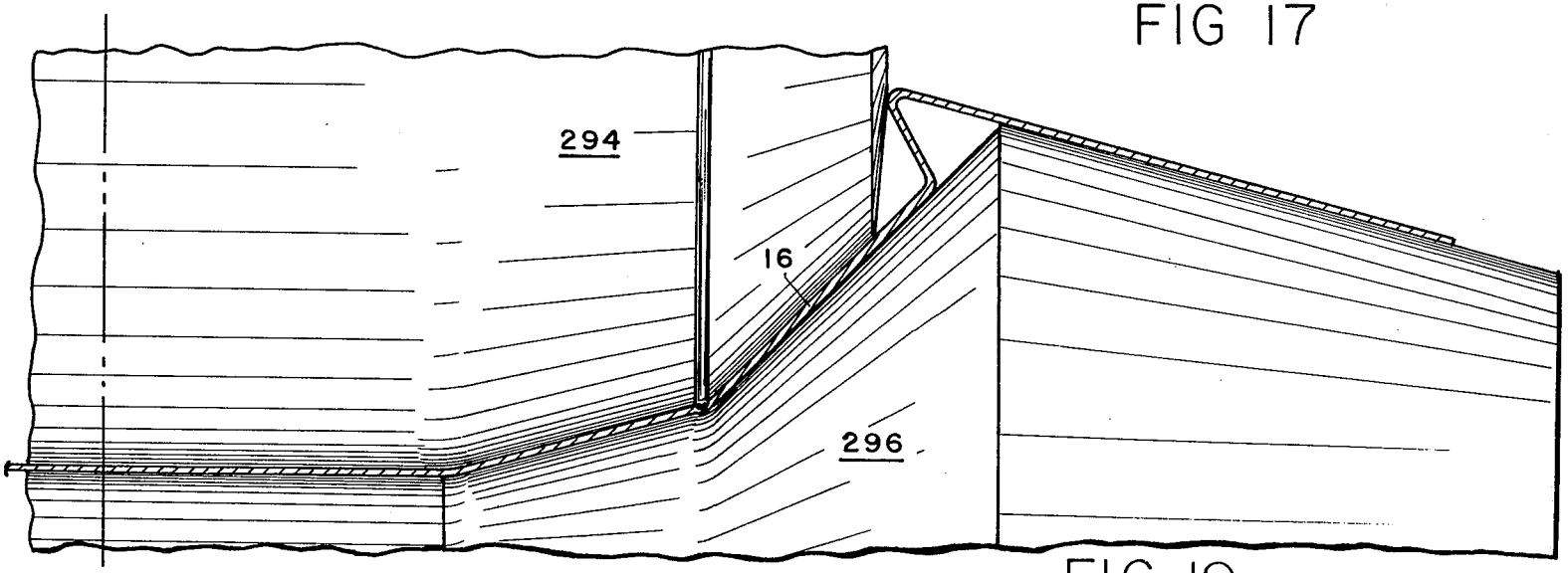
FIG. 19 is an enlarged, fragmentary, front, elevational view of station No. IV.

As best seen in FIGS. 18 and 19, station IV includes a barrel-shaped upper roll 290 and a generally convex shaped lower roll 292. The upper roll is of similar cross-sectional shape as the upper roll 270 of station IV, however, the angular relationship between the conical portions 294 of the upper roll and 296 of the lower roll is further increased. As seen in FIG. 19, this roller die set, therefore, further bends the stock material upwardly towards the vertical and rotates the ventilation portions 16 of the ultimate product through a greater angle than with the previous station.

STATION NO. IV

Figure 20:
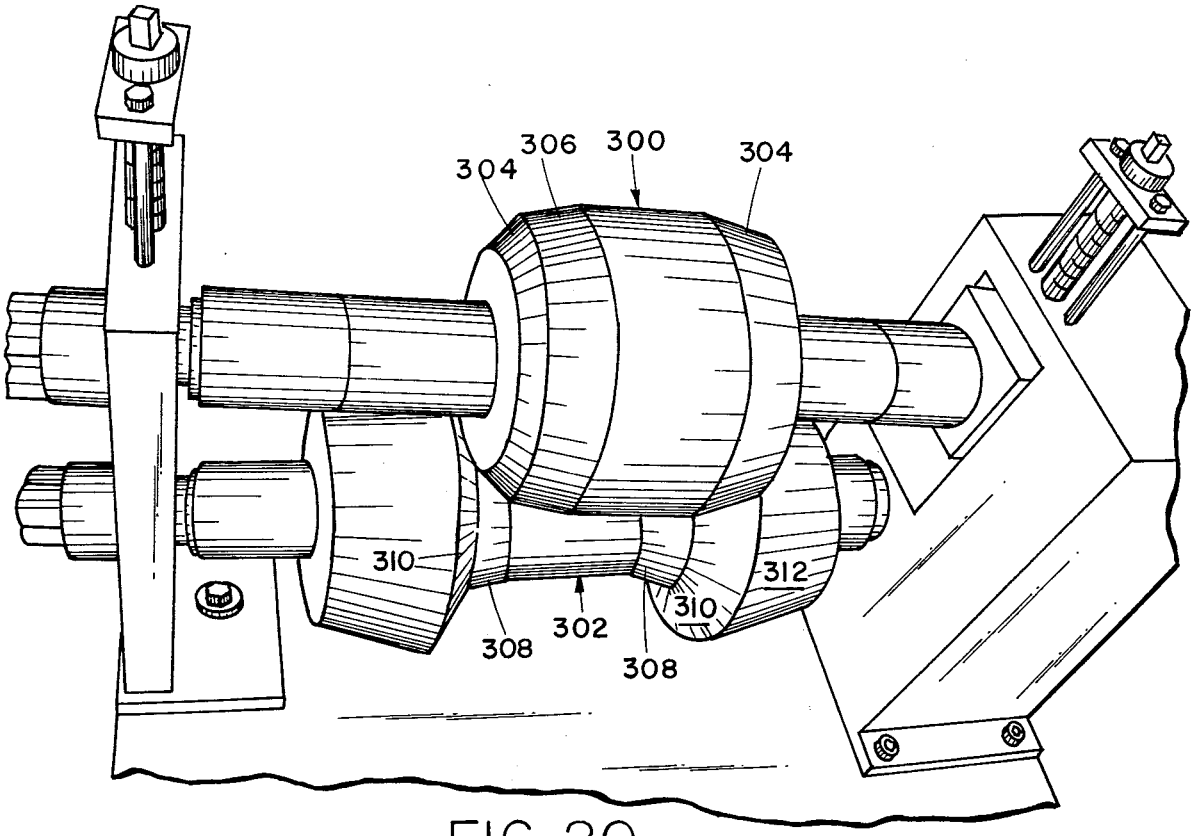
FIG. 20 is a fragmentary, perspective view of station No. V.
Figure 21:
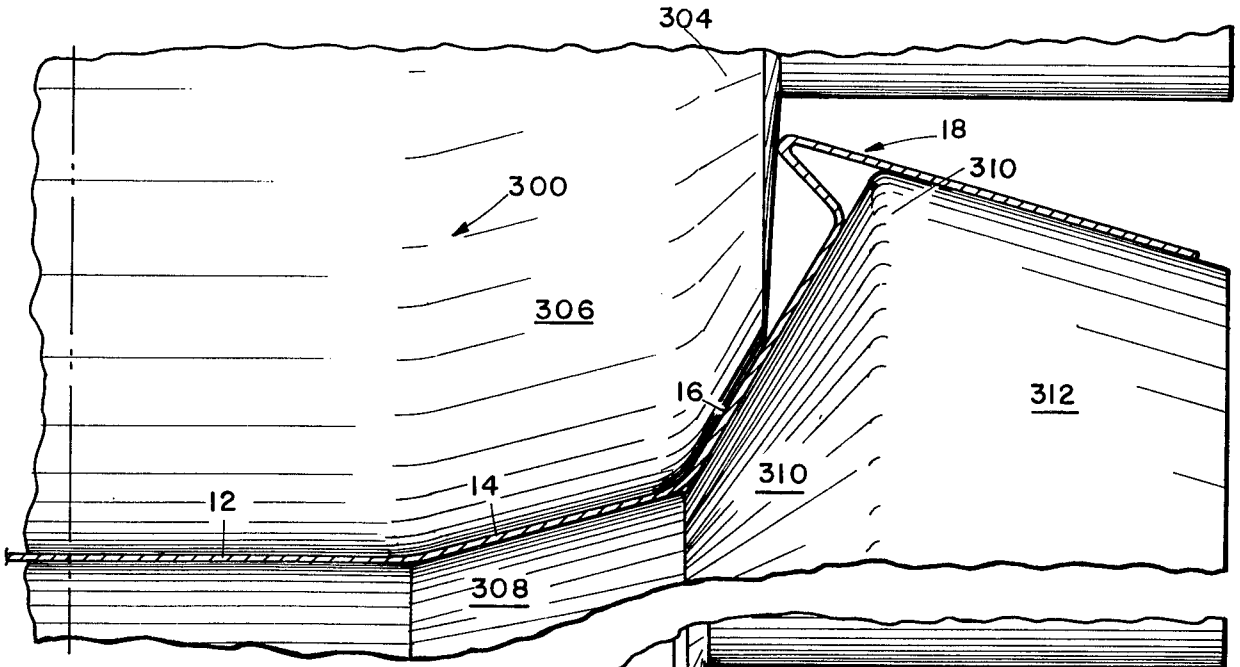
FIG. 21 is an enlarged, fragmentary, front, elevational view of station No. V.

As best seen in FIGS. 20 and 21, station V similarly includes a generally barrel-shaped upper roll 300 and a concave conically portioned lower roll 302. The angular relationship between the outer stepped cone portions 304 and the inner cone portions 306 is further pronounced. Similarly, the angular relationship between the conical portions 308 and 310 is increased. As seen in FIG. 21, this results in further vertical rotation of the ventilation panels 16 of the stock material. The outer ends of the lower roll 302 is in the shape of a converging outwardly directed cone and serves to support the inner side walls and flashing portions of the stock. It should be noted that the ends of the upper roll are spaced inwardly from the ends of the conical portion 310 an amount sufficient to accommodate the partially formed dam section 18 of the stock.

STATION NO. VI

Figure 22:
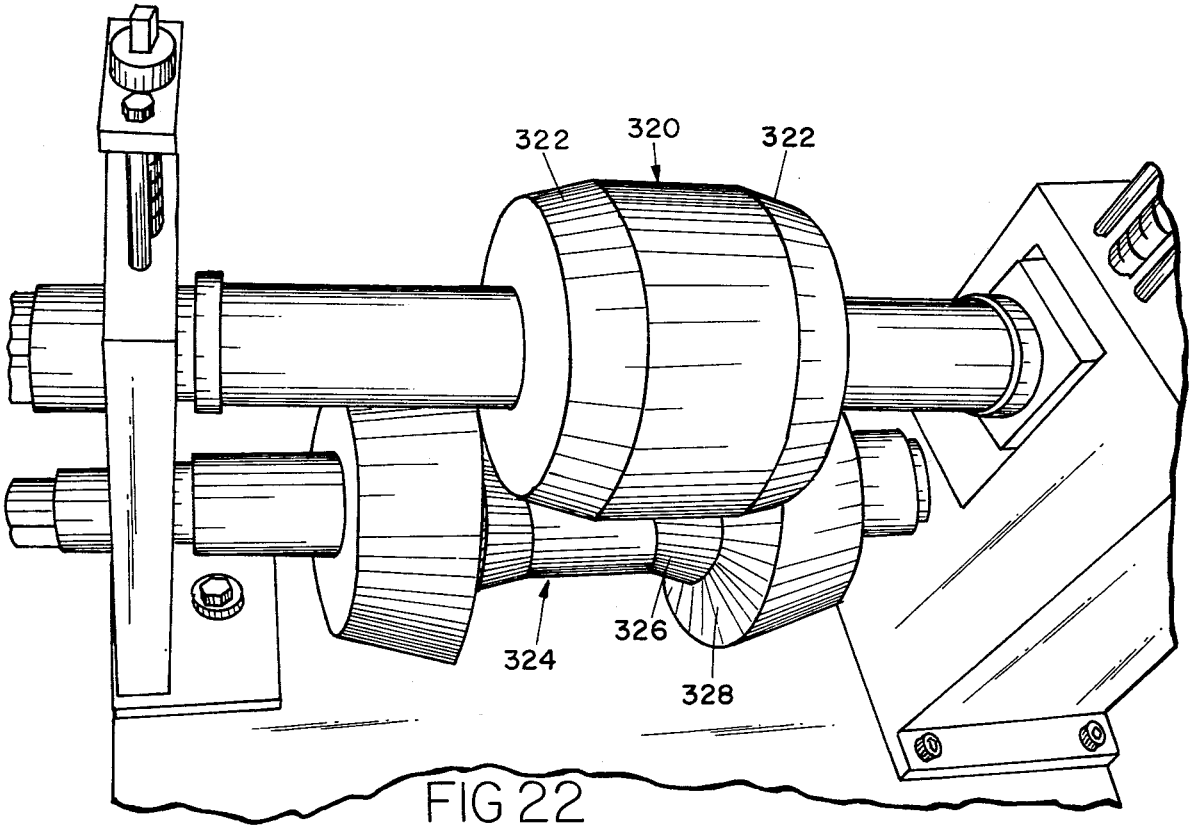
FIG. 22 is a fragmentary, perspective view of station No. VI.
Figure 23:
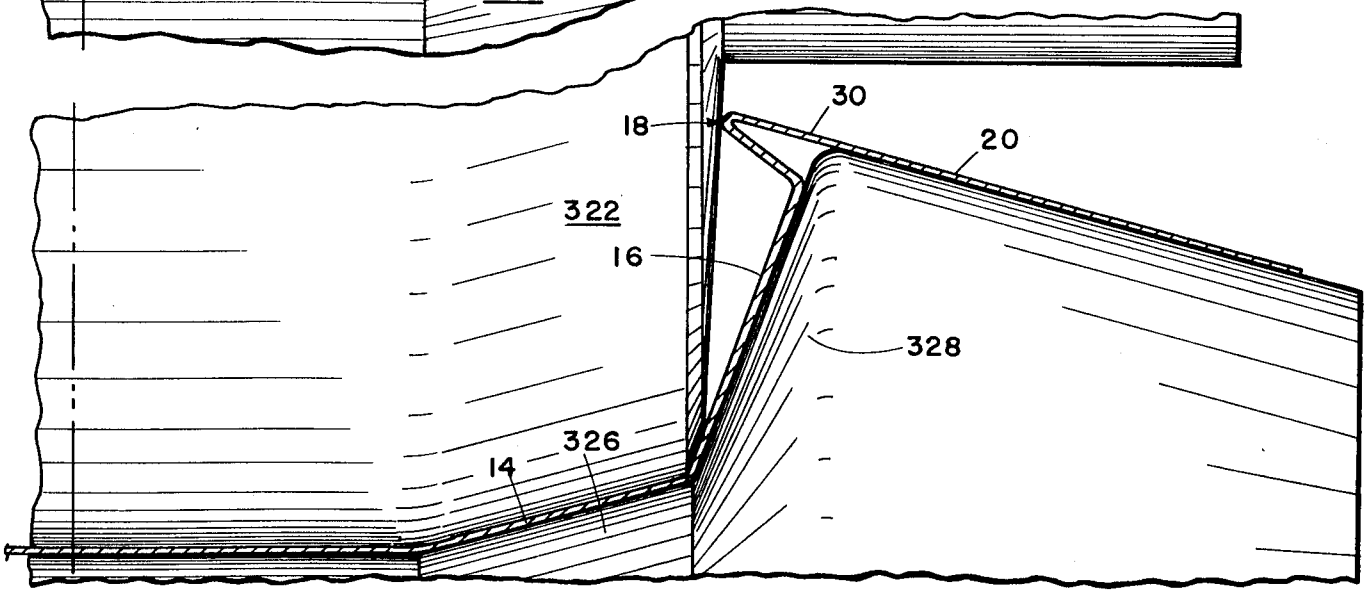
FIG. 23 is an enlarged, fragmentary, front, elevational view of station No. VI.

As best seen in FIGS. 22 and 23, station VI similarly includes an upper generally barrel-shaped roll 320. However, the barrel-shaped roll 320 is formed with a single taper on the conical ends 322 as opposed to the double angled conical ends 304, 306, at station V. The lower roll 324, however, includes the double conical sections 326, 328. As best seen in FIG. 23, the angular relationship between section 328 and section 326 is further increased from that of lower roll 302 of station V. As a result, the ventilation panel portion 16 of the sheet material is angled closer to the vertical after passing through station VI.

STATION NO. VII

Figure 24:
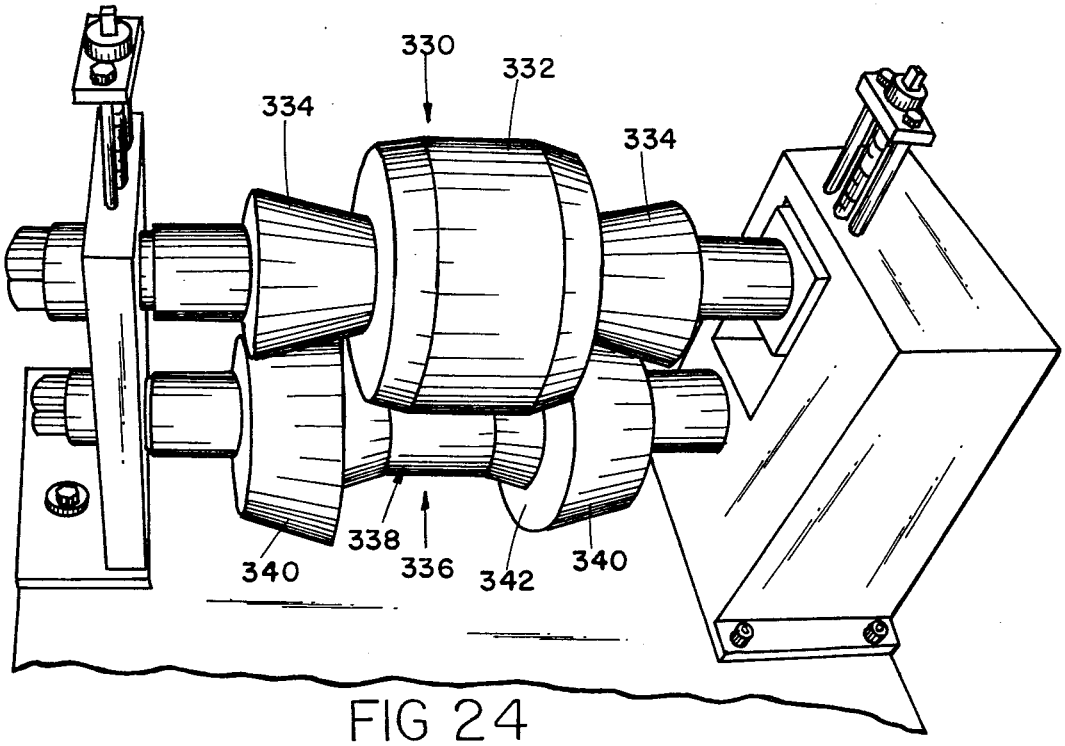
FIG. 24 is a fragmentary, perspective view of station No. VII.
Figure 25:
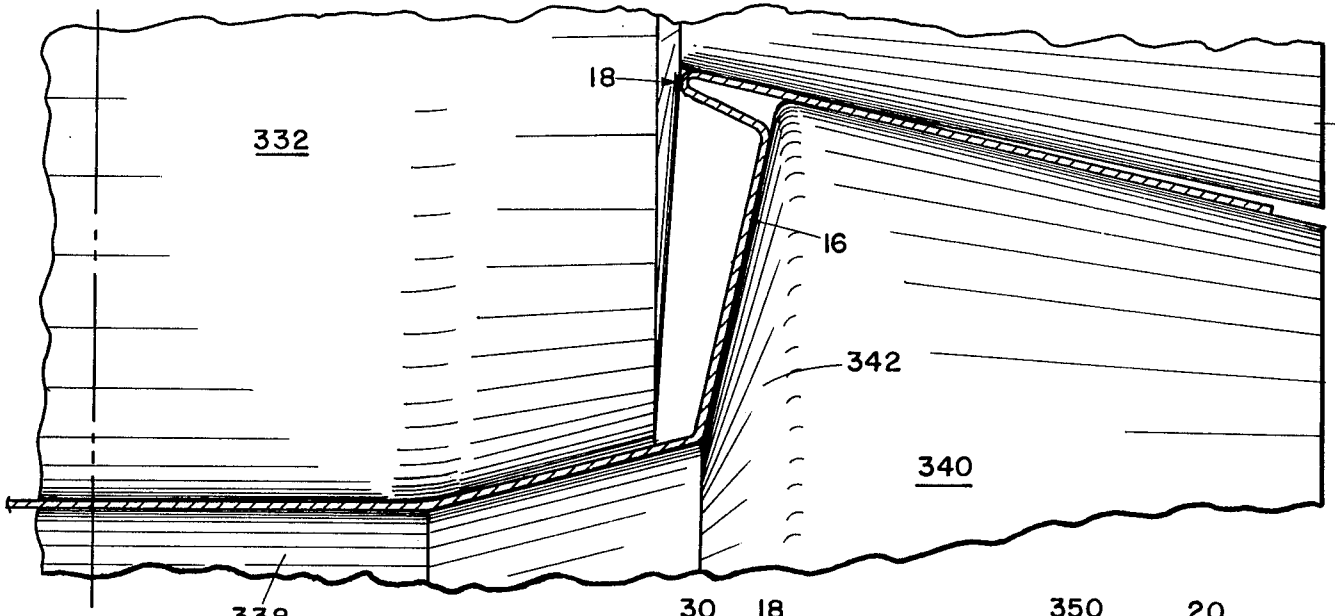
FIG. 25 is an enlarged, fragmentary, front, elevational view of station No. VII.

As best seen in FIGS. 24 and 25, station VII includes a three-part upper roller die 330. The upper roller die 330 includes a centrally disposed generally barrel-shaped roll 332 and a pair of opposed, frusto-conical shaped roll 334. Rolls 334 converge towards the center of roll 332. The lower roller die 336 is of concave shape and includes a central portion 338 and opposed conical portions 340. Conical portions 340 each converge toward the ends of the lower shaft. As best seen in FIG. 25, the central barrel-shaped roll 332 is dimensioned to fit within the concave central portion 338 of the lower roll. The ends of this barrel-shaped portion 332 terminate at points spaced from the beveled surfaces 342 of the convex portions 340 of the lower roll. The upper conical roll portion 334 cooperates with the lower concave roll portion 340 to further form the dam portion 18 of the product from the stock material. The ventilation panel portion 16 is bent through a greater angle than was present at station VI.

STATION NO. VIII

Figure 26:
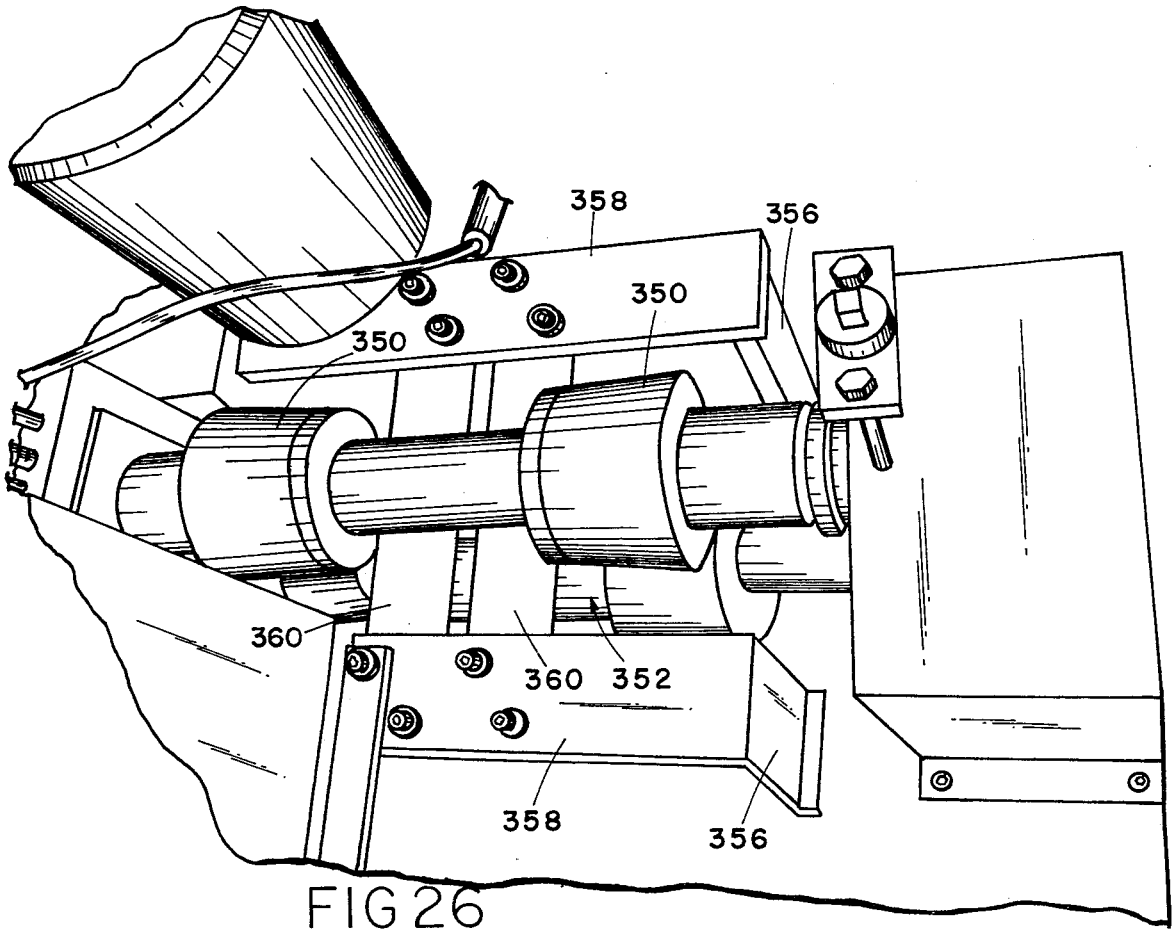
FIG. 26 is a fragmentary, perspective view of station No. VII.
Figure 30:
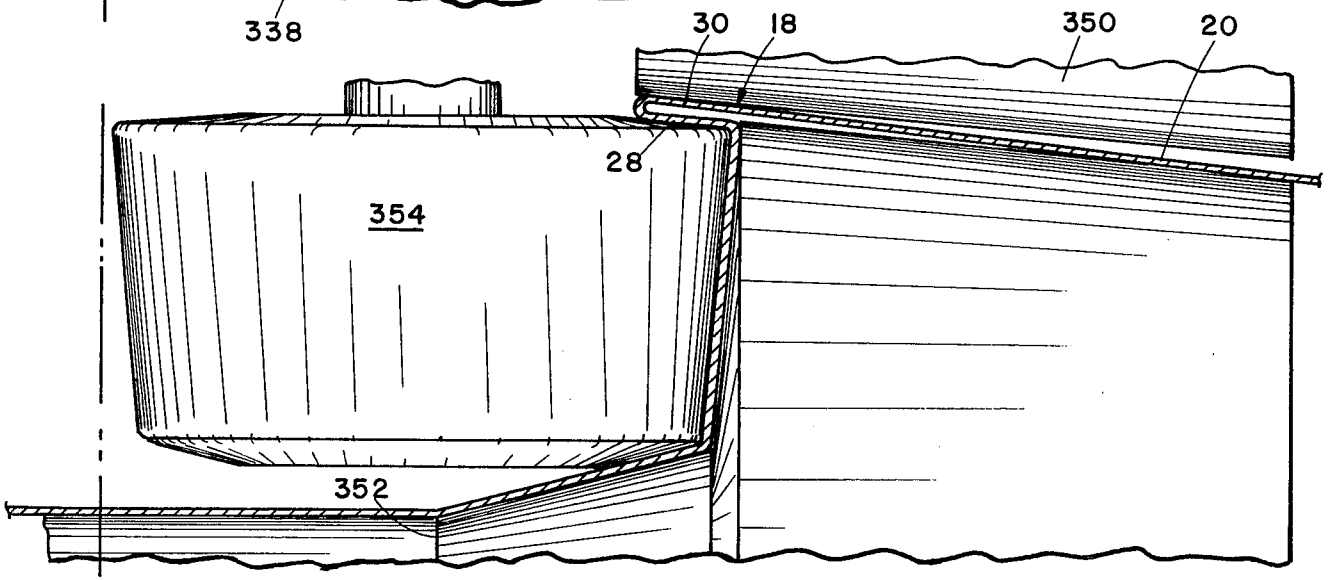
FIG. 30 is an enlarged, fragmentary, front, elevational view of station No. VIII.
Figure 27:
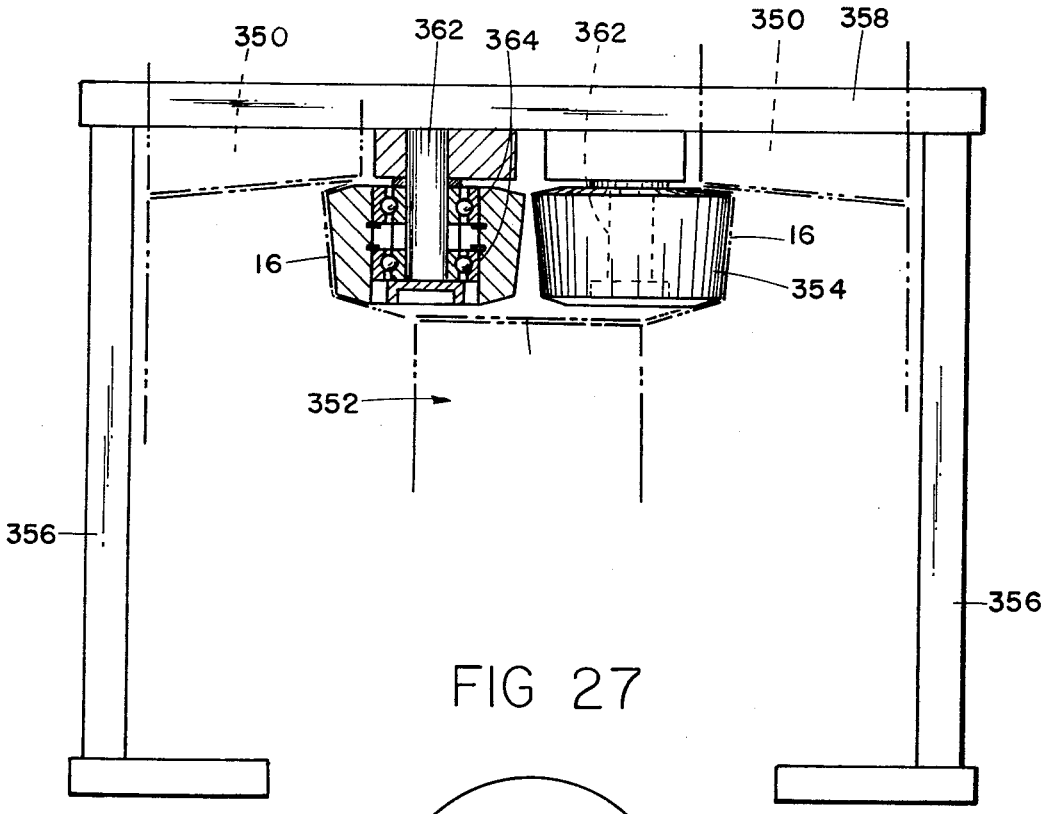
FIG. 27 is an enlarged, front, elevational view of the cluster roll stand assembly employed with station No. VIII.
Figure 28:
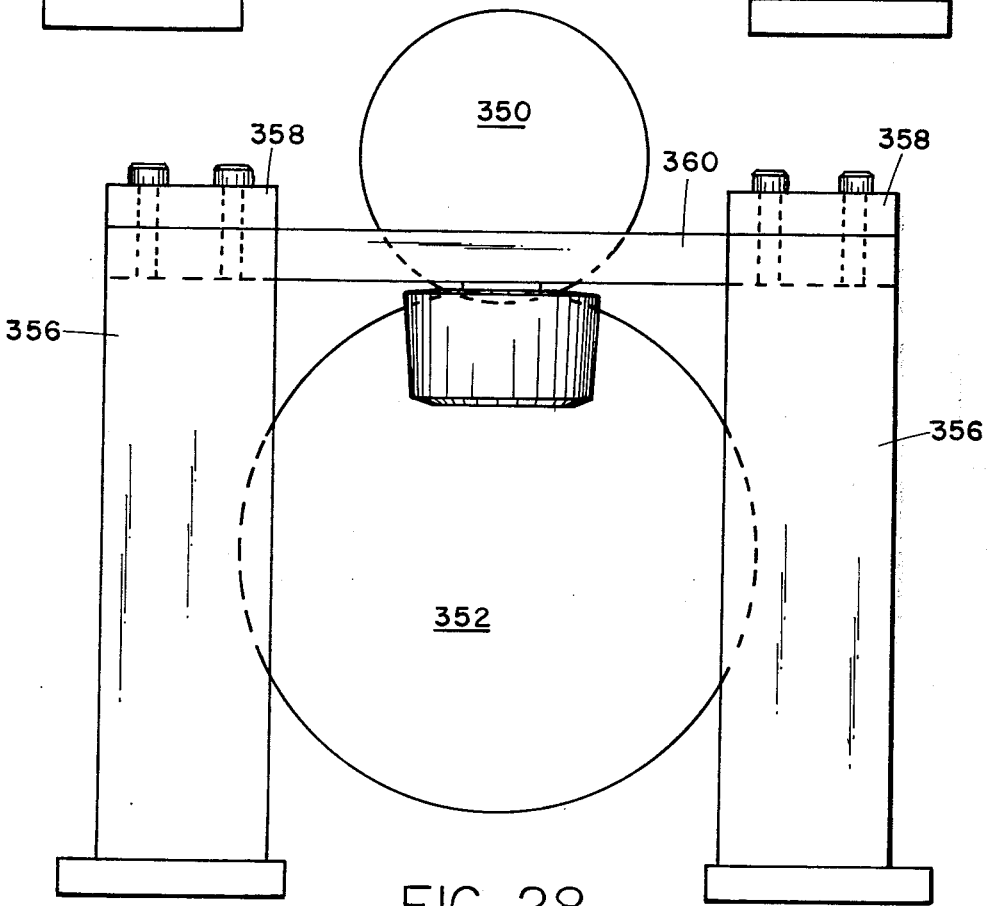
FIG. 28 is an enlarged, side, elevational view of the station No. VIII cluster roll stand assembly.
Figure 29:
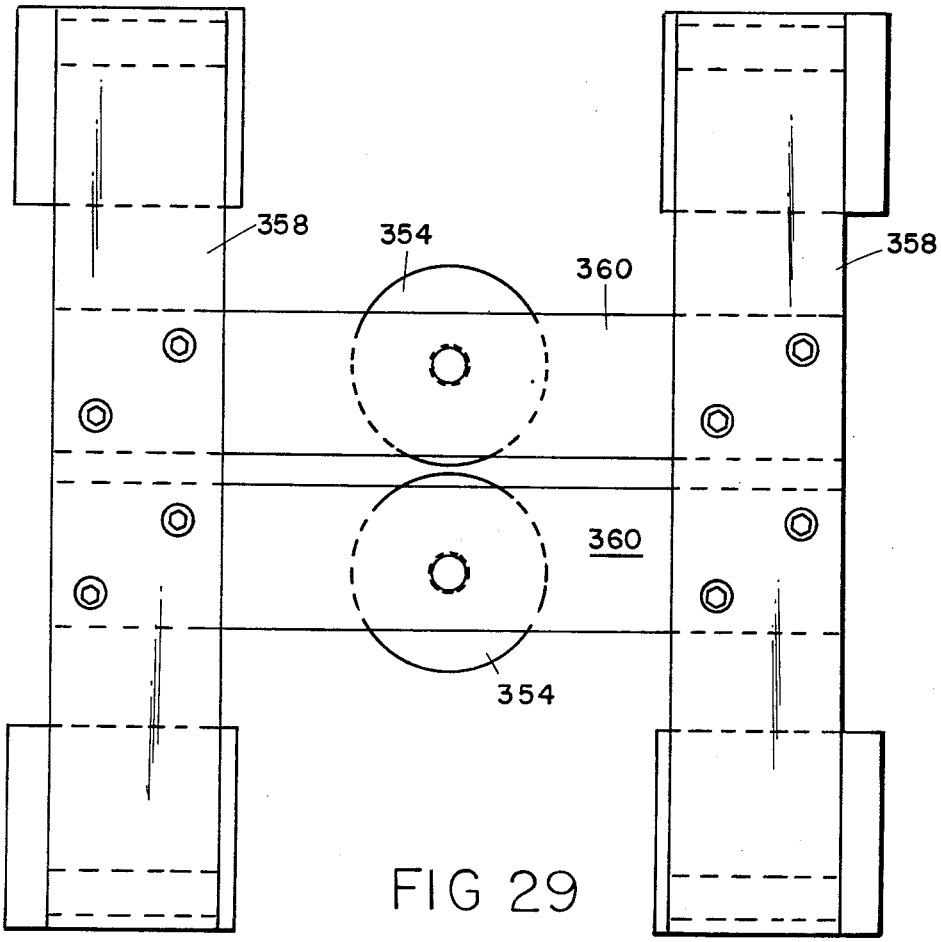
FIG. 29 is an enlarged, plan view of the cluster roll assembly employed with station No. VIII.
Figure 31:
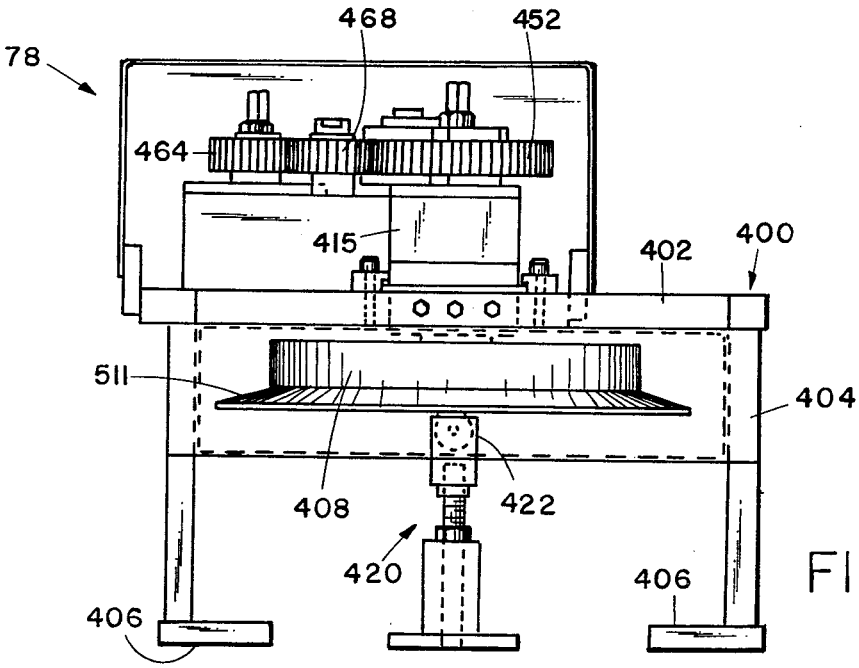
FIG. 31 is an enlarged, side, elevational view of the unique lancing subassembly positioned at station No. IX.

At station VIII just upstream from the lancing subassembly, the internal dam portion of the product is finally formed with the stock material reversed bent upon itself to define the inner lip 28 and the inner side wall 30 of the vent. This bending operation is accomplished through the use of an upper roll set including transversely spaced, conical upper rolls 350, a lower, concave complex shaped conical roll 352 and a pair of generally cylindrical, slightly tapered, cluster rolls 354. As best seen in FIG. 26, the cluster rolls are supported from a stand assembly including vertical legs 356, transverse cross members 358 and longitudinal cross members 360. As seen in FIGS. 27, 28 and 29, the cluster rolls 354 are supported for rotation about a vertical axis on the longitudinal cross members 360. The cluster rolls 354 are mounted in a side-by-side relationship for rotation on shafts 362 by bearing assemblies 364. The rolls are positioned so that they will rotate within the confines of the deformed stock material. The upper rolls 350 and the lower roll 352 are outlined in FIGS. 27 and 28 which are enlarged views of the cluster and stand assembly. As shown therein and in FIG. 30, coaction of the upper rolls 350, the lower roll 352 and each cluster roll 354, bends the stock so that the material is reversed bent upon itself to define the dam portion 18 of the ultimate product. Further, the ventilation panel portion 16 of the product is bent to a near vertical orientation by the coacting cluster roll 354 and the conical portion of the lower roll 352.

As a result of the differently configured rollers employed at each individual stations numbered I–VIII, the initially flat stock material is progressively bent through an increasing angle adjacent its lateral portions until the crease lines of the hood portion and outer side walls are defined, the internal dam structure is formed and the ultimate ventilation panel is positioned in a generally vertical orientation relative to the bed of the apparatus. Once this initial deformation or bending of the stock material is accomplished, the panel portions 16 are now in position for passage through the lancing subassembly wherein the offset strapped, hooded ventilation openings are formed. The stock is now generally U-shaped in cross section. It should be understood that a greater number and possibly a lesser number of stations could be employed for this initial bending of the stock material. It has been found, however, that by progressively bending the material by passage through eight separate stations, the bending of the stock material is accomplished without excessive cold working, buckling, or adverse deformation of the material.

LANCING SUBASSEMBLY

Figure 32:
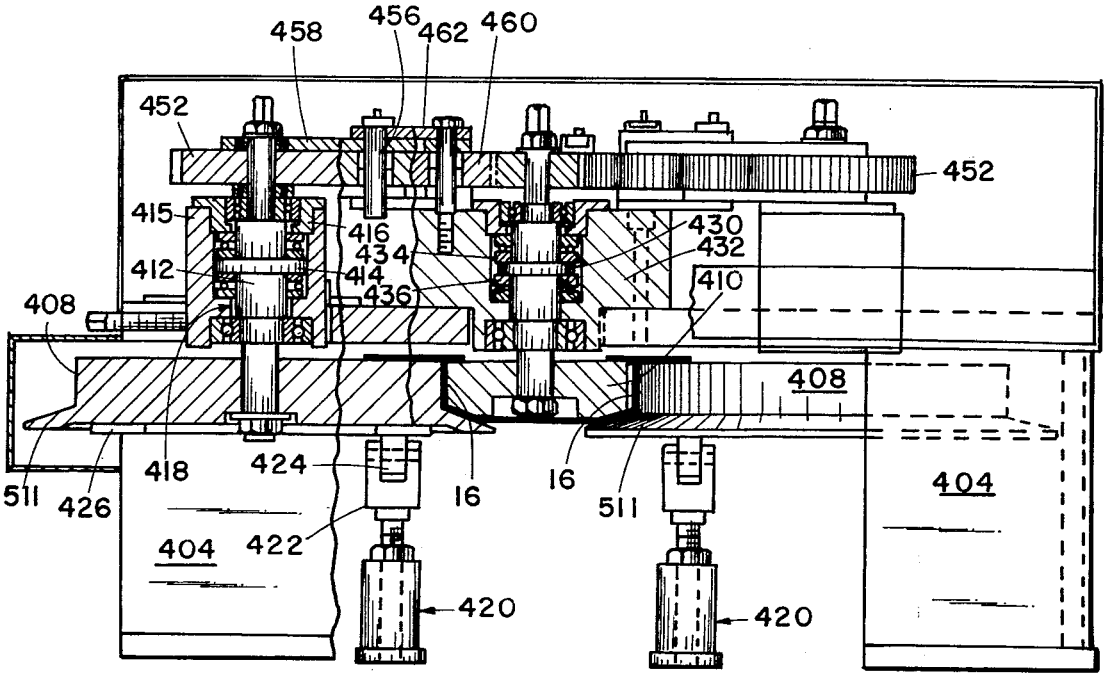
FIG. 32 is an enlarged, partially sectioned, front, elevational view of the lancing subassembly.
Figure 33:
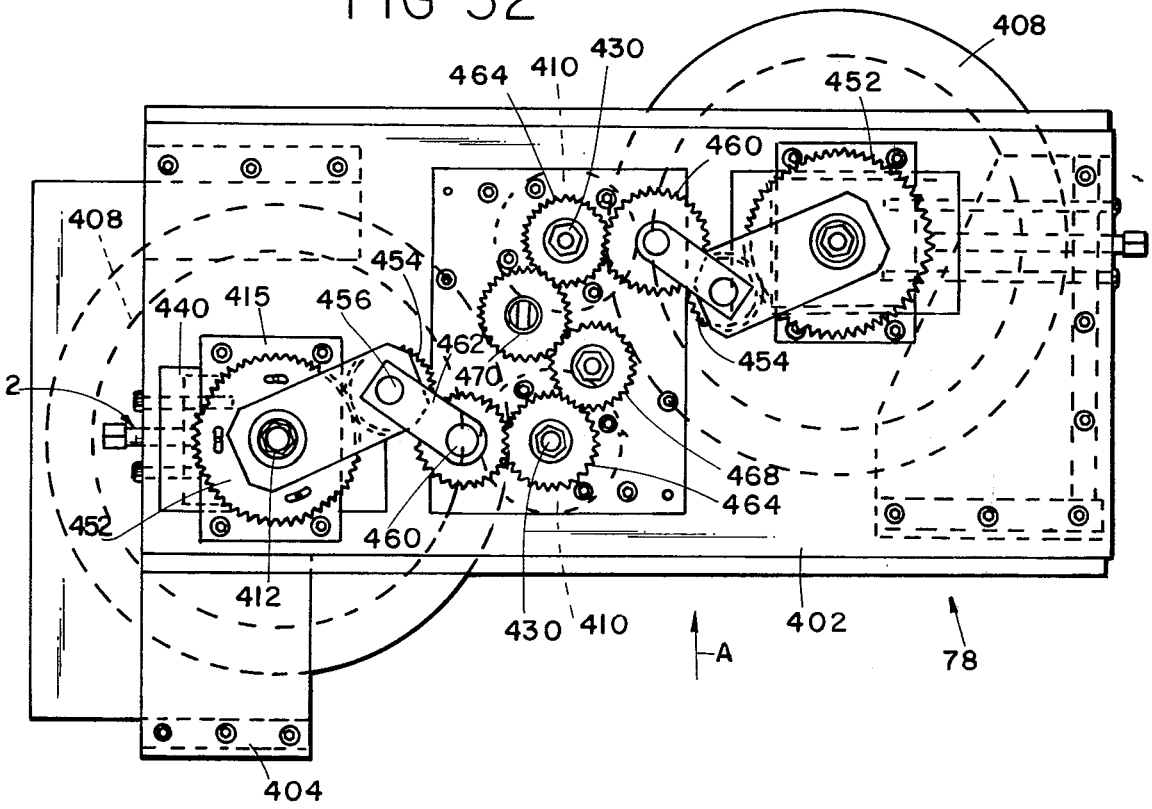
FIG. 33 is an enlarged, plan view of the lancing subassembly.
Figure 34:
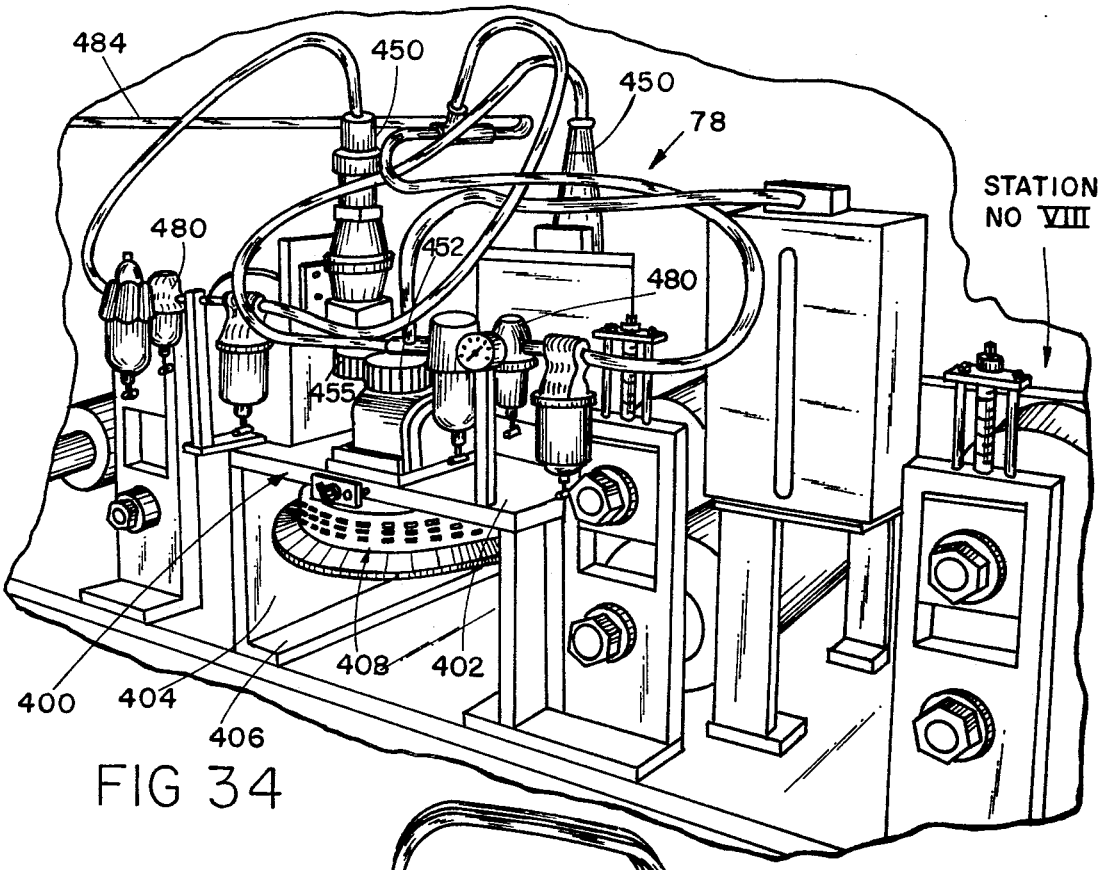
FIG. 34 is a fragmentary, perspective view of the roll forming apparatus showing the positioning of the lancing subassembly.

The lancing subassembly 78 is illustrated in detail in FIGS. 31–38. With reference to FIG. 34, the lancing subassembly 78 is mounted on the apparatus bed immediately downstream of station VIII. The lancing unit includes a support table 400 having a top 402 and legs 404. The legs 404 are rigidly secured to the apparatus bed through the use of bolts extending through mounting pads 406. The lancing subassembly includes two pairs of longitudinally offset lancing rolls. Each pair of lancing rolls includes an outer roll 408 and an inner roll 410. The righthand roll set when viewed in FIG. 33 in the direction of stock travel is positioned downstream from the lefthand roll set. The inner rolls 410 are positioned slightly offset from each other along the longitudinal center line of the table top 402. Each outer lancing roll 408 is suspended underneath the table top 402 by a shaft 412. The shaft 412 is collared at 414 and is suspended within a bearing block assembly 415 including bearings 416, 418. An adjustable roller support stand 420 bolted to the apparatus bed beneath the outer roll 408 assists in supporting the roll. The adjustable stand 420 includes a vertically adjustable yolk 422 which rotatably supports a roller 424. The roller rides on a ring 426 secured to the bottom of each outer lancing roll 408.

Each inner lancing roll 410 is secured to a collared shaft 430 which in turn is supported by a bearing block assembly 432. Thebearing block assembly includes vertically spaced bearing assemblies 434, 436.

As best seen in FIGS. 32 and 33, the bearing block assembly which supports the outer lancing rolls 408 is slidably mounted within a slot or aperture 440 formed in the table top 402. An adjustment screw or stud 442 is provided to shift the position of the outer roll 408 relative to the inner roll 410 within the adjustment distance provided by the slot 440. In this manner, the relative positioning and hence the nip or bite between the inner and outer lancing rolls may be adjusted to accommodate stock material of varying thickness and to vary the depth of lance. As seen in FIG. 32, the inner and outer lancing rolls define a vertical nip or space through which the now vertical ventilator panel portions 16 of the product may pass. As will be more fully described below, each pair of the lancing rolls is provided with teeth-like structures on one roll and a matching tooth receiving channel on the other around their outer peripheries which lance and offset the stock material to form the hooded ventilation openings.

The inner and outer lancing rolls are powered by a pair of air motors 450 interconnected through a gear train. One motor is connected to the lancing roll pair on the right side and the other lancing roll pair on the left side. Each shaft 412 supporting an outer lancing roll has keyed thereto adjacent its upper end, a gear 452. The gear 452, as seen in FIG. 34, is engaged by a drive gear 455 of the air motor 450. Gear 452 meshes with a spur gear 454 which in a sense is a floating gear. The gear 454 is mounted on a floating shaft 456 which is supported by a link or arm 458. The opposite end of the link 458 is pivotally supported at the end of shaft 412. Spur gear 454 in turn meshes with another spur gear 460. Similarly, spur gear 460 is carried by a floating arm or link including arm 462 pivotally secured at one end to shaft 456. Spur gear 460 meshes with a driven gear 464 nonrotatably secured to the inner lancing roll shaft 430. The gear train and link assembly acts in effect as a variable center transmission unit which permits transverse adjustment of the outer lancing roll relative to the longitudinal center line of the apparatus bed, while still permitting the air motor 450 to drive both the inner and outer lancing rolls. Spur gears 468, 470, interconnect the longitudinally spaced inner lancing roll driven gears 464. As a result of this gear train arrangement, each set of outer and inner lancing rolls are interconnected so that they will be synchronized and operate at the same or substantially the same rotational speed.

It has been found that the lancing roll pairs must be driven at a speed substantially equal to the linear velocity of the stock material as it travels through the apparatus. This synchronizing of the angular speed of rotation of the lancing rolls with the linear velocity of the stock material as it passes through the apparatus is necessary to avoid buckling or unwanted deformation of the stock material which will generaly be a fairly thin aluminum stock, such as .028 inch gauge. It has been found also that the longitudinal offset of the lancing roll sets introduces a torque or torsional action on the stock material as it traverses the lancing subassembly. Unless counteracted, this torque could result in twisting of the stock during the lancing operation. To counteract this unwanted torque, the air motor 450 of the downstream lancing roller set is operated at a higher pressure than the upstream lancing roller set. Since air motors are employed and the gear train interconnects the pairs of rollers, driving the downstream air motor at an increased pressure merely serves to increase the torque exerted on the material by the downstream inner and outer lancing rolls. This increased torque counteracts the natural torque resulting from offset of the lancing roll pairs.

The lancing subassembly angular velocity is synchronized with the stock linear velocity merely by increasing the air pressure to the air motors 450 until smooth operation results. The lancing rolls do not pull the stock material through the apparatus. Any such pulling force introduced on the stock material by operation of the lancing subassembly is merely incidental to its operation. No separate automatic control system is employed to insure synchronization between the stock linear travel and the linear travel and the lancing roll angular velocities. As best seen in FIG. 34, individual filter and oiler devices are provided in the compressed air lines to the individual air motors 450. Further, each feed line to the air motors is fitted with a pressure regulator 480 and the units are fed from a common source of compressed air 484.

The specific details of the lancing rolls are illustrated in FIGS. 35, 36, 37 and 38. The outer lancing roll 408 includes a central hub 500 which is keyed to the roll drive shaft 412. The hub supports an inner rim 502 through an annular web 504. An outer flanged rim 506 is secured to the periphery of the inner rim 502. The outer flanged rim 506 supports a plurality of alternating, vertically superimposed, concentric rings 508, 510. Rings 508 are formed with outwardly extending teeth spaced in groups around the periphery of the ring. Rings 510 are of smaller outer diameter than the lancing rings 508. Due to the alternating positioning of the rings, a plurality of vertically spaced teeth are presented around the periphery of the outer lancing roll separated by a plurality of vertical grooves.

Further, as best seen in FIG. 32, the flange 511 of the outer rim, serves to support the stock from beneath as it passes through the subassembly. This positively and accurately positions the stock relative to the lancing rolls. Also, the flange 511 confines the metal stock during lancing and thereby controls distortion of the stock.

The inner lancing roll is of similar construction and includes a plurality of concentrically positioned, superimposed spacer and lancing ring. The lancing rings 516 similarly include a plurality of lancing teeth 520 extending around the periphery of each of the rings in groups. The positioning of the concentric rings on the inner lancing roll is such that the rings provided with the projecting lancing teeth will extend into the peripheral grooves around the outer lancing roll. Similarly, the teeth on the rings of the outer lancing roll will mesh with a groove or extend into a groove on the inner lancing roll. Therefore, as the now vertical ventilation panels 16 of the partially configured stock material pass between the opposed peripheral faces of the inner and outer lancing rolls, a plurality of longitudinally extending rows of vents will be lanced at transversely spaced positions in the ventilation panel. Alternating rows will have oppositely offset straps at the ventilation openings.

Figure 37:
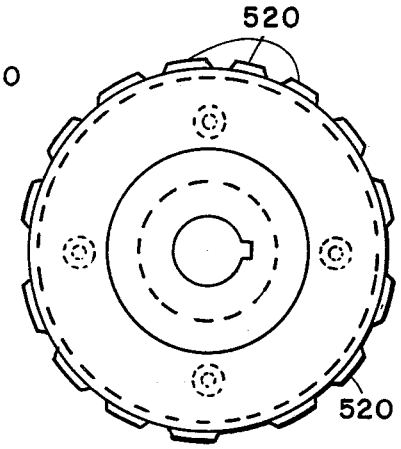
FIG. 37 is an enlarged, top, plan view of the inner lancing roll.
Figure 35:
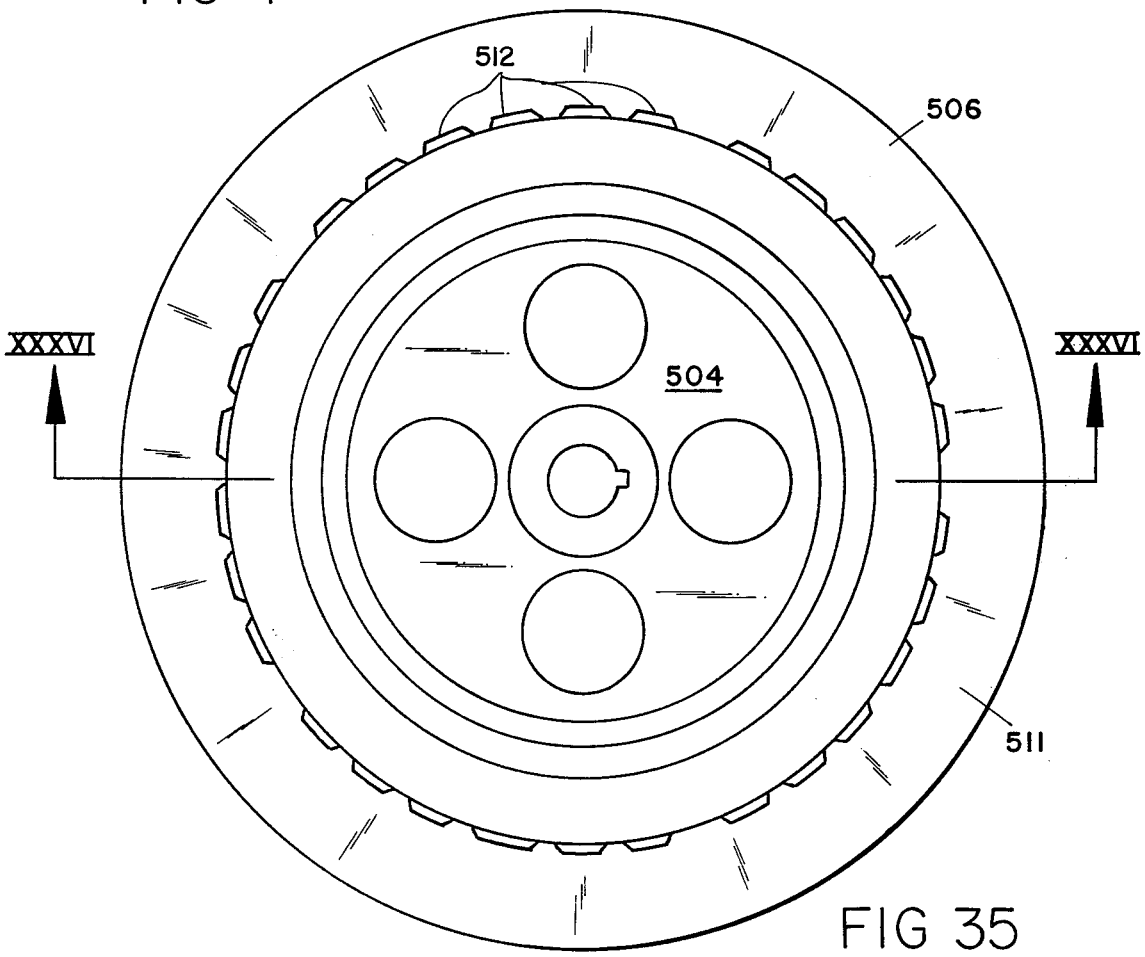
FIG. 35 is an enlarged, top, plan view of the outer lancing roll.
Figure 36:
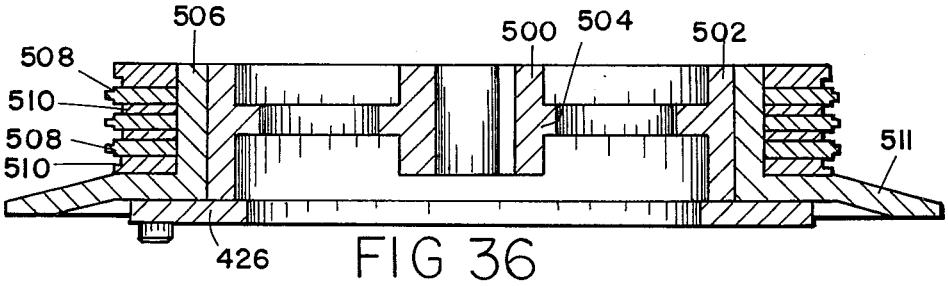
FIG. 36 is a cross-secitonal view of the outer lancing roll taken generally along line XXXVI—XXXVI of FIG. 35.

In order to insure that the offset straps are formed in the same position on each panel 16 as the panels pass through the lancing roll sets, the driven gears 452 are secured to their respective shafts 412 by a variable position arrangement. This may take the form of slots formed in the gear hubs which permit relative rotation of the gear relative to the shaft so that when it is properly positioned, the gear may be tightened and proper synchronization between the roll set pairs may be obtained. This synchronization insures that the ventilation rows formed in each panel correspond with one another and such correspondence is critical to the cutoff operation performed on the stock after it leaves the rolling mill. As best seen in FIGS. 35 and 37, the gear teeth 512, 520, respectively, are positioned in groups around the periphery of each of the lancing rolls. As a result of this grouping, the resultant rows of ventilation openings lanced in the panels will be spaced or divided into longitudinally extending sets. The spacing between each longitudinally extending set, as will be more fully described below, may then be employed for the actuation of a cutoff assembly.

As seen in FIGS. 39 and 40, the opposed inner and outer lancing rolls pierce the vertically oriented panels 16 to form longitudinally extending and transversely spaced rows of ventilation slots or openings 22. The lancing rolls described above will produce the pattern illustrated in FIG. 39. As shown therein, the inner lancing roll forms the offset straps 26 while the outer lancing roll forms the lower offset straps 26. The inner lancing roll may be provided with a beveled, lower row of teeth 536, illustrated in FIG. 38, to thereby form in the ventilation panel, the longitudinally extending row of louvered openings 31. In the preferred form, the diameter of the outer lancing roll is equal to twice the diameter of the inner lancing roll. Therefore, the inner lancing roll has half as many lancing teeth extending around its periphery as are provided on the outer lancing roll. It, of course, should be understood that differently configured lancing teeth arrangements may be employed with the opposed inner and outer lancing rolls. For example, a toothed cross section may be provided which will form a single lanced opening in the ventilation panels so that the vent openings are baffled by conventional louvers.

STATIONS X–XX

Upon leaving the lancing subassembly, which is designated station IX in the overall apparatus, the stock material is further bent by a second group of individual rolling stations. These stations progressively bend the stock into the final cross-sectional shape, illustrated in FIG. 1. This second group includes ten individual stations. In the drawings depicting these stations, the lanced openings in the panels 16 are illustrated schematically.

STATION NO. X

Figure 41:
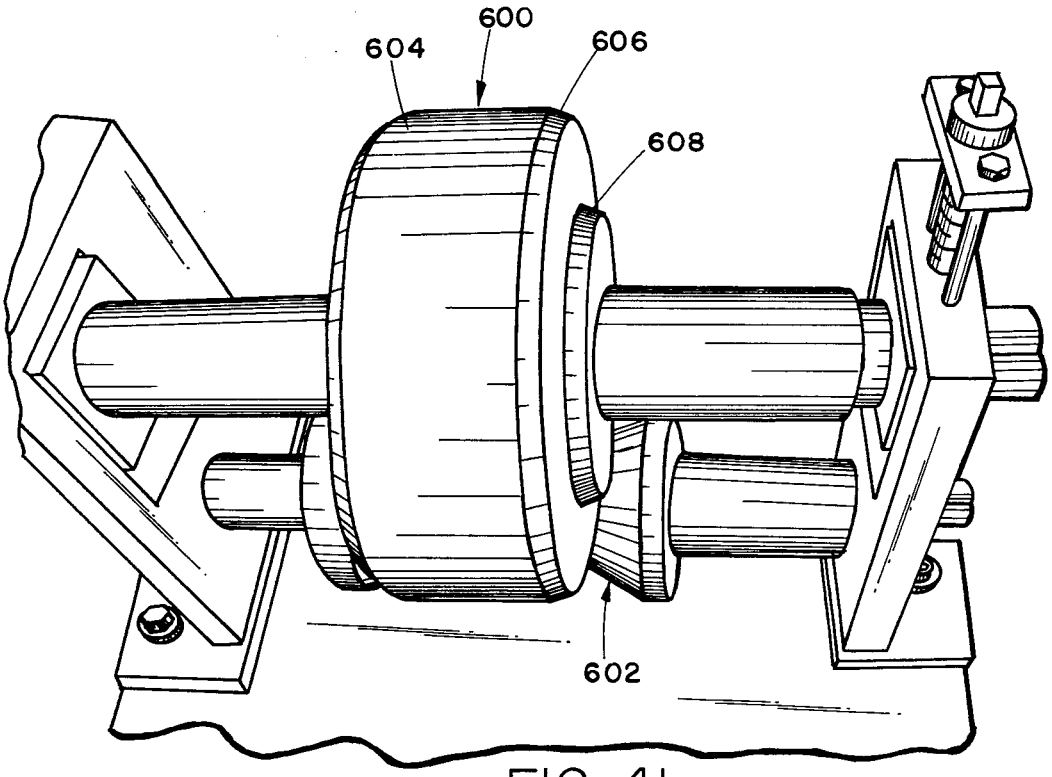
FIG. 41 is a fragmentary, perspective view of station No. X.
Figure 42:
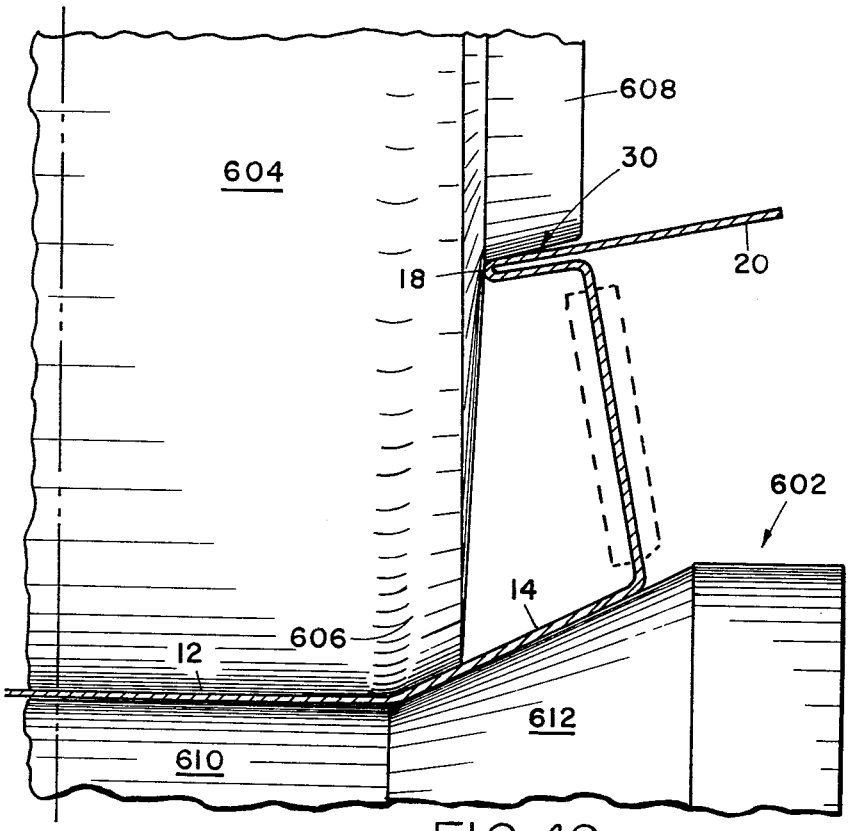
FIG. 42 is an enlarged, fragmentary, front, elevational view of station No. X.

As best seen in FIGS. 41 and 42, station X includes an upper roller 600 and a generally concave-shaped lower roller 602. The upper roller 600 includes a central cylindrical portion 604 which has a beveled edge 606. A beveled hub portion 608 is formed at each end of the upper roll 600. The lower roll 602 includes a central, generally cylindrical portion 610 and terminates on each end with conical portions 612. The beveled edge 606 of the upper roll conforms with and is positioned directly above the juncture of the conical portion 612 with the cylindrical portion 610 of the lower roll. As best seen in FIG. 42, therefore, this roller die set further forms the longitudinal crease line begun at station VIII and which defines the juncture of the side wall 14 with the hood portion 12. The relationship between the beveled hub 608 and the lower roll 612 is such that the inner side wall portion 30 and the dam structure 18 are supported between the conical portion 612 and the beveled portion 608.

STATION NO. XI

Figure 43:
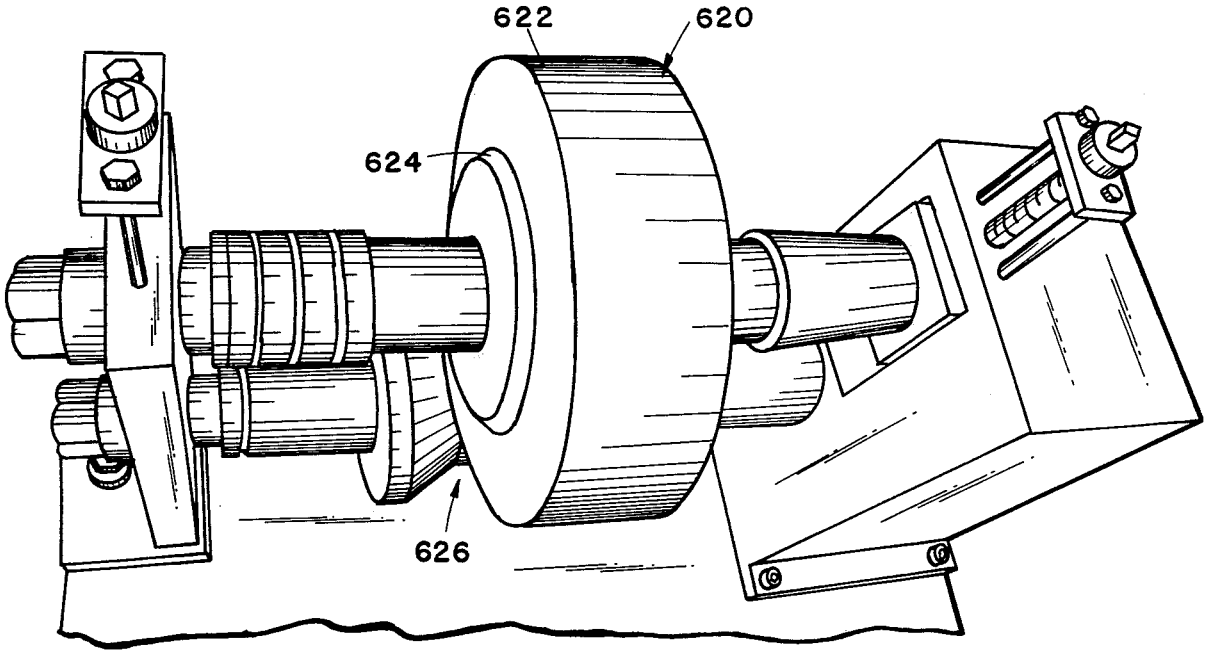
FIG. 43 is a fragmentary, perspective view of station No. XI.
Figure 44:
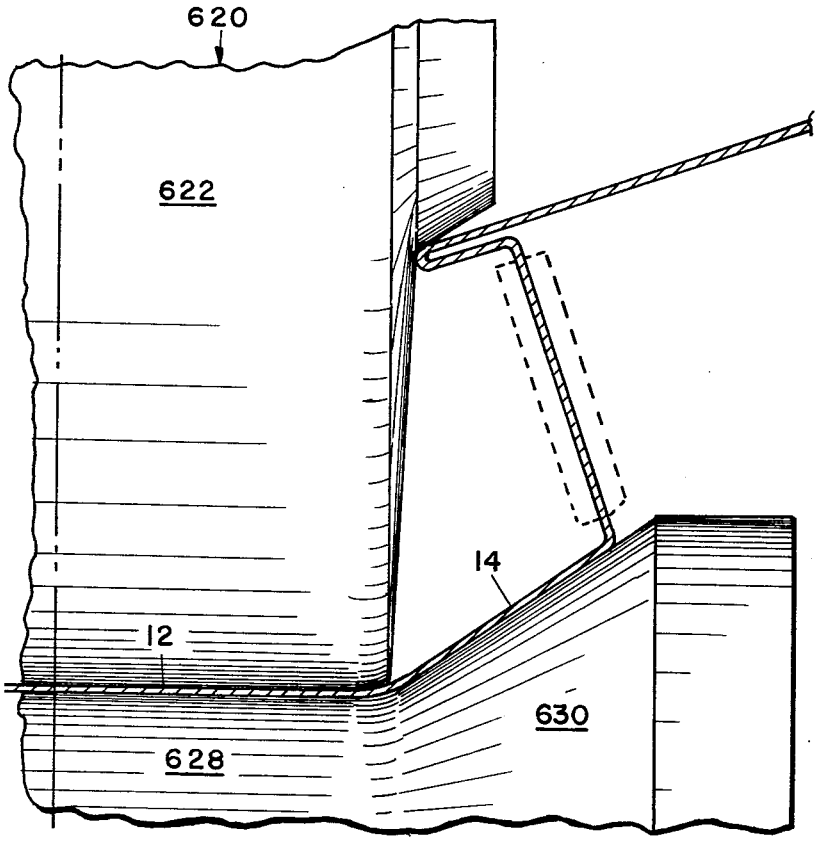
FIG. 44 is an enlarged, fragmentary, front, elevational view of station No. XI.

As best seen in FIGS. 43 and 44, station XI similarly includes an upper roll 620 having, however, a nonbeveled central cylindrical portion 622. Each end of the upper roll 620, however, includes beveled or conical hub-like portions 624. The lower roll 626 includes a central cylindrical portion 628 and end conical portions 630. As best seen in FIG. 44, the upper roll 620 is superimposed on the roll 626 so that the edge of the upper roll is positioned directly above the juncture of the conical portion 630 with the cylindrical portion 628. As a result, the side wall portion 14 is further rotated inwardly relative to the hood 12.

STATION NO. XII

Figure 45:
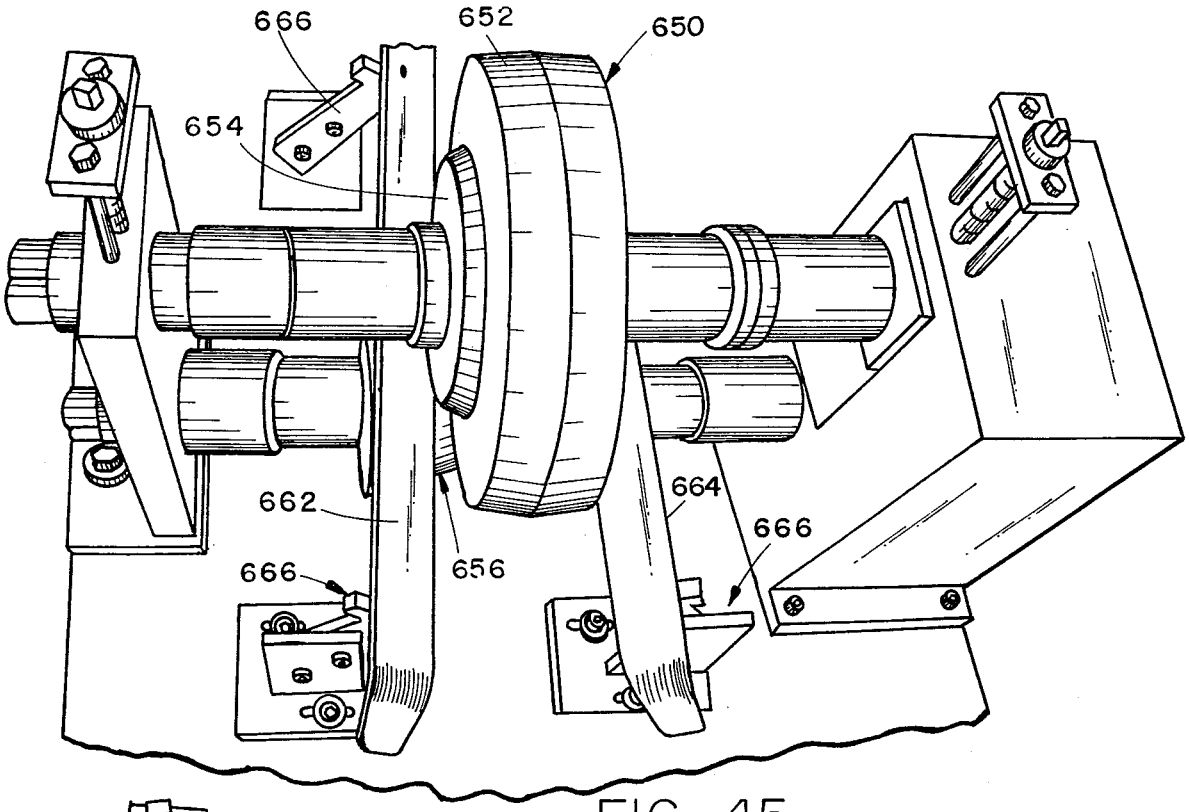
FIG. 45 is a fragmentary, perspective view of station No. XII.
Figure 46:
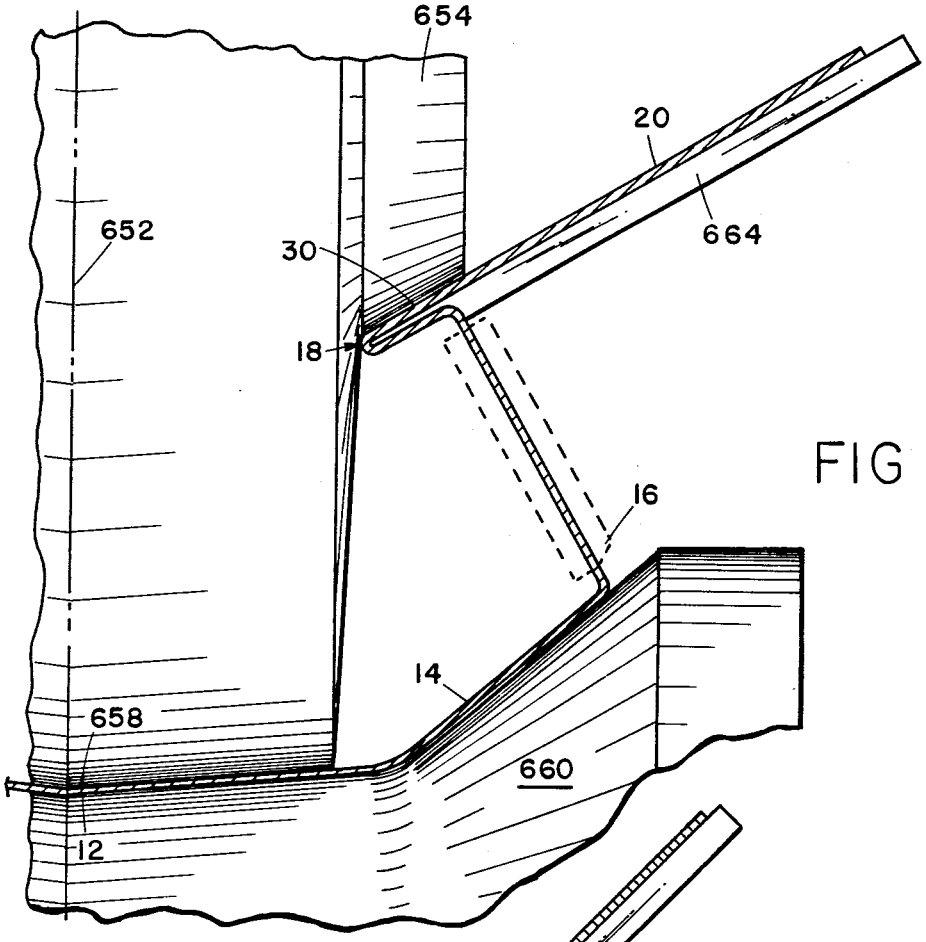
FIG. 46 is an enlarged, fragmentary, front, elevational view of station No. XII.

As seen in FIGS. 45 and 46, station XII includes an upper roll 650 having a central portion having the shape of back-to-back cones thereby defining a central, peripheral ridge 652. Each end of the roll 650 includes a beveled hub portion 654. The lower roll 656, as best seen in FIG. 46, includes a similarly configured central portion having an inwardly directed groove along the center of its periphery and angled cone portions 660. In order to support the flashing portions 20 and aid in bending the stock, angled support or guide bars 662 and 664 are employed. These guide bars extend the length of several of the stations at an incrementally increasing acute angle relative to the vertical plane. The support bars which have a generally rectangular cross section are secured to adjustable mounting brackets 666 which are in turn bolted to the bed of the apparatus. The guide bars start intermediate stations XI and XII and terminate intermediate stations XVI and XVII.

As best seen in FIG. 46, the longitudinally extending, progressively angled guide bars 664 support the stock material from underneath in the area of the flashing portion 20. The guide bars which are angled further towards the vertical as they extend lengthwise of the apparatus serve to support the stock material and also assist in folding over the ventilation panels 16 to an ultimate position where they are approximately horizontal with the bed of the apparatus. These bars are critical to the overall functioning of the apparatus and the quality of the ultimate product produced. Since the ventilation panels 16 have been lanced at station IX, these surfaces may not be contacted again. The stock material must, however, be supported in some manner as it passes through the remaining stations. The guide bars 662, 664, perform this function and also assist in bending the ventilation panels 16 to the desired final position.

STATION NO. XIII

Figure 47:
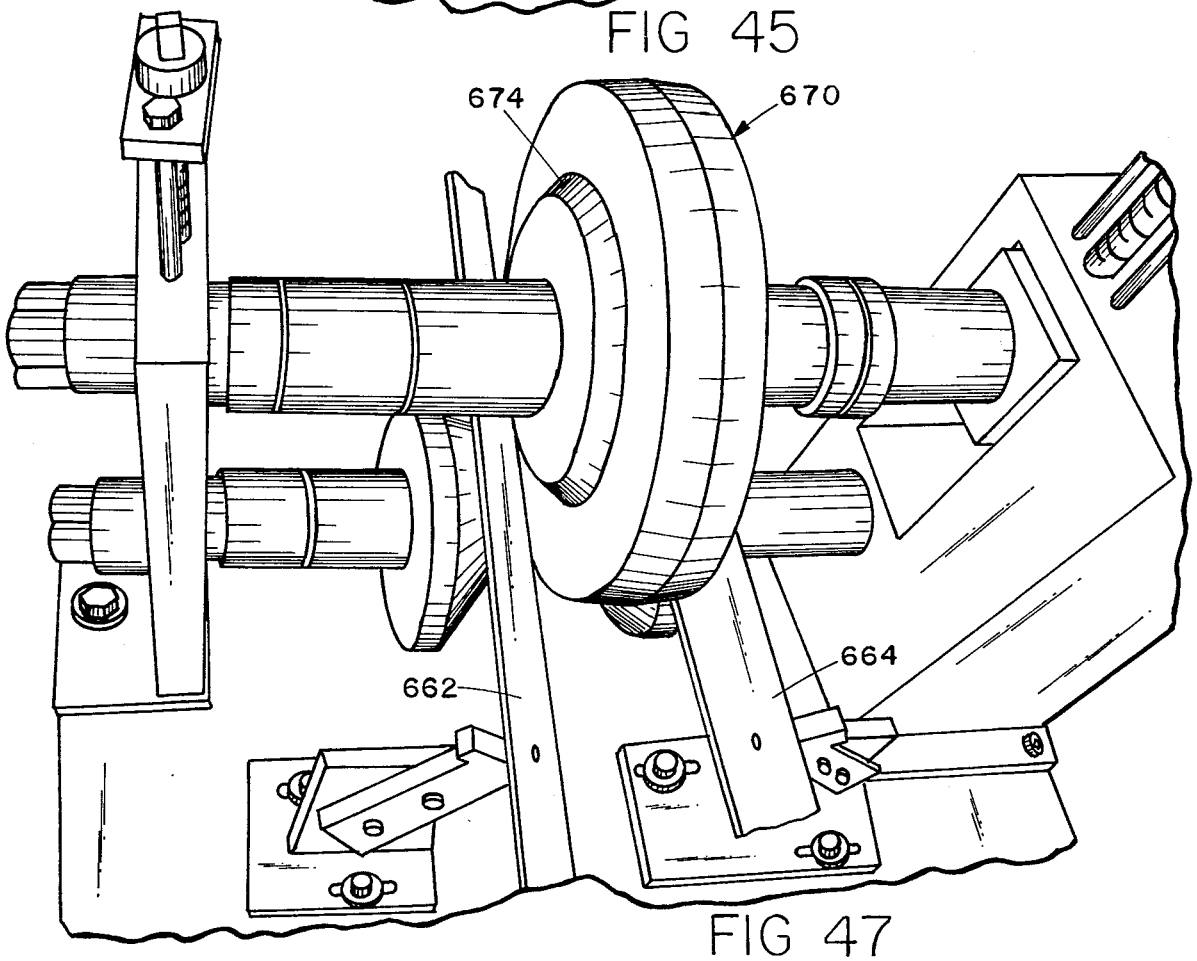
FIG. 47 is a fragmentary, perspective view of station No. XIII.
Figure 48:
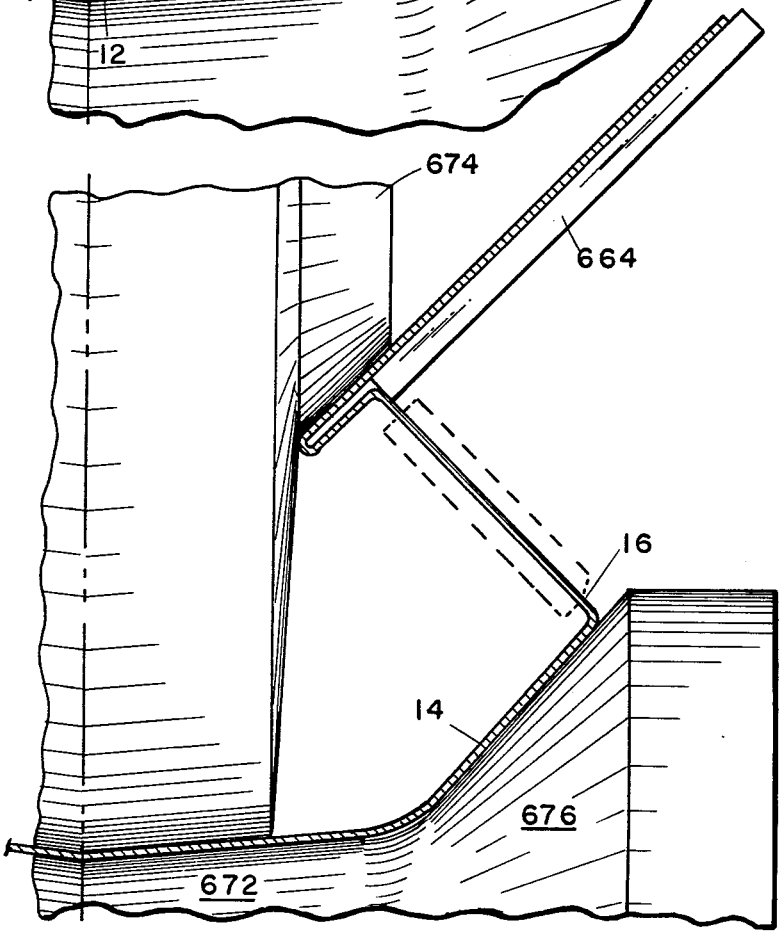
FIG. 48 is an enlarged, fragmentary, front, elevational view of station No. XIII.

As seen in FIGS. 47 and 48, station XIII includes a configured upper roll 670 and a configured lower roll 672. Beveled portions 674 of the upper roll are formed with a more acute angle of convergence than the previous station. The conical portions 676 of the lower roll are angled so that they are generally parallel with the beveled portions 674. Also, as is readily apparent from a comparison of FIGS. 46 and 48, the support or guide bars 662, 664, are positioned at a greater angle relative to the horizontal and further, are generally parallel to the peripheral surface of the beveled portions 674 of the upper roll 670.

As should be apparent, the progressive change in the conical portions of each of the upper and lower rollers in conjunction with the progressive angling of the support bar 664 serves to further bend the stock material into the desired configuration.

STATION NO. XIV

Figure 49:
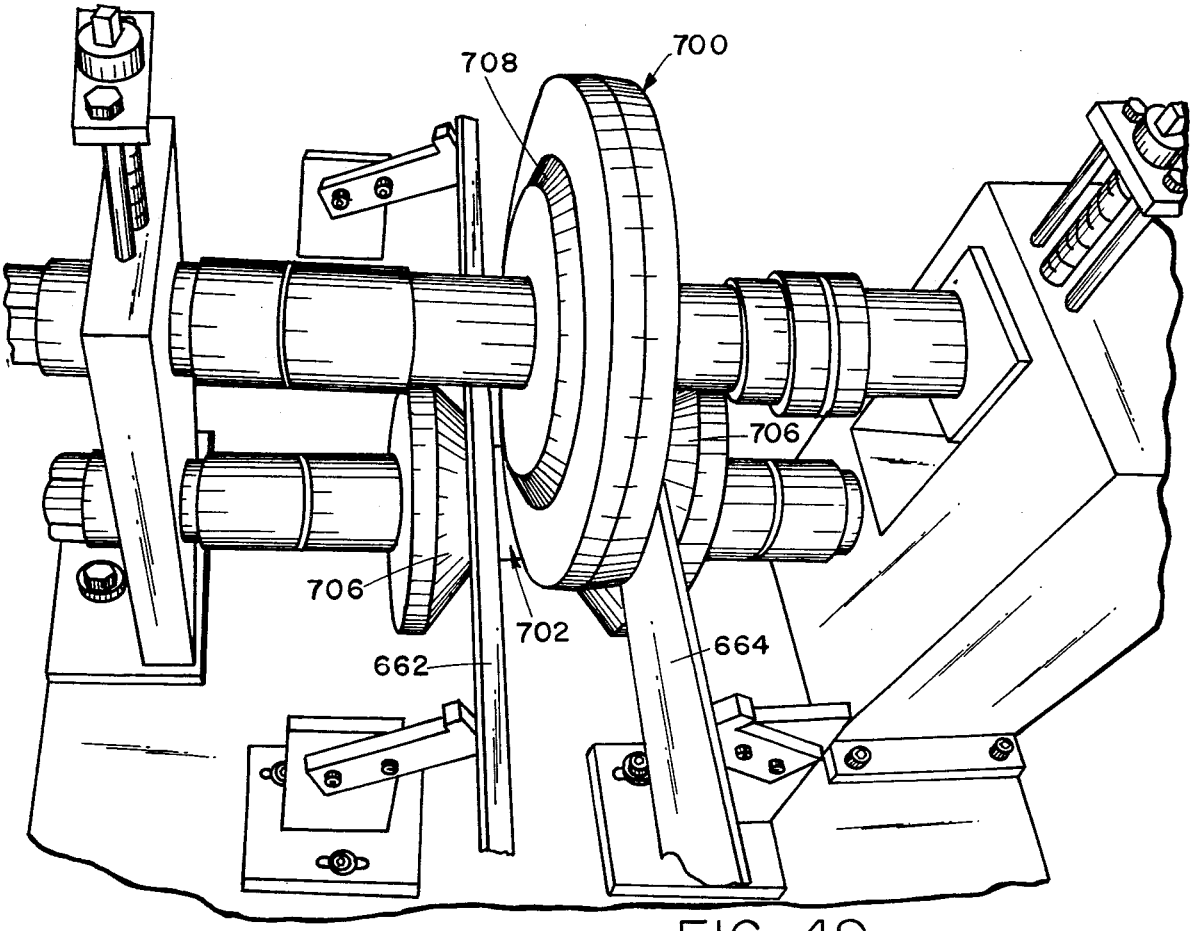
FIG. 49 is a fragmentary, perspective view of station No. XIV.
Figure 50:
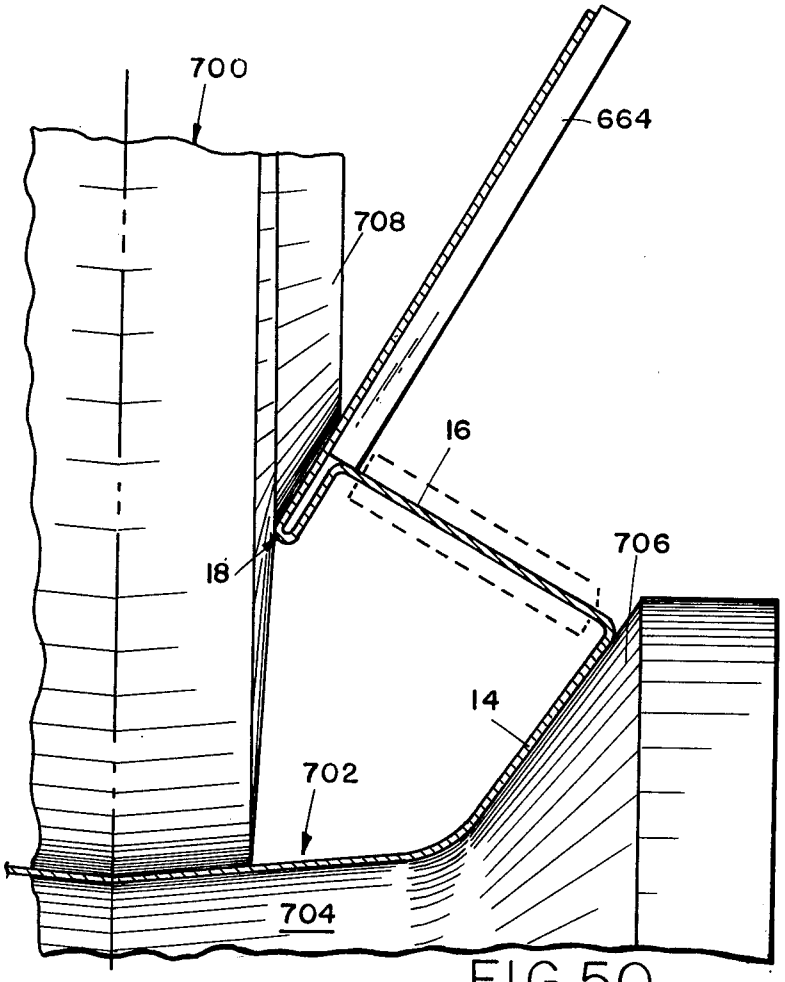
FIG. 50 is an enlarged, fragmentary, front, elevational view of station No. XIV.

As seen in FIGS. 49 and 50, station XIV includes a peaked, generally cylindrical upper roller 700 and a lower roller 702 having a grooved central portion 704 and end conical portions 706. As is readily apparent from a comparison of FIGS. 47 and 49, the transverse dimension or thickness of the upper rollers has decreased progressively as the stock material is folded over towards its final configuration. Further, the longitudinal dimension of the central portions of the lower rollers has correspondingly decreased. The guide bars or support bars 662, 664, besides angling progressively towards the vertical, are also converging towards one another. As best seen in FIG. 50, the side wall portions 14 of the vent are now bent to their proper configuration. The support bars 662 and 664 have assisted in bending the ventilation panels 16 towards their final horizontal position. The conical surfaces 706 of the lower roll are spaced from the beveled end surfaces 708 of the upper roll a distance substantially equal to that occupied by the ventilation panels 16 and the dam structures 18.

STATION NO. XV

Figure 51:
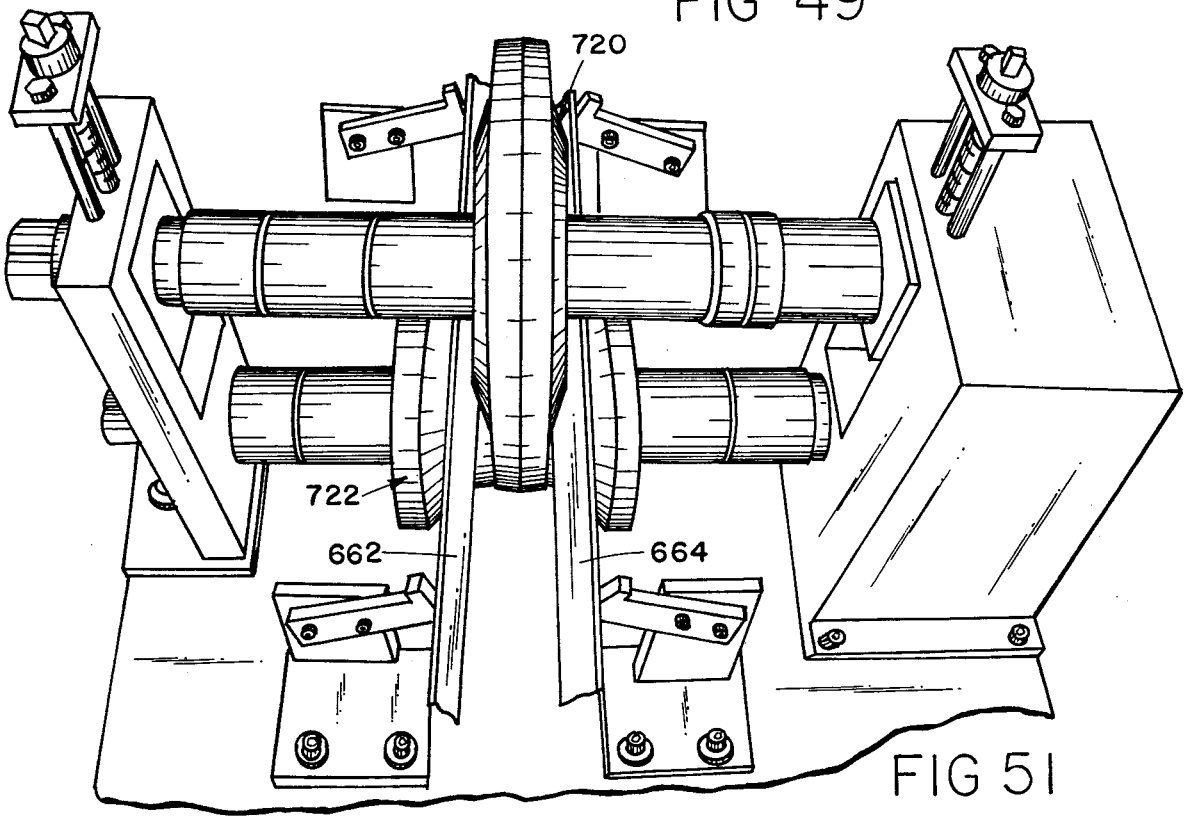
FIG. 51 is a fragmentary, perspective view of station No. XV.
Figure 52:
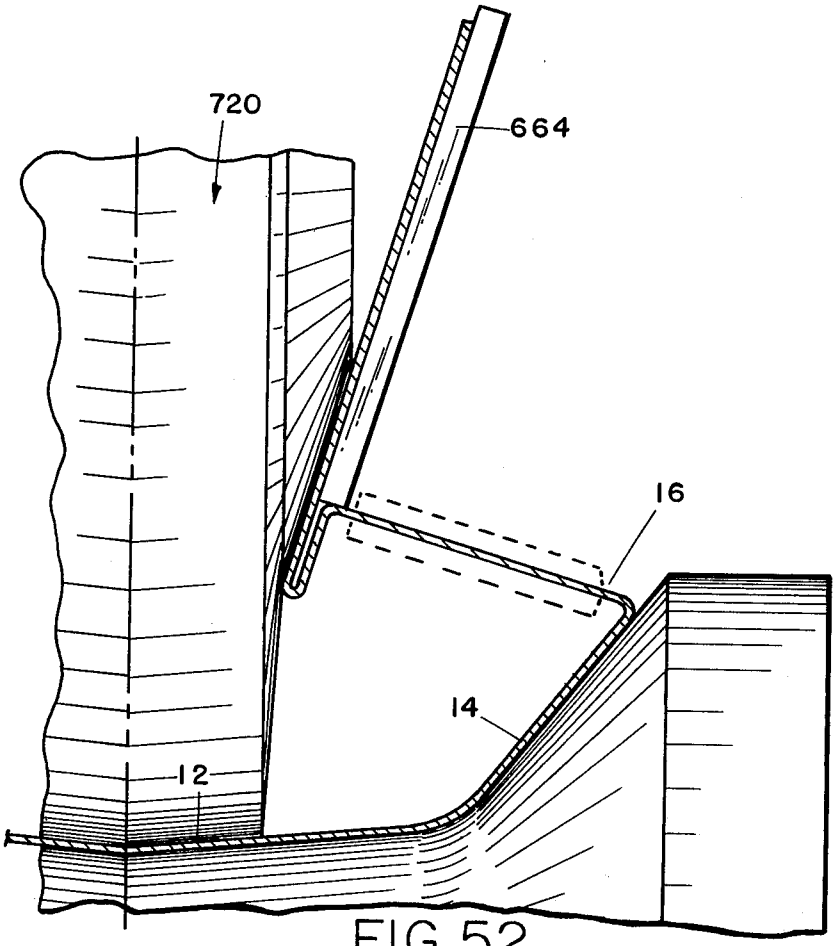
FIG. 52 is an enlarged, fragmentary, front, elevational view of station No. XV.

As seen in FIGS. 51 and 52, station XV includes an upper roll 720 of narrower thickness than the roll 700 of station XIV and a lower roll 722 having a longitudinal dimension less than that of the lower roll 702 of station XIV. As best seen in FIG. 52, the guide support bars 662, 664, are now at an acute angle relative to vertical and the ventilation panels 16 are approaching a horizontal position.

STATION NO. XVI

Figure 53:
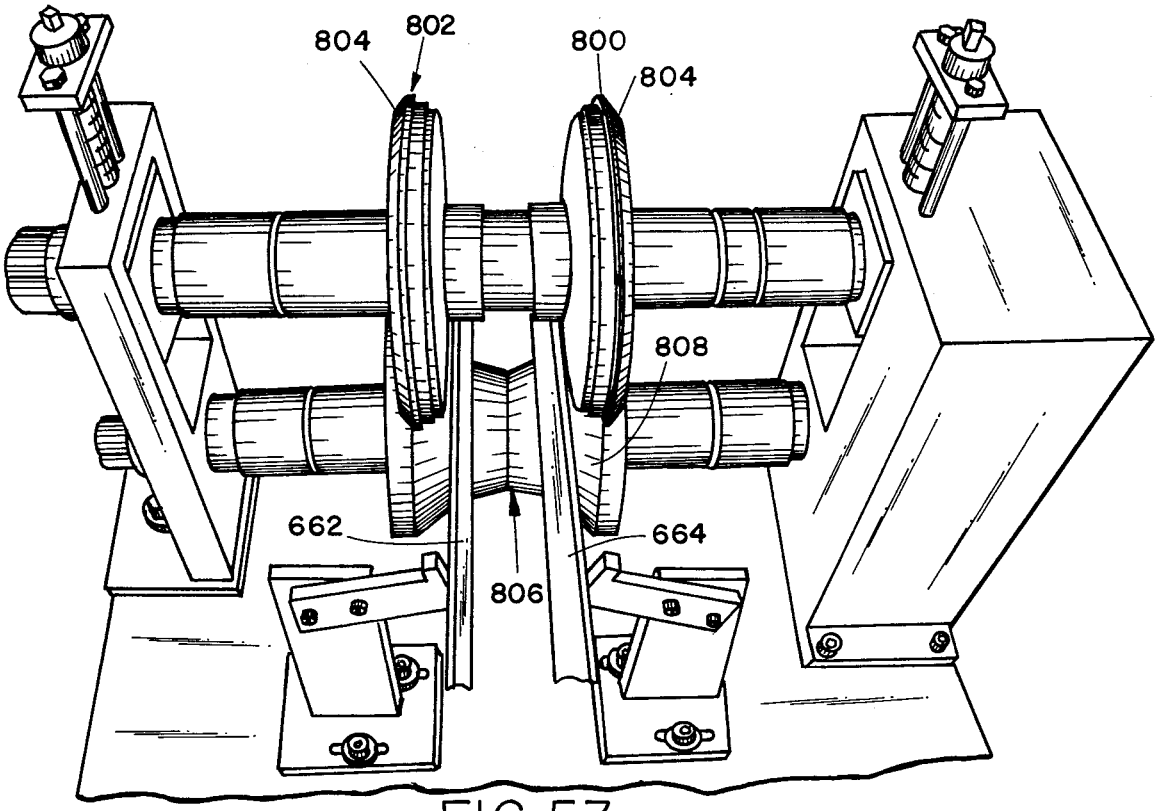
FIG. 53 is a fragmentary, perspective view of station No. XVI.
Figure 54:
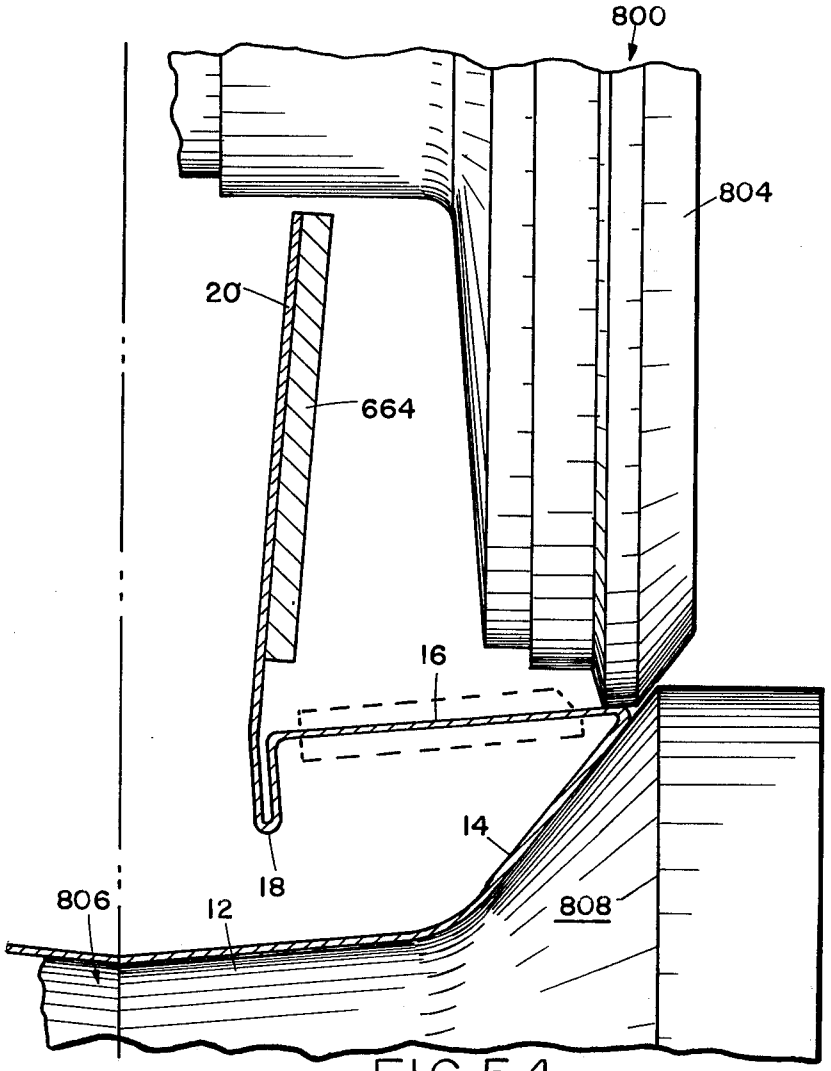
FIG. 54 is an enlarged, fragmentary, front, elevational view of station No. XVI.

As seen in FIGS. 53 and 54, station XVI deforms the stock material so that the ventilation panels are essentially horizontal to the bed of the apparatus. This deformation is accomplished by a pair of transversely spaced upper rolls 800, 802. Each of the upper rolls are similarly configured and have a generally stepped cross-sectional configuration terminating in outer beveled edges 804. The lower roll 806 is configured substantially the same as the lower roll of the previous station. As best seen in FIG. 54, the beveled surface 804 of the upper roll is parallel to the conical surface 808 of the lower roll. The stock material is contacted by the upper roll adjacent the outer, lateral edge of the vent panels 16. This coaction between the upper roll and the lower rolls fixes the cross-sectional shape of the hood and ventilation panels. The flashing portions 20 of the stock are held against the now almost vertical support bars. The support bars prevent the material from buckling outwardly under the forces exerted upon it by station XVII. In order to insure that the proper cross-sectional shape is obtained, the panels 16 are in fact bent beyond their final position. This overbending compensates for any tendency of the material to return to its original pre-station shape.

STATION NO. XVII

Figure 55:
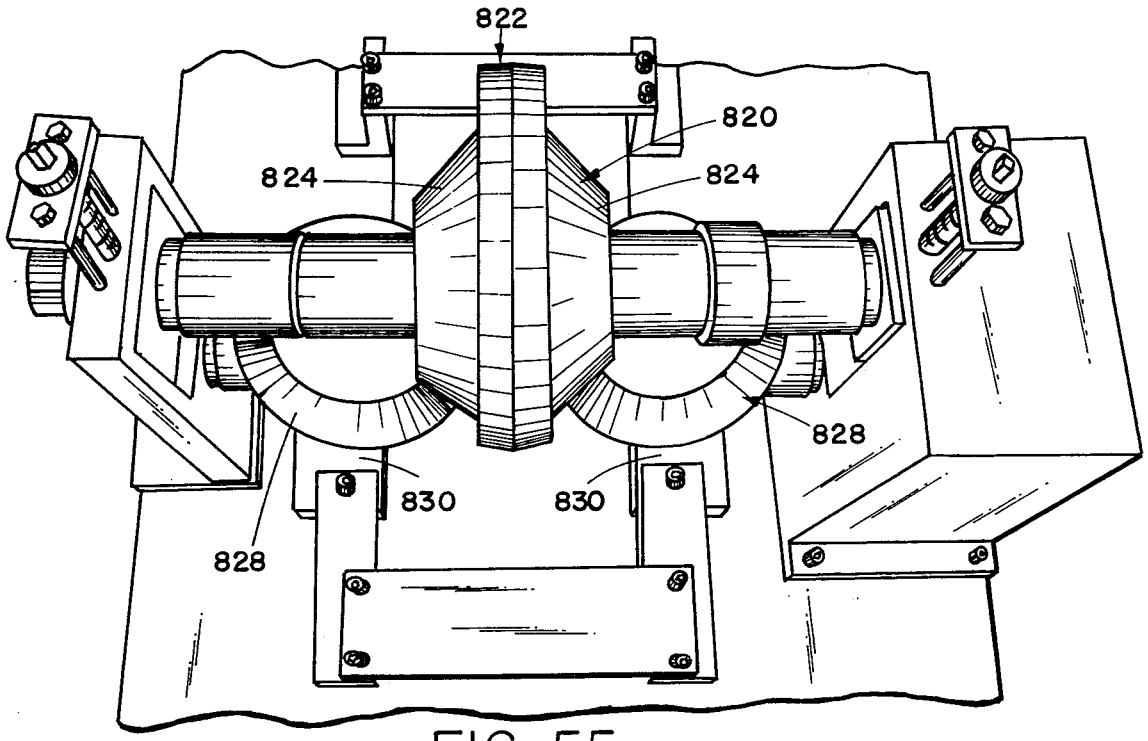
FIG. 55 is a fragmentary, perspective view of station No. XVII.
Figure 56:
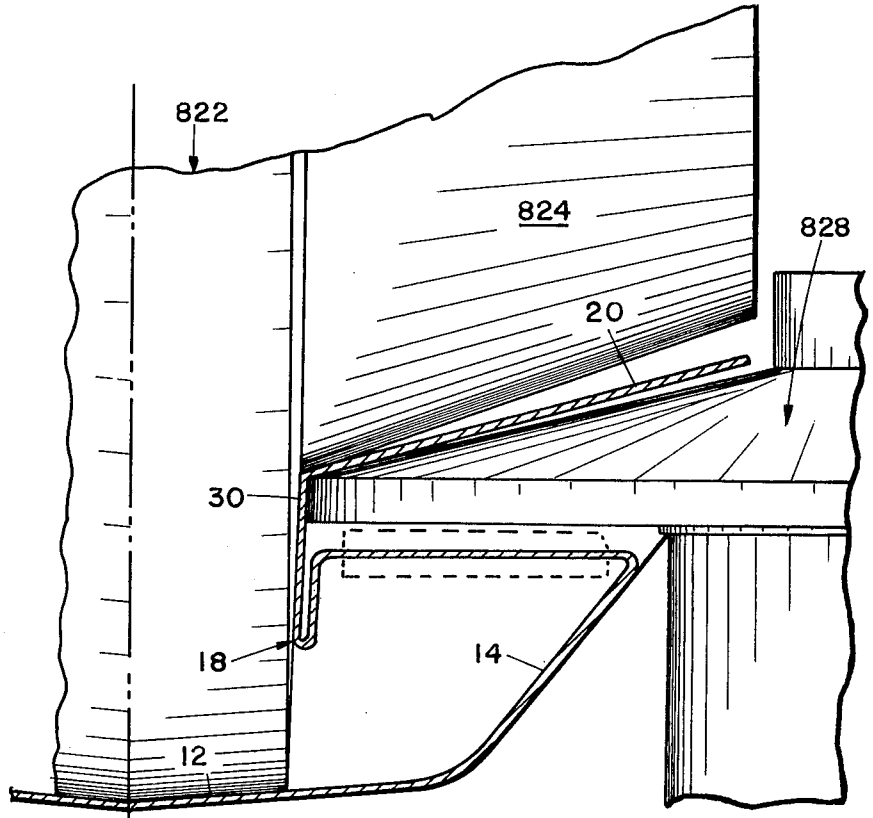
FIG. 56 is an enlarged, fragmentary, front, elevational view of station No. XVII.

As seen in FIGS. 55 and 56, station XVII includes an upper roll 820 having a center portion 822. The center portion 822 is of a transverse dimension or thickness which is substantially equal to the width of the throat area of the almost completed roof ridge vent. Further, the upper roll 820 includes outwardly converging frusto-conical portions 824. At station XVIII, the upper roll 820 coacts with a lower roll 826 (FIG. 56) having the same general configuration as lower roll 808 of station XVI. Further, the upper and lower rolls coact with a pair of transversely spaced cluster rolls 828 mounted for free rotation about their vertical axes. The cluster rolls 828 are each rotatably mounted on a stand assembly including legs and a cross member 830. As best seen in FIG. 56, the cluster rolls are generally disc-shaped having a frusto-conical surface which assumes an acute angle with the horizontal. The conical portion 824 of the upper roll coacts with the cluster roller 828 to bend the flashing portion 20 of the product through an angle greater than that which it assumes in its final cross-sectional shape. This overbending assures an accurate crease line which divides the flashing portion 20 from the inner side wall 30. Further, the ventilation panels 16 are now in a substantially horizontal position.

STATION NO. XVIII

Figure 57:
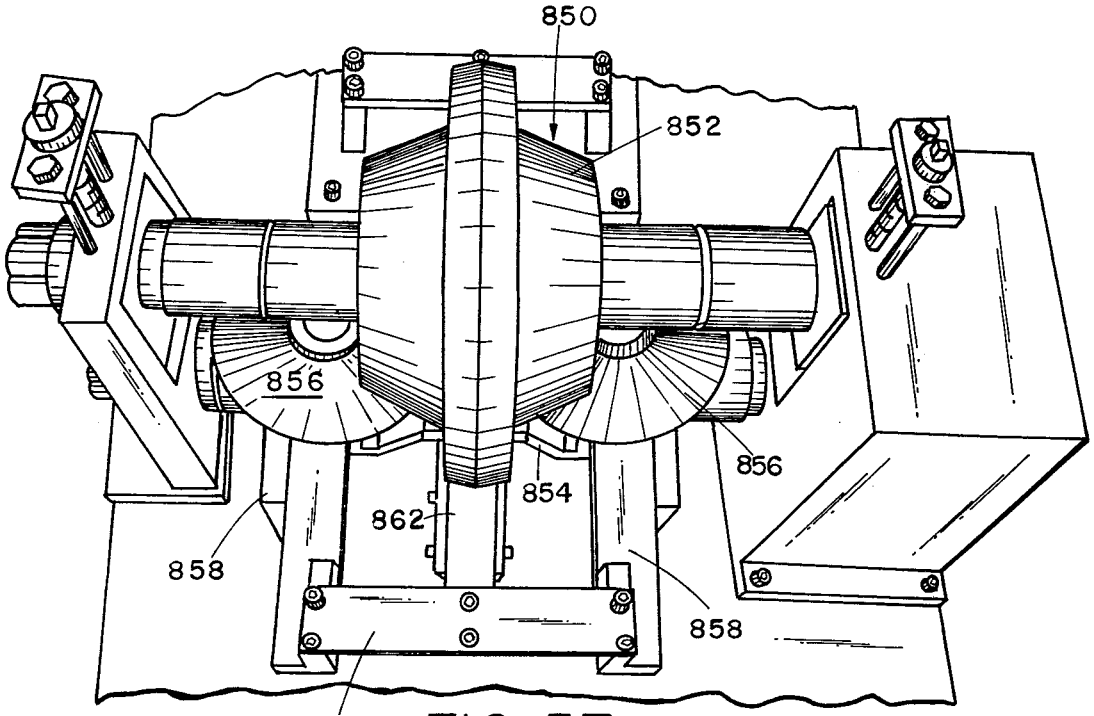
FIG. 57 is a fragmentary, perspective view of station No. XVIII.
Figure 58:
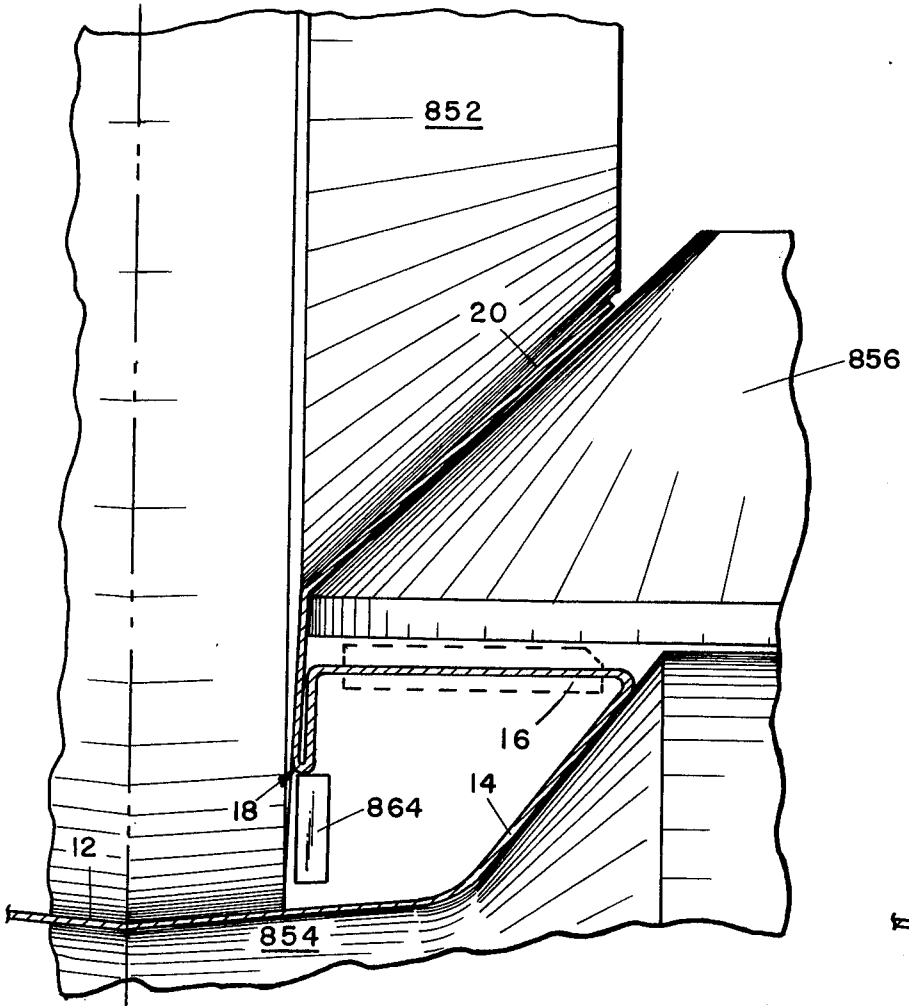
FIG. 58 is an enlarged, fragmentary, front, elevational view of station No. XVIII.

As seen in FIGS. 57 and 58, the stock material is bent to its final cross-sectional configuration at station XVIII. Station XVIII includes an upper roll 850 having conical end portions 852, a lower roll 854 configured the same as the lower roll of station XVII. A pair of opposed cluster rolls 856 are mounted for rotation about their vertical axes on stands 858. Cross members 860 connect the leading and trailing ends of the stands 858. Extending below and centrally of the cross members 860 at both the inlet and the outlet to station XVIII are guide blocks 862 (FIG. 57) and 864 (FIG. 58). The guide blocks support the dam 18 as the stock passes through station XVIII. As best seen in FIG. 58, the cluster rolls 856 are not as acutely angled relative to horizontal as the cluster rolls of station XVII. The cluster rolls 856 coact with the conical portions 852 of the upper roll to bend the flashing portions 20 back to their final and completed product position. The guides 862, 864, support the stock material and prevent collapse of the material inwardly upon passage through station XVIII.

STATION NO. XIX

Figure 59:
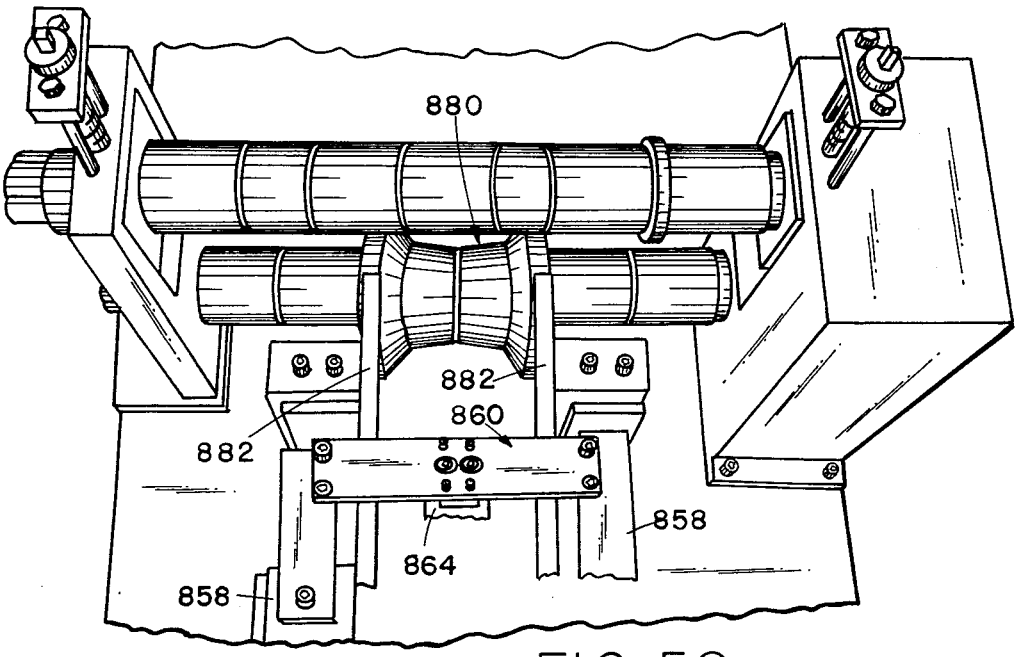
FIG. 59 is a fragmentary, perspective view of station No. XIX.
Figure 60:
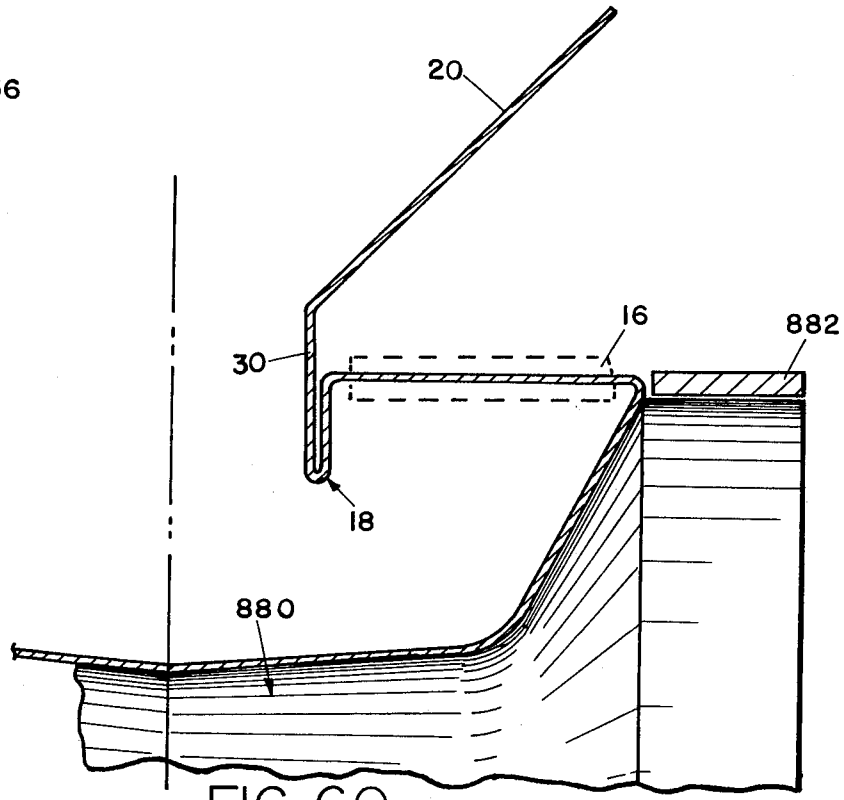
FIG. 60 is an enlarged, fragmentary, front, elevational view of station No. XIX.

As seen in FIGS. 59 and 60, station XIX includes only a lower concave roller 880. The lower roller 880 serves primarily to support the stock material prior to entry into the final station or last pass of the apparatus. A pair of horizontally positioned, longitudinally extending guide bars 882 extend outwardly from the cross member 860 positioned between the stands 858. These guide bars are essentially tangential to the cylindrical end portions 884 of the lower roller 880. The guide bars 882 insure that the stock material passes through station XIX without canting or rotating about its longitudinal axis since they are positioned to engage or abut against the outer lateral edge of the ventilation panels 16 and side walls 14.

STATION NO. XX

Figure 61:
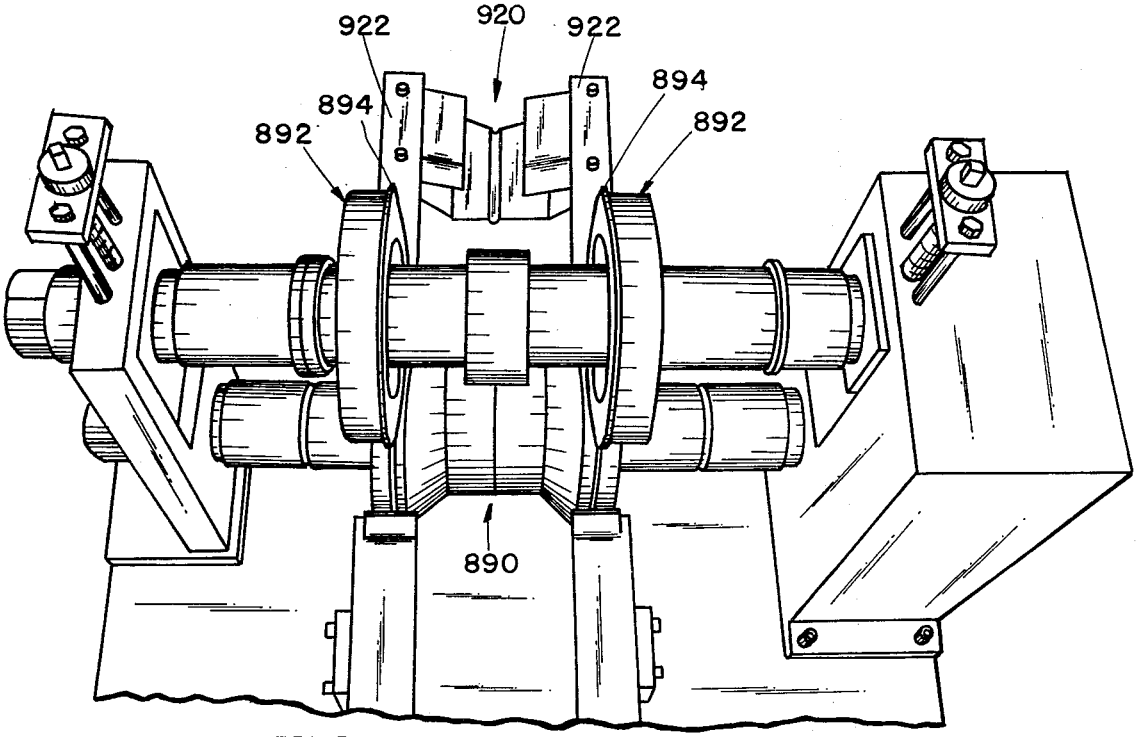
FIG. 61 is a fragmentary, perspective view of station No. XX.
Figure 62:
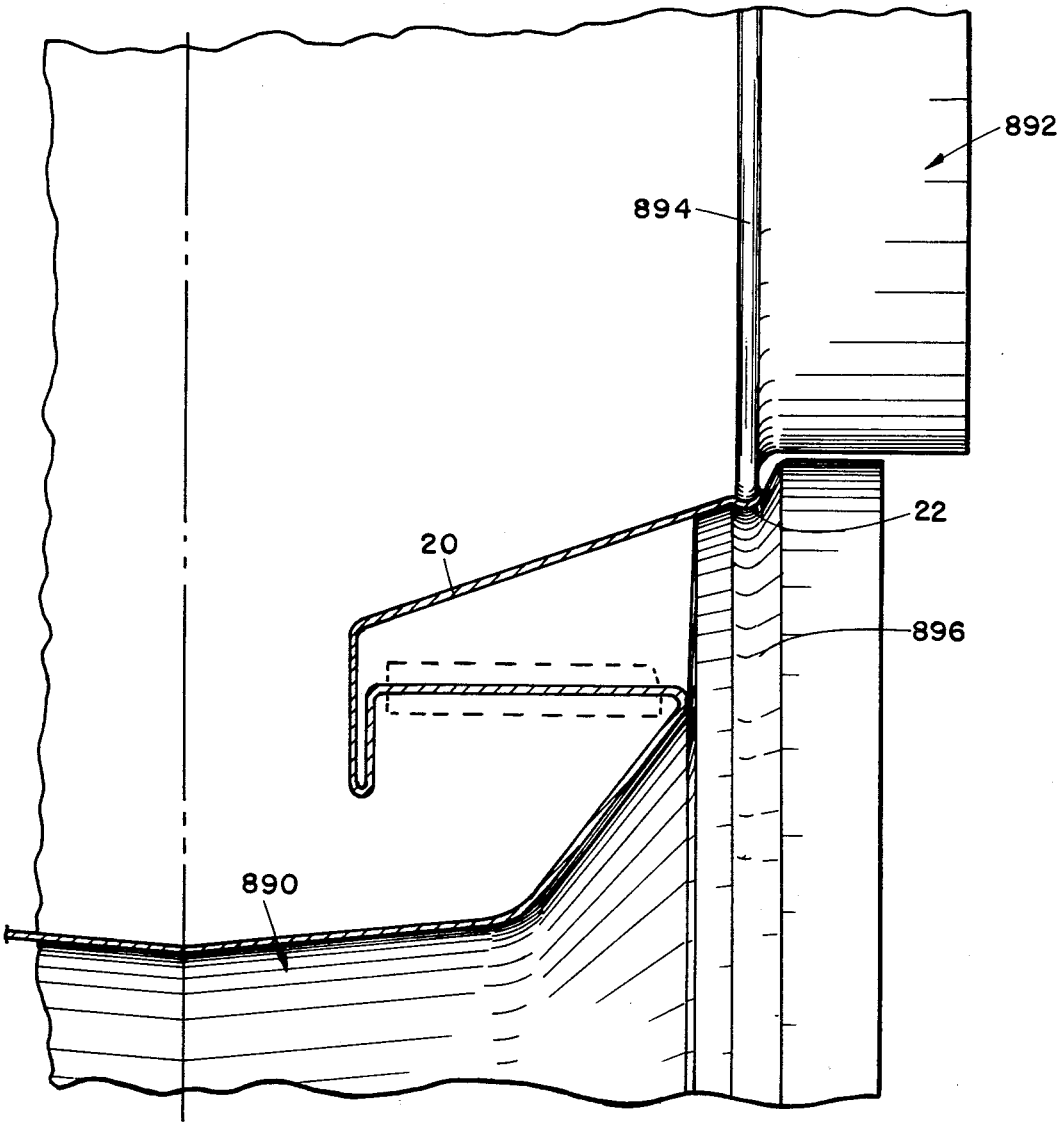
FIG. 62 is an enlarged, fragmentary, front, elevational view of station No. XX.
Figure 67:
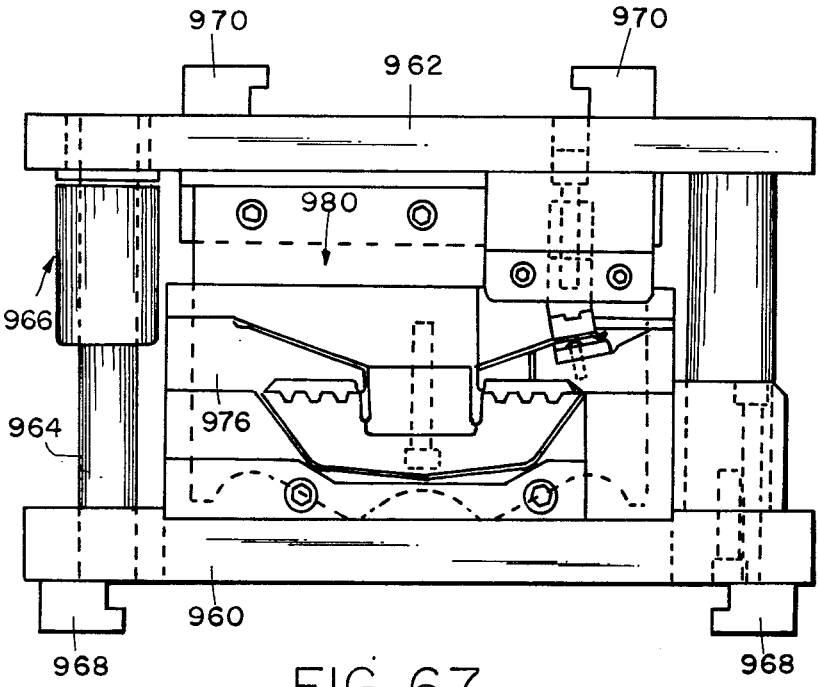
FIG. 67 is a front, elevational view of the cutoff die and knife assembly.

As seen in FIGS. 61 and 62, station XX includes a lower roll 890 and a pair of opposed, spaced upper rolls 892. The upper rolls 892 include around their opposed faces, peripheral beads 894. As seen in FIG. 62, the peripheral beads 894 of each upper roll coact with a circumferential groove 896 formed adjacent the ends of the lower roll 892 to deform the stock material and thereby form the stiffening lip 22 which extends longitudinally adjacent the free lateral edge of the flashing portion 20.

STRAIGHTENER

As seen in FIGS. 61, 63, 64, and 65, positioned immediately downstream of station XX is a multi-sectioned straightener 920. Straightener 920 is supported by rectangular bars 922 positioned immediately downstream of station XX. As seen in FIG. 63, straightener 920 is formed from multiple pieces 924, 926, 928, and 930 which are retained between upper and lower plates 932, 934.

As is apparent from FIGS. 63 and 65, the individual elements which make up the straightener are spaced from one another and configured to permit passage of the now fully formed stock material. Pieces 928 and 930 conform generally to the hood section of the completed vent. Pieces 926 conform generally to the ventilation panel and flashing portions of the completed vent and piece 924 conforms to the flashing portions and the throat of the completed vent. As best seen in FIG. 65, the individual pieces which make up the straightener are beveled at the inlet to the straightener or, in other words, have a bell mouth configuration,. The inwardly converging inlet insures that entry into and passage through the straightener by the stock material will be smooth.

CUTOFF ASSEMBLY

Figure 66:
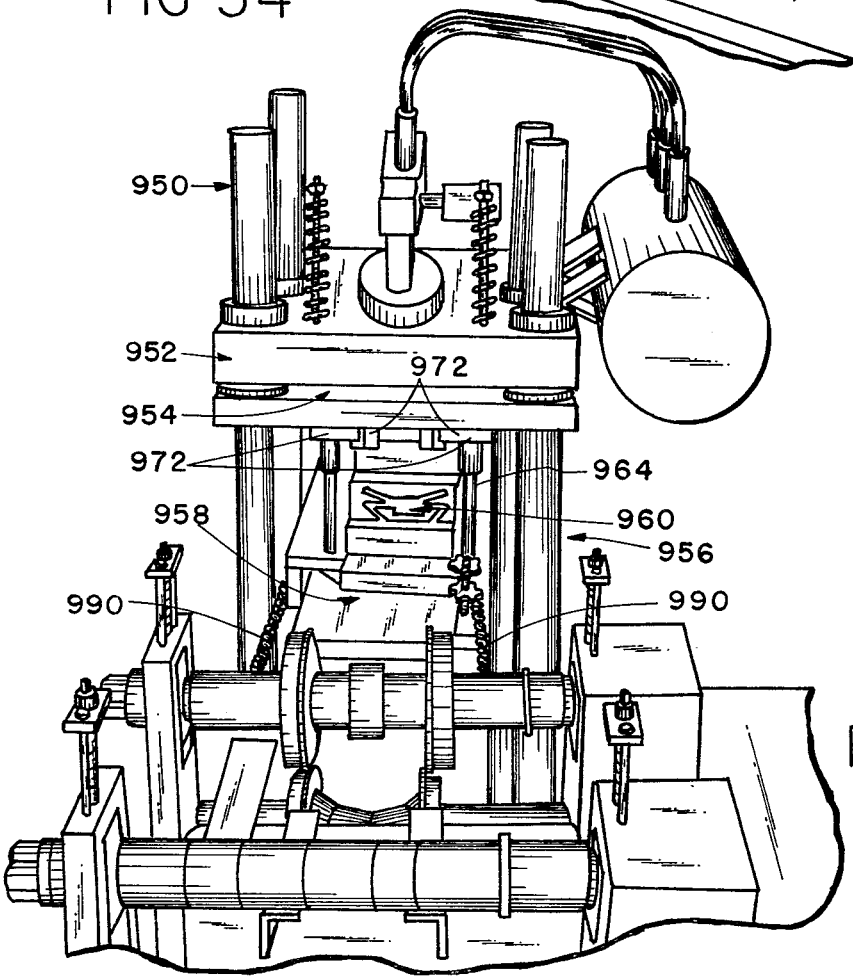
FIG. 66 is a fragmentary, perspective view of the cutoff subassembly positioned downstream of station no. XX.
Figure 68:
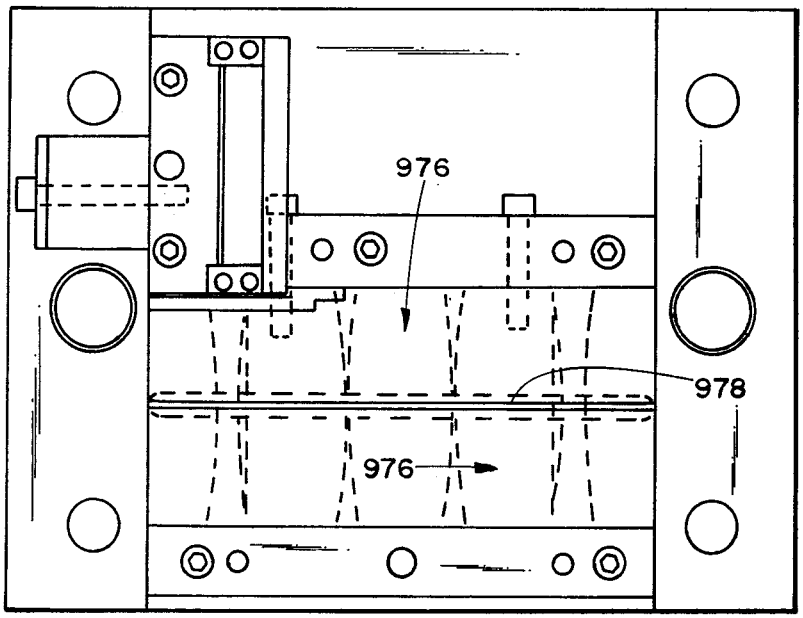
FIG. 68 is a top, plan, elevational view of the die assembly with the upper plate and knife removed.
Figure 69:
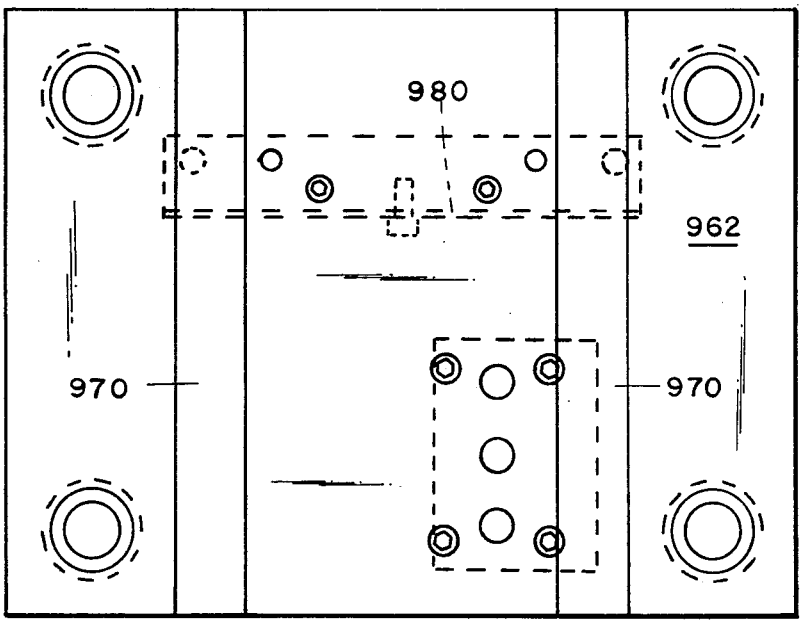
FIG. 69 is a top, plan view of the cutoff die and knife assembly.
Figure 70:
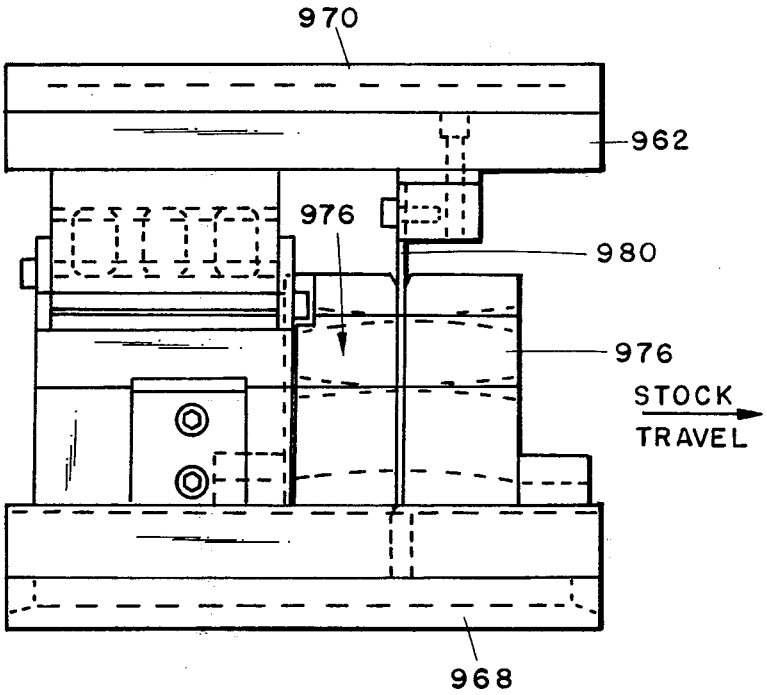
FIG. 70 is a side, elevational view of the cutoff die and knife subassembly.

With reference to FIG. 66, the cutoff assembly generally designated 950 is positioned immediately downstream of station 20. The cutoff assembly 950 includes an air powered ram 952 having an upper plate assembly 954 mounted for vertical movement on guide posts 956. The ram further includes a base plate 958. A cutoff die and knife assembly 960 is supported for sliding movement between upper plate assembly 954 and the base plate 958. As best seen in FIGS. 67–70, the cutoff die and knife subassembly includes a lower base plate 960 and an upper plate 962. The upper plate is mounted for vertical movement relative to the lower plate 960 by a plurality of posts 964 received in bushings 966. The lower die plate 960 includes transversely spaced L-shaped lugs 968. These lugs 968 engage correspondingly configured tracks 970 secured to the ram air base plate 958. The upper plate 962 similarly includes generally inverted L-shaped lugs 970. Lugs 970 slide on and engage L-shaped lugs 972 secured to the underside of the ram air upper plate assembly 952. In this manner, the cutoff die and knife assembly is mounted for sliding, longitudinal movement with the continuously moving stock during the cutting operation. In other words, the cutoff mechanism is an "on the fly" type device. Mounted on the lower base plate 960 are a pair of multipiece die members 976. As best seen in FIGS. 68 and 70, the die members 976 are in tandem and spaced from each other to define a knife receiving slot 978. Rigidly secured to the underside of the upper plate 962 is a cutting knife 980. As with the straightener subassembly each cutoff die 976 is formed from molding pieces which when assembled define a through passage 982 having the same shape as the cross section of the roof ridge vent.

As best seen in FIG. 66, a pair of coil springs 990 are employed to return the sliding cutoff die to the forward position. The coil springs 990 have one end secured to the cutoff die and the other end secured to the bed of the roll forming apparatus.

A control system (not shown) is preferably employed with the cutoff mechanism to actuate the same so that the now formed stock material can be cutoff into suitable sections, such as sections having a 10 foot length. The control system includes a sensor position somewhere along the rolling mill apparatus downstream of the lancing subassembly. The sensor senses the spacing between the tandemly arranged rows of lanced ventilation openings. For example, if each individual row extends a distance of 20 inches and is then spaced by a $\frac{3}{4}$ inch area, the sensor would be connected to a suitable counting mechanism which upon the sensing of six of these $\frac{3}{4}$ inch spaces would actuate the compressed air ram. Upon actuation of the compressed air ram, the upper plate 962 which is in a raised position initially, would be forced downwardly. As knife 980 passes into the slot 978 and engages the stock, the entire cutoff die and knife assembly would be translated longitudinally by the moving stock material. Upon full reciprocation of the knife, the die is released from the material and the coil springs act to pull the die forward to its initial operating position. The components for such an automatic control system are conventional and readily adaptable to control cutoff mechanism.

SUMMARY OF OPERATION

In summary, sheet or coiled aluminum stock initially passes through a nail punch subassembly where two pairs of opposed, vertically positioned rolls punch longitudinally spaced nail holes adjacent the lateral edges of the stock material. The stock then passes into a first group of roll forming stations wherein the stock is progressively bent to the general configuration of the hood of the roof ridge vent and portions of the material are reverse bent to define the dam portions. Upon passage through the last of the stations of the first group, the dams are fully formed and the portions of the stock which will ultimately serve as the ventilation panels of the product are in an essentially vertical position.

Next, the partially formed stock enters the lancing subassembly. The lancing subassembly, which includes two pairs of longitudinally offset, inner and outer lancing rolls, lances the now vertical ventilation panels to form the ventilation openings.

Upon leaving the lancing subassembly, the now lanced and partially formed stock enters a second group of individual roll forming stations. These roll forming stations in coaction with a pair of support bars extending longitudinally of the apparatus for a portion thereof continue to bend the stock material until the hood portion of the vent is completely formed and the ventilation panels are rotated inwardly to their final horizontal positions. Further, this last group of rollers bends the flashing portions so the desired cross-sectional shape is completed. Upon leaving the last station of the second group, the stock passes through a straightener and then enters a cutoff mechanism. The cutoff mechanism is controlled so that the continuously produced roof ridge vent is cut in sections of suitable length.

It can therefore be seen that the unique method and apparatus in accordance with the present invention is capable of producing on a continuous basis, products of complex shape and, more particularly, a roof ridge ventilator having an integral dam structure and a plurality of longitudinally extending rows of hooded or baffled vent openings. The problems heretofore experienced in the production of a roof ridge ventilator having an integral dam defined by a reversed bend in the stock material are substantially eliminated. The method and apparatus of the present invention permits such a product to be produced economically on a continuous basis through the use of roll forming technology. It is expressly intended, however, that the above description should be considered as that of the preferred embodiment of the present invention. The true spirit and scope of the invention may be determined only by reference to the appended claims.

The embodiments of the invention in which an exclusive property or privilege is claimed are defined as follows.

What is claimed is:

1. A multi-station roll form apparatus adapted to continuously form an article of complex cross-sectional shape from flat stock, comprising:

a first group of individual roll forming means positioned in spaced, tandem relationship for progressively bending the stock so that a portion thereof extends in a substantially vertical plane and for reverse bending longitudinally extending portions of the stock;

lancing means positioned downstream of said first group of roll forming means for lancing areas of said vertical portion of said stock after said stock has been reverse bent;

a second group of individual roll forming means positioned in tandem relationship downstream of said lancing means for progressively bending the stock into the predetermined, complex cross-sectional shape with said lancing areas of said stock being progressively rotated to a horizontal position; and stock support means extending through some of the roll forming means of said second group for supporting lateral portions of said stock along the under-surface thereof as said stock is bent by said roll forming means and for assisting in bending said stock into the predetermined complex cross-sectional shape and for rotating said lancing areas of said stock without contacting said lancing areas of said stock.

2. An apparatus as defined by claim 1 wherein each of said roll forming means comprises:

an upper roll and a lower roll, said upper roll being configured to complement said lower roll configuration;

roller support means for supporting and positioning said upper roll above said lower roll to thereby define a nip; and drive means operatively connected to said rolls for rotating said rolls and thereby pulling the stock through said nip, the shape of said upper and lower rolls at each station varying so that stock is progressively bent as said stock passes through said roll forming means.

3. An apparatus as defined by claim 2 wherein some of said roll forming means of said second group include:

a frusto-conical cluster roll positioned in spaced relationship to said upper and lower rolls, said frusto-conical cluster roll supported for rotary movement about its vertical axis whereby, said frusto-conical cluster roll, said upper roll and said lower roll coact to form a crease line in said stock as said stock is pulled through said apparatus.

4. An apparatus as defined by claim 2 wherein the last one of said first group of individual roll forming means further includes a cluster roll supported for rotary movement about its vertical axis intermediate the ends of said upper and said lower rolls, said lower roll including a generally cylindrical center portion; a first conical portion joining said center portion in the direction of its convergence, an acutely beveled portion joining said first conical portion and a second conical portion joining said bevelled portion and converging away from said beveled portion, said upper roll including a conical portion, said cluster roll, said upper roll and said lower roll coacting to bend said stock and complete the reverse bending of said stock progressively begun by the remaining roll forming means of said first group.

5. An apparatus as defined by claim 2 wherein said roller support means comprises:

a pair of spaced vertically adjustable support head means, one of said support means positioned at one of said upper and lower rolls and the other of said support head means positioned at the other end of said upper and lower rolls; and upper and lower shafts upon which said upper and lower rolls are mounted said shafts supported by said support head means.

6. An apparatus as defined by claim 5 wherein one of said vertically adjustable support head means comprises:

a housing having a front wall and a spaced parallel rear wall, said walls each defining lower apertures and said front wall further defining a vertically extending guide slot;

a journal block slidably supported by said front wall in said guide slot, one end of said upper shaft rotatably received within said journal block and one end of said lower shaft extending through said front and rear wall apertures; and gear train means operatively connected to said lower shaft within said housing for transmitting rotary motion of said lower shaft to said upper shaft, said drive means being operatively connected to said lower shaft.

7. An apparatus as defined by claim 6 wherein the last one of said first group of individual roll forming means further includes a cluster roll supported for rotary movement about its vertical axis intermediate the ends of said upper and said lower rolls, said lower roll including a generally cylindrical center portion, a first conical portion joining said center portion in the direction of its convergence, an acutely beveled portion joining said first conical portion and a second conical portion joining said beveled portion and converging away from said beveled portion and said upper roll including a conical portion; said cluster roll, said upper roll and said lower roll coacting to bend said stock and complete the reverse bending of said stock progressively begun by the remaining roll forming means of said first group.

8. An apparatus as defined by claim 7 wherein said stock support means comprises:

an elongated, inclined, generally flat bar extending longitudinally adjacent some of said roll forming means of said second group, said flat bar positioned at an increasingly acute angle relative to the vertical at each of said roll forming means.

9. An apparatus as defined by claim 8 wherein said support means includes a second elongated, inclined, generally flat bar, said first bar and said second bar extending longitudinally of some of said roll forming means of said second group in spaced converging relationship, lateral portions of said stock riding on said flat bars as said stock is pulled through said apparatus.

10. An apparatus as defined by claim 9 wherein some of said roll forming means of said second group include:

a frusto-conical cluster roll positioned in spaced relationship to said upper and lower rolls, said frusto-conical cluster roll supported for rotary movement about its vertical axis whereby, said frusto-conical cluster roll, said upper roll and said lower roll coact to form a crease line in said stock as said stock is pulled through said apparatus.

11. An apparatus as defined by claim 1 wherein said stock support means comprises:

an elongated, inclined generally flat bar extending longitudinally adjacent some of said roll forming means of said second group, said flat bar positioned at an increasingly acute angle relative to vertical at each of said roll forming means and positioned to support the lateral edge of said stock.

12. An apparatus as defined by claim 11 wherein said support means includes a second elongated, inclined, generally flat bar said first bar and said second bar extending longitudinally of some of said roll forming means of said second group in spaced converging relationship, lateral portions of said stock riding on said flat bars as said stock is pulled through said apparatus.

13. A multi-station roll form apparatus for continuously producing a roof ridge vent from generally flat stock, said vent being the type having a hooded portion, a ventilation panel and an internal dam integral with said ventilation panel and a depending flashing portion, said dam being defined by a reverse bent portion of the stock, said apparatus comprising:

a first group of individual roll forming means positioned in a spaced, tandem relationship for progressively and continuously bending generally flat stock material fed through each of said roll forming means, said first group reverse bending transversely spaced, longitudinally extending portions of the stock to thereby form said integral internal dams positioned in a substantially horizontal plane and further bending said stock so that the ventilation panels are in a near vertical plane;

a lancing means positioned downstream from said first group of roll forming means for lancing vent openings in said ventilation panel portions of the stock, said vent openings extending in transversely spaced, longitudinally extending rows;

a second group of individual roll forming means positioned in spaced tandem relationship downstream of said lancing means for progressively bending said lanced stock without contacting said lanced ventilation panel portions of the stock; and elongated stock support means extending adjacent some of said roll forming means of said second group for supporting longitudinally extending portions of the stock adjacent the lateral edges of said stock and for assisting said second group of roll forming means in progressively bending said lanced stock into the predetermined roof ridge vent cross section.

14. An apparatus as defined by claim 13 wherein said elongated stock support means comprises a pair of inclined, longitudinally extending generally flat support bars, said support bars converging towards each other as they extend adjacent and in cooperative relationship with some of said roll forming means of said second group, said bars each being progressively inclined at a more acute angle relative to vertical in order to assist in bending the ventilation panel portion of the stock to a substantially horizontal position.

15. An apparatus as defined by claim 14 further including a straightener means positioned downstream of the last roll forming means of said second group for straightening said stock after it has been bent into the roof ridge vent cross section.

16. An apparatus as defined by claim 15 wherein said straightener means comprises:

a multi-section die having a through passage in the same cross-sectional configuration as the roof ridge vent.

17. An apparatus as defined by claim 16 wherein the inlet to said straightener means passage converges inwardly to insure smooth entry of the continuously moving stock into said straightener.

18. An apparatus as defined by claim 14 wherein said lancing means includes means for hooding said vent openings with oppositely offset straps at alternating transversely spaced areas of said ventilation portions of said stock and for forming louvered vent openings extending longitudinally of the outer lateral edge of said ventilation portions of said stock .

19. An apparatus as defined by claim 18 further including:

rotary nail punch means positioned upstream of said first group of roll forming means for punching longitudinally spaced nail holes immediately adjacent the lateral edges of said stock.

20. An apparatus as defined by claim 18 wherein said lancing means lances said longitudinally extending rows of vent openings in the stock in longitudinally spaced groups.

21. An apparatus as defined by claim 20 further including cutoff means positioned downstream of said second group of roll forming means for cutting said stock into sections of appropriate length while said stock is continuously moving through said apparatus.

22. An apparatus as defined by claim 21 wherein said cutoff means includes control means for actuating said cutoff means, said control means counting the vent opening longitudinal groups lanced by said lancing means and actuating said cutoff means after a predetermined number have been counted.

23. An apparatus for continuously lacing a generally, vertical flat transverse section of sheet stock continuously pulled through said apparatus, comprising:

a support member;

a set of inner and outer lancing rolls supported on said support member for rotation about their vertical axes, said rolls positioned on said member to define a nip through which said stock is fed; one of said rolls including a plurality of circumferentially extending rows of lancing teeth and the other of said rolls including circumferentially extending grooves around the periphery thereof said lancing teeth of one of said rolls positioned to extend partially into the circumferential groove of said other of said rolls;

means for shifting one of said lancing rolls relative to the other whereby the depth of lance may be varied;

drive means operatively engaging said rolls for rotating said rolls;

another set of inner and outer lancing rolls offset from said set of lancing rolls in the direction of stock travel, said inner roll of said another set being spaced from but adjacent to said inner roll of said set whereby generally parallel, vertical portions of the stock may be lanced simultaneously;

second drive means operatively engaging said another set of lancing rolls for rotating said rolls at a peripheral speed substantially equal to the peripheral speed of the other set of lancing rolls, said drive means and said second drive means each comprising variable torque motors geared to the outer rolls of each lancing roll set, whereby the torque exerted on one of said sets of lancing rolls may be varied to counteract any twisting of the stock introduced as a result of the offset between the lancing roll sets.

24. An apparatus as defined by claim 23 wherein each of said outer rolls and each of said inner rolls of said lancing sets include circumferentially extending rows of laching teeth and circumferentially extending grooves whereby the stock is double lanced and openings are hooded by oppositely offset straps.

25. An apparatus as defined by claim 23 further including a variable center linkage and gear train means interconnecting said driven outer lance rolls with each other and with each of said inner lance rolls for maintaining the peripheral speed of each set of lancing rolls substantially equal.

26. A lancing apparatus adapted to lance vent openings in continuously fed stock which has been partially bent into a generally U-shaped cross section, the vent openings being lanced in longitudinally extending rows, transversely spaced in the vertical portions of the U-shaped stock, comprising:

a support member having a generally horizontal support surface;

a first set of paired outer and inner lancing rolls;

a second set of paired outer and inner lancing rolls, each of said inner and outer lancing rolls mounted on said support member for rotation about their vertical axes; and drive means operatively connected to each set of paired lancing rolls and interconnecting said paired sets for synchronizing and rotating said rolls at substantially the same speed and for preventing deformation of the stock.

27. An apparatus as defined by claim 26 wherein said inner rolls of each of said sets are offset in the direction of stock feed.

28. An apparatus as defined by claim 27 wherein the diameter of each of said outer lancing rolls is greater than the diameter of each of said inner rolls and said inner rolls are positioned substantially in line with each other.

29. An apparatus as defined by claim 28 wherein said drive means comprises:

a plurality of bearing blocks positioned on said support member concentric with a corresponding lancing roll;

a plurality of shafts, one of said shafts supported by one of said bearing blocks and having one end nonrotatably secured to a corresponding one of said lancing rolls;

a gear train means interconnecting each of said shafts for causing each set of paired lancing rolls to be driven at substantially the same peripheral speed.

30. An apparatus as defined by claim 29 further including means for adjusting the position of each outer lancing roll relative to its paired inner roll whereby the depth of lance may be varied and stock of varying thickness may be accommodated.

31. An apparatus as defined by claim 29 wherein said drive means further includes a pair of variable torque motors each geared to one of said outer lancing rolls whereby an tendency of the stock to twist as it passes through said apparatus due to the offset of said sets lancing rolls may be counteracted by increasing the torque applied to one of said outer lancing rolls.

32. An apparatus as defined by claim 31 wherein one of said lancing rolls of each paired set includes a plurality of teeth extending around the periphery of the roll in transversely spaced rows and the other of said rolls of each paired set includes a plurality of transversely spaced continuous grooves extending around the periphery thereof.

33. An apparatus as defined by claim 31 wherein each of said inner and outer lancing rolls of each paired set includes a plurality of alternating transversely spaced rows of lancing teeth and continuous grooves extending around the periphery thereof whereby the stock passing through the nip of each paired set is lanced in a pattern resulting in longitudinally extending, transversely spaced rows of alternating oppositely offset hooded vent openings defined by offset straps.

34. An apparatus as defined by claim 28 wherein each of said outer lancing rolls includes an outwardly extending circumferential flange, said flange dimensioned so as to support and position said stock from below as said stock passes through said apparatus.

35. An apparatus for continuously lancing a generally planar vertical first leg of an L-shaped section of continuously fed sheet-like strip stock, the stock having a lower generally horizontal second leg, said apparatus comprising:

a support member;

a set of inner and outer lancing rolls supported on said support member for rotation about their veritcal axes, said rolls positioned on said member to define a nip through which said stock is fed; one of said rolls including a plurality of circumferentially extending rows of lancing teeth and the other of said rolls including circumferentially extending grooves around the periphery thereof, said lancing teeth of one of said rolls positioned to extend partially into the circumferential groove of said other of said rolls;

drive means operatively engaging said rolls for rotating said rolls at a peripheral velocity substantially equal to the linear velocity of said stock;

one of said rolls having a generally horizontally extending flange passing beneath said second leg for vertically positioning said stock with respect to said lancing teeth.

36. An apparatus for continuously lancing the generally planar vertical legs of a generally U-shaped section of continuously fed sheet-like strip stock, the stock having a lower web interconnecting the legs, said apparatus comprising:

a support member;

a first set of inner and outer lancing rolls supported on said support member for rotation about their vertical axes, said rolls positioned on said member to define a nip through which one vertical leg of said stock is fed; said inner lancing roll being positioned within said stock; one of said rolls including a plurality of circumferentially extending rows of lancing teeth and the other of said rolls including circumferentially extending grooves around the periphery thereof, said lancing teeth of one of said rolls positioned to extend partially into the circumferential groove of said other of said rolls;

a second set of inner and outer lancing rolls indentical to those of said first set and defining a nip through which the other vertical leg of said stock is fed; said second set of lancing rolls being offset from said first set in the longitudindal direction of said stock; and separate drive means operatively engaging each of said sets of rolls for rotating said rolls at a peripheral velocity substantially equal to the linear velocity of said stock, said first and second sets of rolls being interconnected by a gear train and said drive means for the set of said rolls upstream in the direction of movement of said stock being driven at a slightly greater torque than said other set of rolls.

37. Apparatus as described in claim 36 wherein said drive means are air motors.

38. An apparatus as described in claim 37 wherein said gear train has a floating mount means for the inner roll of each of said sets for permitting the depth of penetration of said rolls with respect to each other to be varied without interruption of the gear train.

39. A method of forming a product having a complex cross-sectional shape from continuously moving initially flat stock material, comprising the steps of:

bending the stock by progressively varying the angular relationship of longitudinally extending portions of the continuously moving stock;

reverse bending portions of the stock while simultaneously varying the angular relationship of other portions of the stock until at least one portion of the stock is in a substantially vertical plane;

lancing areas of the portion of the stock in a vertical plane after portions of the stock have been reverse bent on themselves;

bending said stock further by progressively varying the angular relationship of portions of the stock;

supporting said stock adjacent its lateral edges so that the progressive bending into the final predetermined cross section may be accomplished without contact with the lanced portions of said stock; and rotating, simultaneously with said supporting step, the lanced portions of the stock inwardly.

40. A method as defined by claim 39 wherein said bending steps include the steps of forming clear crease lines between angularly related portions of the stock.

41. A method as defined by claim 40 wherein said supporting of said stock is performed during selected portions only of the further progressive bending of said stock.

42. A method for forming on a continuous basis from a linearly moving continuous length of initially flat stock, a roof ridge vent of the type having a hood defined by angularly related longitudinally extending portions, generally horizontal, inwardly directed ventilation panels, integral internal dams defined by reversed bent portions and downwardly angle, outwardly extending flashing portions comprising the steps of:

bending said stock at longtiudinally spaced points by progressively and incrementally varying the angular relationship of longitudinally extending portions of said stock until the ventilation panel portions of the stock are in a substantially vertical plane and the reversed bent integral dam portions of said stock are formed and positioned in a substantially horizontal plane;

lancing said stock after said initial progressive bending so that a plurality of longitudinally extending, transversely spaced vent openings are formed in the substantially vertical panel portions of the stock;

bending said stock further after said lancing step; and simultaneously rotating the ventilation panel portions of the stock inwardly to a substantially horizontal position during said further bending.

43. A method as defined by claim 42 including the further step of supporting the stock adjacent the lateral edges during the further bending step and the ventilation panel rotating step.

44. A method as defined by claim 43 including the additional step of bending said flashing portions of the stock into the predetermined cross section after said ventilation panel portions are rotated to a substantially horizontal position.

45. A method as defined by claim 44 wherein said lancing step includes the step of forming hooded vent openings in the ventilation panel portions of the stock.

46. A method as defined by claim 45 wherein said step of forming hooded vent openings in the ventilation panel portions comprises the additional step of hooding the vent openings with alternating, oppositely offset straps.

47. A method as defined by claim 46 further including the step of:

punching longitudinally spaced, tandem nail holes in the stock prior to bending of the material.

48. A method as defined by claim 47 further including the step of:

deforming said stock stock adjacent the lateral edges thereof to form longitudinally extending stiffening lips after said stock has been progressively bent into the predetermined vent cross-sectional shape.

49. A method as defined by claim 46 further including the step of:

straightening the stock after the further progressive bending by passing the stock through a straightener die.

50. A method as defined by claim 49 further including the step of cutting said stock after it is bent into the predetermined cross section into sections of suitable length.

51. A method as defined by claim 50 wherein said lancing step includes the step of forming said vent openings in longitudinally extending and spaced grouped rows.

52. A method as defined by claim 51 wherein said cutting step includes the steps of:

counting the grouped rows of vent openings and cutting said stock after a predetermined number have been counted.

53. A method as defined by claim 44 wherein said lancing step further includes the step of supporting said stock from beneath during said lancing step.

54. A method as defined by claim 46 wherein said lancing step further includes the step of single, lanced baffled vent openings extending longitudinally adjacent the lateral edge of said ventilation panel portions remote from said reversed bent dam portions of the stock.

55. The method of forming a ridge vent for a roof having a hood-like top, an inner throat portion, outwardly extending flashings and inwardly extending, generally horizontal ventilation panels equipped with ventilation openings each shielded by a cover portion, said covers being offset from both faces of said panels, said method including the steps of providing a continuous strip of metal, forming from said strip by progressive rolling deformation the hood portion with said ventilation panels extending vertically and the throat portions defining walls and the flashings extending generally horizontally outwardly from the top of said ventilation panels, forming by horizontally shearing and offset through said ventilation panels said ventilation openings and covers therefor; providing at least one pair of progressively converging side straps along which the throat sidewalls and flashing portions of said vent are wiped and simultaneously supporting the lower edges of said panels by deforming rollers, said rollers and wiping straps cooperatively and progressively rocking said ventilation panels into an inwardly extending horizontal position and said throat walls and flashings into a vertical position; progressively bending said flashings into their outwardly flared position.

56. The method of forming a ridge vent for a roof as described in claim 55 wherein said strip at the point which is to become the inner edge of each of the ventilation panels is first crimped and then progressively folded over upon itself simultaneoulsy with the erection of the ventilation panels from a generally horizontal to said vertical position to form a pair of integral double thickness dams in said ridge vent, said dams extending inwardly normal to said ventilation panels.

57. The method of forming a ridge bent for a roof as described in claim 56 wherein the portions of said strip which will form the throat portion walls and the flashings are progressively moved inwardly as the dam forming folding over and ventilation panel erection occurs.

58. The method of forming by progressive rolling deformation a ridge vent for a roof having a hood-like top, an inner throat portion, outwardly extending flashings and inwardly extending, generally horizontal ventilation panels equipped with ventilation openings each shielded by an offset cover member, said covers being offset from both faces of said panels, said method including the steps of providing a continuous strip of metal, forming in said strip bend lines defining the outer edges of the hood portion and defining said ventilation panels, starting at the bend line which is to become the inner edge of each of the ventilation panels first crimping said strip into a generally Z-shape and then progressively folding it over upon itself to form a pair of integral, double thickness dams, simultaneously with the folding, erecting the ventilation panels to vertical position and positioning said dams to extend inwardly normal to said ventilation panels whereby the central portion of said strip assumes a generally upwardly opening, U-shaped configuration partially closed at the top by said dams, the side margins of said strip extending generally horizontally from said dams, said side margins of said strip being shifted progressively inwardly as the dams are formed; forming by horizontal shearing and offset through said ventilation panels said ventilation openings and cover members; providing at least one pair of progressively converging side straps along which the throad sidewalls and flashing portions of said vent are wiped and simultaneously supporting the lower edges of said ventilation panels by deforming rollers, said rollers and wiping straps progressively rocking said ventilation panels into an inwardly extending horizontal position and side margins of said strip into a vertical position; progressively bending side margins into their outwardly flared position as flashings.

* * * * *

UNITED STATES PATENT AND TRADEMARK OFFICE

CERTIFICATE OF CORRECTION

PATENT NO. : 4,050,277

DATED : September 27, 1977

INVENTOR(S) : Malott et al

It is certified that error appears in the above-identified patent and that said Letters Patent are hereby corrected as shown below:

Column 11, line 48

"Thebearing" should be --The bearing--

Column 20, line 56

"bevelled" should be --beveled--

Column 23, line 25

"lacing" should be --lancing--

Column 23, line 64

"laching" should be --lancing--

Column 25, line 50

"indentical" should be --identical--

Column 26, line 37

"angle" should be --angled--

Column 27, line 10

"stock stock" should be --stock--

UNITED STATES PATENT AND TRADEMARK OFFICE

CERTIFICATE OF CORRECTION

PATENT NO. : 4,050,277

DATED : September 27, 1977

INVENTOR(S) : Malott et al

It is certified that error appears in the above-identified patent and that said Letters Patent are hereby corrected as shown below:

Column 27, line 52

"horizontally" should be --horizontal--

Column 28, line 16

"bent" should be --vent--

Column 28, line 49

"throad" should be --throat--

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*